US012773602B2

(12) United States Patent
Clarke et al.

(10) Patent No.: US 12,773,602 B2
(45) Date of Patent: Oct. 27, 2026

(54) CLUB HEADS HAVING REINFORCED CLUB HEAD FACES AND RELATED METHODS

(71) Applicant: KARSTEN MANUFACTURING CORPORATION, Phoenix, AZ (US)

(72) Inventors: Jacob T. Clarke, Apex, NC (US); Ryan M. Stokke, Anthem, AZ (US); Cory S. Bacon, Cave Creek, AZ (US); Martin R. Jertson, Phoenix, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 235 days.

(21) Appl. No.: 18/680,655

(22) Filed: May 31, 2024

(65) Prior Publication Data

US 2024/0316418 A1 Sep. 26, 2024

Related U.S. Application Data

(63) Continuation of application No. 17/816,295, filed on Jul. 29, 2022, now Pat. No. 11,998,812, which is a (Continued)

(51) Int. Cl.
*A63B 53/04* (2015.01)
*A63B 53/06* (2015.01)
(Continued)

(52) U.S. Cl.
CPC ..... *A63B 53/0475* (2013.01); *A63B 53/047* (2013.01); *A63B 53/06* (2013.01);
(Continued)

(58) Field of Classification Search
CPC ... A63B 53/0475; A63B 53/047; A63B 53/06; A63B 60/02; A63B 60/54;
(Continued)

(56) References Cited

U.S. PATENT DOCUMENTS 1,359,220 A 11/1920 Beamer
4,667,963 A 5/1987 Yoneyama
(Continued)

FOREIGN PATENT DOCUMENTS

CN 104740854 7/2015
JP H06-023553 3/1994
(Continued)

OTHER PUBLICATIONS

International Search Report dated Jul. 27, 2015 from corresponding PCT Application No. PCT/US2015/030076, filed May 11, 2015.
(Continued)

*Primary Examiner* — Jeffrey S Vanderveen

(57) ABSTRACT

Some embodiments include club heads having reinforced club head faces. In one example, the club head comprises a variable face thickness with thickened and thinned regions. The face includes a thinned perimeter region positioned near a perimeter of the face, and a thickened central region positioned over a geometric center of the face. The club head further comprises a 360 undercut that extends along the entire perimeter of the face. The combination of the thinned perimeter region, thickened central region, and 360 undercut reinforces the club head while permitting the face to bend. Other embodiments of related club heads and methods are also disclosed.

20 Claims, 23 Drawing Sheets

Related U.S. Application Data continuation of application No. 17/001,517, filed on Aug. 24, 2020, now Pat. No. 11,406,883, which is a continuation of application No. 16/407,465, filed on May 9, 2019, now Pat. No. 10,751,587, which is a continuation-in-part of application No. 16/282,020, filed on Feb. 21, 2019, now Pat. No. 10,918,919, which is a continuation of application No. 15/644,653, filed on Jul. 7, 2017, now Pat. No. 10,258,843, which is a continuation-in-part of application No. 15/628,639, filed on Jun. 20, 2017, now Pat. No. 10,888,743, and a continuation-in-part of application No. 15/170,593, filed on Jun. 1, 2016, now Pat. No. 10,905,926, said application No. 15/628,639 is a continuation-in-part of application No. 14/920,480, filed on Oct. 22, 2015, now Pat. No. 10,688,350, and a continuation-in-part of application No. 14/920,484, filed on Oct. 22, 2015, now abandoned, said application No. 15/170,593 is a continuation-in-part of application No. 14/710,236, filed on May 12, 2015, now Pat. No. 10,905,925.

(60) Provisional application No. 62/821,965, filed on Mar. 21, 2019, provisional application No. 62/669,230, filed on May 9, 2018, provisional application No. 62/521,998, filed on Jun. 19, 2017, provisional application No. 62/359,450, filed on Jul. 7, 2016, provisional application No. 62/280,035, filed on Jan. 18, 2016, provisional application No. 62/266,074, filed on Dec. 11, 2015, provisional application No. 62/206,152, filed on Aug. 17, 2015, provisional application No. 62/169,089, filed on Jun. 1, 2015, provisional application No. 62/146,783, filed on Apr. 13, 2015, provisional application No. 62/131,739, filed on Mar. 11, 2015, provisional application No. 62/105,464, filed on Jan. 20, 2015, provisional application No. 62/105,460, filed on Jan. 20, 2015, provisional application No. 62/101,926, filed on Jan. 9, 2015, provisional application No. 62/068,232, filed on Oct. 24, 2014, provisional application No. 62/023,819, filed on Jul. 11, 2014, provisional application No. 61/994,029, filed on May 15, 2014.

(51) Int. Cl.
*A63B 60/02* (2015.01)
*A63B 60/52* (2015.01)
*A63B 60/54* (2015.01)

(52) U.S. Cl.
CPC ..... *A63B 60/02* (2015.10); *A63B 60/54* (2015.10); *A63B 53/0408* (2020.08); *A63B 53/0416* (2020.08); *A63B 53/0445* (2020.08); *A63B 53/0454* (2020.08); *A63B 53/0458* (2020.08); *A63B 2053/0491* (2013.01); *A63B 60/52* (2015.10); *Y10T 29/49828* (2015.01)

(58) Field of Classification Search
CPC ..... A63B 53/0408; A63B 53/0416; A63B 53/0445; A63B 53/0454; A63B 53/0458; A63B 60/52; A63B 2053/0491; A63B 60/00; A63B 60/002; Y10T 29/49828
See application file for complete search history.

(56) References Cited

U.S. PATENT DOCUMENTS

D319,091 S 8/1991 Antonious
D327,720 S 7/1992 Antonious
D332,478 S 1/1993 Antonious
5,282,625 A 2/1994 Schmidt
5,409,229 A 4/1995 Schmidt
5,540,436 A 7/1996 Boone
5,564,705 A 10/1996 Kobayashi
5,586,947 A 12/1996 Hutin
5,595,552 A 1/1997 Wright
5,643,099 A 7/1997 Solheim
5,649,872 A 7/1997 Antonious
5,695,411 A 12/1997 Wright
5,766,092 A 6/1998 Mimeur
5,776,010 A 7/1998 Helmstetter
5,776,011 A 7/1998 Su
5,873,795 A 2/1999 Wozny
5,971,868 A 10/1999 Kosmatka
6,290,607 B1 9/2001 Gilbert
6,319,149 B1 11/2001 Lee
6,348,013 B1 2/2002 Kosmatka
6,379,265 B1 4/2002 Hirakawa
6,475,427 B1 11/2002 Deshmukh
6,482,104 B1 11/2002 Gilbert
6,533,679 B1 3/2003 McCabe
6,572,491 B2 6/2003 Hasebe
6,616,546 B2 9/2003 Cho
6,688,989 B2 2/2004 Best
6,780,123 B2 8/2004 Hasebe
6,841,014 B2 1/2005 Huang
6,849,005 B2 2/2005 Rife
6,855,069 B2 2/2005 Nagai
6,872,153 B2 3/2005 Gilbert
6,971,961 B2 12/2005 Chen
6,991,559 B2 1/2006 Yabu
6,997,820 B2 2/2006 Willett
7,018,303 B2 3/2006 Yamamoto
7,018,305 B2 3/2006 Sugimoto
RE39,178 E 7/2006 Allen
7,083,530 B2 8/2006 Wahl
7,083,531 B2 8/2006 Aguinaldo
7,126,339 B2 10/2006 Nagai
7,144,337 B2 12/2006 Hirano
7,182,698 B2 2/2007 Tseng
7,192,364 B2 3/2007 Long
7,207,900 B2 4/2007 Nicolette
7,232,381 B2 6/2007 Imamoto
D554,217 S 10/2007 Ruggiero
D554,218 S 10/2007 Ruggiero
7,351,164 B2 4/2008 Schweigert
7,377,861 B2 5/2008 Tateno
7,387,579 B2 6/2008 Lin
7,390,270 B2 6/2008 Roberts
7,431,668 B2 10/2008 Tateno
7,435,189 B2 10/2008 Hirano
7,435,191 B2 10/2008 Tateno
D581,000 S 11/2008 Nicolette
7,448,964 B2 11/2008 Schweigert
7,455,597 B2 11/2008 Matsunaga
7,469,321 B2 12/2008 Heller, Jr.
7,470,200 B2 12/2008 Sanchez
7,503,853 B2 3/2009 Matsunaga
7,513,836 B2 4/2009 Matsunaga
7,585,232 B2 9/2009 Krumme
7,588,504 B2 9/2009 Matsunaga
7,591,735 B2 9/2009 Matsunaga
7,594,864 B2 9/2009 Sukman
D602,103 S 10/2009 Jorgensen
7,597,633 B2 10/2009 Shimazaki
7,611,423 B2 11/2009 Matsunaga
7,731,604 B2 * 6/2010 Wahl ..... A63B 53/047 473/337
7,744,486 B2 6/2010 Hou
7,749,102 B2 7/2010 Nakamura
7,762,907 B2 7/2010 Rice
D621,893 S 8/2010 Nicolette
7,798,915 B2 9/2010 Matsunaga
D635,627 S 4/2011 Nicolette
8,012,040 B2 9/2011 Takechi
8,043,165 B2 10/2011 Galloway
8,109,842 B2 2/2012 Matsunaga
8,182,365 B2 5/2012 Wada

(56) References Cited

U.S. PATENT DOCUMENTS

| | | | |
|---|---|---|---|
| 8,197,355 | B2 | 6/2012 | Galloway, Sr. |
| 8,246,489 | B2 | 8/2012 | Yamamoto |
| 8,262,495 | B2 | 9/2012 | Stites |
| 8,267,807 | B2 | 9/2012 | Takechi |
| 8,277,337 | B2 | 10/2012 | Shimazaki |
| 8,282,506 | B1 | 10/2012 | Holt |
| 8,353,785 | B2 | 1/2013 | Ines |
| 8,382,609 | B2 | 2/2013 | Yokota |
| 8,403,771 | B1 | 3/2013 | Rice |
| 8,409,022 | B2 | 4/2013 | Oldknow |
| 8,535,177 | B1 | 9/2013 | Wahl |
| 8,647,217 | B2 | 2/2014 | Nishio |
| 8,651,975 | B2 | 2/2014 | Soracco |
| 8,657,701 | B2 | 2/2014 | Boyd |
| 8,657,703 | B2 | 2/2014 | Wada |
| 8,690,710 | B2 | 4/2014 | Nicolette |
| 8,753,230 | B2 | 6/2014 | Stokke |
| 8,870,681 | B2 | 10/2014 | Yamamoto |
| 8,920,258 | B2 | 12/2014 | Dolezel |
| 8,932,149 | B2 | 1/2015 | Oldknow |
| 8,956,242 | B2 | 2/2015 | Rice |
| 9,005,046 | B2 | 4/2015 | Thomas |
| 9,011,266 | B2 | 4/2015 | Brunski |
| 9,033,820 | B2 | 5/2015 | Kato |
| 9,044,653 | B2 | 6/2015 | Wahl |
| 9,079,078 | B2 | 7/2015 | Greensmith |
| 9,079,080 | B2 | 7/2015 | Jertson |
| 9,079,081 | B2 | 7/2015 | Shimazaki |
| 9,089,747 | B2 | 7/2015 | Boyd |
| 9,220,654 | B2 | 12/2015 | Barlow |
| 9,265,995 | B2 | 2/2016 | Wahl |
| 9,393,469 | B2 | 7/2016 | Shimahara |
| 9,415,280 | B2 | 8/2016 | Stokke |
| 9,433,835 | B2 | 9/2016 | Sugimae |
| 9,492,722 | B2 | 11/2016 | Taylor |
| 9,522,311 | B2 | 12/2016 | Doi |
| 9,597,562 | B2 | 3/2017 | Dipert |
| 9,610,481 | B2 | 4/2017 | Parsons |
| 9,669,271 | B2 | 6/2017 | Soracco |
| 9,675,852 | B2 | 6/2017 | Westrum |
| 9,764,208 | B1 | 9/2017 | Parsons |
| 9,802,091 | B2 | 10/2017 | Taylor |
| 9,814,952 | B2 | 11/2017 | Parsons |
| 9,844,710 | B2 | 12/2017 | Parsons |
| 9,901,792 | B2 | 2/2018 | Franklin |
| 9,908,018 | B2 | 3/2018 | Roberts |
| 9,937,395 | B2 | 4/2018 | Taylor |
| 9,937,396 | B2 | 4/2018 | Stites |
| 9,950,219 | B2 | 4/2018 | Larson |
| 10,029,157 | B2 | 7/2018 | Sugimoto |
| 10,029,158 | B2 | 7/2018 | Parsons |
| 10,046,211 | B2 | 8/2018 | Franklin |
| 10,688,350 | B2 | 6/2020 | Jertson |
| 10,722,763 | B2 | 7/2020 | Abe |
| 10,751,587 | B2 | 8/2020 | Clarke |
| 10,905,925 | B2 | 2/2021 | Morales |
| 2002/0183134 | A1 | 12/2002 | Allen |
| 2006/0052179 | A1 | 3/2006 | Hou |
| 2007/0015601 | A1 | 1/2007 | Tsunoda |
| 2009/0017934 | A1 | 1/2009 | Stites |
| 2009/0023513 | A1 | 1/2009 | Shibata |
| 2009/0029790 | A1 | 1/2009 | Nicolette |
| 2009/0029796 | A1 | 1/2009 | Mergy |
| 2009/0239681 | A1 | 9/2009 | Sugimoto |
| 2010/0029544 | A1 | 2/2010 | Cheng |
| 2010/0041489 | A1 | 2/2010 | Elmer |
| 2011/0111883 | A1 | 5/2011 | Cackett |
| 2011/0183776 | A1 | 7/2011 | Breier |
| 2012/0077613 | A1* | 3/2012 | Jertson ..... A63B 60/02 473/290 |
| 2013/0109500 | A1 | 5/2013 | Boyd |
| 2013/0281229 | A1 | 10/2013 | Su |
| 2014/0080633 | A1* | 3/2014 | Bezilla ..... A63B 53/04 473/342 |
| 2015/0011326 | A1 | 1/2015 | Su |
| 2023/0264080 | A1* | 8/2023 | Nielson ..... A63B 53/02 473/336 |

FOREIGN PATENT DOCUMENTS

| | | |
|---|---|---|
| JP | H8-308967 | 11/1996 |
| JP | H9-215793 | 8/1997 |
| JP | H090225075 | 9/1997 |
| JP | 2001218880 | 8/2000 |
| JP | 2001009070 | 1/2001 |
| JP | 2001087430 | 4/2001 |
| JP | 4562862 | 12/2001 |
| JP | 2002095776 | 4/2002 |
| JP | 2002102396 | 4/2002 |
| JP | 2002186695 | 7/2002 |
| JP | 2002186696 | 7/2002 |
| JP | 2002331051 | 11/2002 |
| JP | 2003000773 | 1/2003 |
| JP | 2003062132 | 3/2003 |
| JP | 2003135632 | 5/2003 |
| JP | 3123825 | 7/2006 |
| JP | 2006212066 | 8/2006 |
| JP | 2008054985 | 3/2008 |
| JP | 2008073106 | 4/2008 |
| JP | 2010167131 | 8/2010 |
| JP | 2012166092 | 9/2012 |
| JP | 2012166093 | 9/2012 |
| JP | 2012213607 | 11/2012 |
| JP | 5315577 | 10/2013 |
| JP | 2014188194 | 10/2014 |
| JP | 5763701 | 8/2015 |
| TW | M297777 | 9/2006 |
| WO | 2004041372 | 2/2006 |

OTHER PUBLICATIONS

Written Opinion dated Jul. 27, 2015 from corresponding PCT application No. PCT/US2015/030076, filed May 11, 2015.

http://www.golfworks.com/product.asp_Q_pn_E_MA0225_A_Maltby+DBM+Forged+Iron_Heads_A_c2p_E_cs, "Maltby Dbm Forged Head", Accessed Oct. 15, 2015.

http://www.golfalot.com/equipment-news/taylormade-sldr-irons-2857.aspx, "Taylor Made Sldr Irons", Published May 5, 2014, Accessed Oct. 15, 2015.

http://www.golfwrx.com/322138/you-can-see-inside-cobras-king-ltd-drivers-and-fairway-woods/, "You can see inside Cobra's King Ltd drivers and fairway woods". Zak Kozuchowski, Accessed on Oct. 15, 2015.

International Search Report and Written Opinion from corresponding PCT Application No. PCT/US2015/056933, entitled "Golf Club Hads With Energy Storage Characteristics," filed Oct. 22, 2015.

International Search Report and Written Opinion, dated Aug. 22, 2017, from corresponding PCT Application No. PCT/US2016/035290, filed Jun. 1, 2016.

International Search Report and Written Opinion, dated Oct. 2, 2017, from corresponding PCT Application No. PCT/US2017/041250, filed Jul. 7, 2017.

International Search Report and Written Opinion, dated Oct. 31, 2017, from corresponding PCT Application No. PCT/US2017/038401, filed Jun. 20, 2017.

* cited by examiner

1002

1200

100

CLUB HEADS HAVING REINFORCED CLUB HEAD FACES AND RELATED METHODS

CROSS REFERENCE

This is a continuation of U.S. patent application Ser. No. 17/816,295, filed on Jul. 29, 2022, which is a continuation of U.S. patent application Ser. No. 17/001,517, filed Aug. 24, 2020, now U.S. Pat. No. 11,406,883, which is a continuation of U.S. patent application Ser. No. 16/407,465, filed on May 9, 2019, now U.S. Pat. No. 10,751,587, which is a continuation-in-part of U.S. patent application Ser. No. 16/282,020, filed on Feb. 21, 2019, now U.S. Pat. No. 10,918,919, which claims the benefit of U.S. Provisional Patent Appl. No. 62/821,965, filed on Mar. 21, 2019, and U.S. Provisional Patent Appl. No. 62/669,230, filed on May 9, 2018, and is a continuation of U.S. patent application Ser. No. 15/644,653, filed on Jul. 7, 2017, now U.S. Pat. No. 10,258,843, which claims the benefit of U.S. Provisional Patent Appl. No. 62/521,998, filed on Jun. 19, 2017, and U.S. Provisional Patent Appl. No. 62/359,450, filed Jul. 7, 2016, and is a continuation-in-part of U.S. application Ser. No. 15/170,593, filed on Jun. 1, 2016, now U.S. Pat. No. 10,905,926, which claims the benefit of U.S. Provisional Patent Appl. No. 62/280,035, filed Jan. 18, 2016, U.S. Provisional Patent Appl. No. 62/266,074, filed on Dec. 11, 2015, and U.S. Provisional Patent Appl. No. 62/169,089, filed on Jun. 1, 2015, and is a continuation-in-part of U.S. application Ser. No. 14/710,236, filed May 12, 2015, which claims the benefit of U.S. Provisional Patent Appl. No. 62/146,783, filed Apr. 13, 2015, U.S. Provisional Patent Appl. No. 62/101,926, filed on Jan. 9, 2015, U.S. Provisional Patent Appl. No. 62/023,819, filed on Jul. 11, 2014, and U.S. Provisional Patent Appl. No. 61/994,029, filed on May 15, 2014. U.S. patent application Ser. No. 15/644,653 further is a continuation-in-part of U.S. patent application Ser. No. 15/628,639, filed Jun. 20, 2017, now U.S. Pat. No. 10,888,743, which is a continuation-in-part of U.S. patent application Ser. No. 14/920,484, filed on Oct. 22, 2015, and U.S. patent application Ser. No. 14/920,480, filed on Oct. 22, 2015, now U.S. Pat. No. 10,688,350, which claims the benefit of U.S. Provisional Patent Appl. No. 62/206,152, filed Aug. 17, 2015, U.S. Provisional Patent Appl. No. 62/131,739, filed on Mar. 11, 2015, U.S. Provisional Patent Appl. No. 62/105,460, filed on Jan. 20, 2015, U.S. Provisional Patent Appl. No. 62/105,464, filed on Jan. 20, 2015, U.S. Provisional Patent Appl. No. 62/068,232, filed on Oct. 24, 2014, and said U.S. patent application Ser. No. 14/920,484, filed on Oct. 22, 2015 claims the benefit of U.S. Provisional Patent Appl. No. 62/206,152, filed on Aug. 17, 2015, U.S. Provisional Patent Appl. No. 62/131,739, filed on Mar. 11, 2015, U.S. Provisional Patent Appl. No. 62/105,460, filed on Jan. 20, 2015, U.S. Provisional Patent Appl. No. 62/105,464, filed on Jan. 20, 2015, and U.S. Provisional Patent Appl. No. 62/068,232, filed on Oct. 24, 2014. The contents of all of the above-described disclosures are incorporated fully herein by reference in their entirety.

TECHNICAL FIELD

This disclosure relates generally to sports equipment and relates more particularly to golf club heads and related methods.

BACKGROUND

Various characteristics of a golf club can affect the performance of the golf club. For example, the center of gravity, the moment of inertia, and the coefficient of restitution of the club head of the golf club are each characteristics of a golf club that can affect performance.

The center of gravity and moment of inertia of the club head of the golf club are functions of the distribution of mass of the club head. In particular, distributing mass of the club head to be closer to a sole of the club head, farther from a face of the club head, and/or closer to toe and heel ends of the club head can alter the center of gravity and/or the moment of inertia of the club head. For example, distributing mass of the club head to be closer to the sole of the club head and/or farther from the face of the club head can increase a flight angle of a golf ball struck with the club head. Meanwhile, increasing the flight angle of a golf ball can increase the distance the golf ball travels. Further, distributing mass of the club head to be closer to the toe and/or heel ends of the club head can affect the moment of inertia of the club head, which can alter the forgiveness of the golf club.

Further, the coefficient of restitution of the club head of the golf club can be a function of at least the flexibility of the face of the club head. Meanwhile, the flexibility of the face of the club head can be a function of the geometry (e.g., height, width, and/or thickness) of the face and/or the material properties (e.g., Young's modulus) of the face. That is, maximizing the height and/or width of the face, and/or minimizing the thickness and/or Young's modulus of the face, can increase the flexibility of the face, thereby increasing the coefficient of restitution of the club head; and increasing the coefficient of restitution of the club head of the golf club, which is essentially a measure of the efficiency of energy transfer from the club head to a golf ball, can increase the distance the golf ball travels after impact, decrease the spin of the golf ball, and/or increase the ball speed of the golf ball.

However, although thinning the face of the club head can permit mass from the face to be redistributed to other parts of the club head and can make the face more flexible, thinning the face of the club head also can result in increased bending in the face to the point of buckling and failure. Accordingly, devices and methods for preventing the face of a club head from buckling as the face of the club head is thinned are needed.

BRIEF DESCRIPTION OF THE DRAWINGS

To facilitate further description of the embodiments, the following drawings are provided in which.

Figure 1:
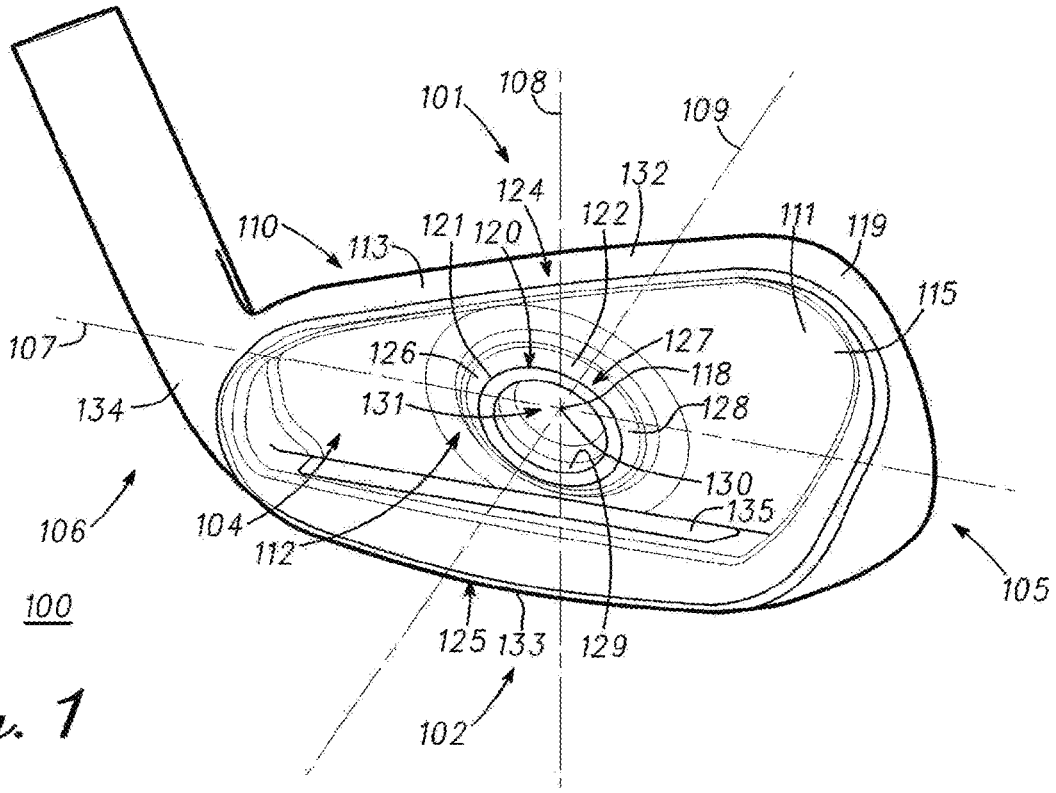
FIG. 1 illustrates a top, rear, toe side view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

Embodiments of a golf club head are described herein, wherein the golf club head can comprise an iron-type club head. More specifically, the iron-type club head can be a muscle-back iron-type club head, a cavity-back iron-type club head, a blade style iron-type club head, hollow body iron-type club head, a cavity-muscle back iron-type club head, high-MOI iron-type club head, or any other type of iron-type club head. The iron-type club head comprises a loft angle. The loft angle refers to the angle formed between a club face and a shaft. More specifically, the loft angle is measured from a vertical plane extending from a hosel/shaft centerline axis to a club face. The loft angle is measured rearward in a direction from the vertical plane to the club face of the iron-type club head.

For example, in some embodiments, the iron-type club head can have a loft angle less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

Further, in other embodiments, the loft angle of the iron-type club head is greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

Further, in other embodiments still, the loft angle of the iron-type club head can be 60 degrees, 59 degrees, 58 degrees, 57 degrees, 56 degrees, 55 degrees, 54 degrees, 53 degrees, 52 degrees, 51 degrees, 50 degrees, 49 degrees, 48 degrees, 47 degrees, 46 degrees, 45 degrees, 46 degrees, 45 degrees, 44 degrees, 43 degrees, 42 degrees, 41 degrees, 40 degrees, 39 degrees, 38 degrees, 37 degrees, 36 degrees, 35 degrees, 34 degrees, 33 degrees, 32 degrees, 31 degrees, 30 degrees, 29 degrees, 28 degrees, 27 degrees, 26 degrees, 25 degrees, 24 degrees, 23 degrees, 22 degrees, 21 degrees, 20 degrees, 19 degrees, 18 degrees, or 17 degrees.

DESCRIPTION

Described herein is an iron-type golf club head comprising a 360 degree undercut and a varying face thickness to maximize the ball speed and/or flight distance of a golf ball while maintaining club head durability over many golf ball impacts. To achieve these advantages, the iron-type club head includes a plurality of cavities that extend entirely around a perimeter of the face, and strategically positioned thickened and thinned regions on the face. More specifically, the face includes a thinned perimeter region positioned near the perimeter of the face, and a thickened central region positioned over a geometric center of the face. The thinned perimeter region comprising a minimum thickness of the face allows the face to bend, and the thickened central region comprising a maximum thickness of the face reinforces the face. The combination of the 360 undercut extending around the perimeter of the face, the thinned perimeter region, and the thickened central region reinforces the face while permitting the face to bend which provides the performance benefits of increased ball speed, increased flight distance, and increased clu head over many golf ball impacts.

Some embodiments include a golf club head. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toc end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a looped rib. Meanwhile, the face surface can be nearer to the rear surface proximal to the face center than proximal to the face perimeter.

Other embodiments include a golf club head. In some embodiments, the golf club head comprises an iron-type golf club head. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. Even further still, the golf club head comprises a perimeter wall element (i) extending out from the rear surface toward the rear end and away from the front end and (ii) extending entirely around the perimeter of the rear surface. The perimeter wall element comprises a first perimeter wall portion extending along the perimeter of the rear surface at the top end and a second perimeter wall portion extending along the perimeter of the rear surface at the bottom end. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toc end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a closed circular looped rib. Also, the golf club head comprises an iron-type golf club head, a center thickness from the face center to the rear center is less than or equal to approximately 0.203 centimeters, and at least part of the second perimeter wall portion is thinner than is the face element proximal to the face perimeter.

Some embodiments further include an insert that at least partially fills in a cavity of the reinforcement element that is formed by the looped rib. In some embodiments, the cavity can be a central cavity. The central cavity can also be partially covered by a badge. The badge can be separate from the insert or integral with the insert. In other embodiments, the badge can be integral with the reinforcement element. The insert can be of a lightweight material of about 3 g or less and may not significantly affect the center of gravity of the swing of the golf club head. In alternative embodiments, the insert can weigh more than 3 g, such as between 5 g and 10 g, and may contribute to the swing weight or the center of gravity of the club head.

Further embodiments include a vibration attenuating feature disposed on the rear surface of the golf club head to reduce noise, to produce a more desirable sound, and to reduce vibration of the golf club head. The vibration attenuating feature can be composed of any material or composition capable of damping or removing vibrations such as damping foil, rubber, or pressure sensitive viscoelastic acrylic polymer. The vibration attenuating feature may be pressure sensitive, leading to lessening or removal of vibration from the golf club head when a golf ball is struck. The viscoelastic damping feature provides the golf club head with a more desirable sound combined with getting greater performance in a thin-face golf club head. The vibration attenuating feature is at least partially applied to the rear surface of the golf club head. The vibration attenuating feature can also be applied to the reinforcement element. The vibration attenuating feature may be further applied to all or part of the cavity of the reinforcement element. The cavity can be a central cavity. The central cavity of the rear surface can also be partially covered by the vibration attenuating feature. The central cavity can also be partially covered by a badge, and the vibration attenuating feature can be disposed beneath the badge.

Further embodiments include a method of providing a golf club head. The method can comprise: providing a face element comprising: (i) a face surface located at the front end and comprising a face center and a face perimeter; and (ii) a rear surface located at the rear end and being approximately opposite to the face surface, the rear surface comprising a rear center approximately opposite the face center and a rear perimeter; and providing a reinforcement device at the rear surface. In these embodiments, the golf club head comprises a top end and a bottom end opposite the top end, a front end and a rear end opposite the front end, and a toc end and a heel end opposite the toe end. Further, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further still, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Meanwhile, the reinforcement device comprises a reinforcement element comprising a geometric center approximately located at the z-axis, the reinforcement element extends out from the rear surface toward the rear end and away from the front end, and the reinforcement element comprises a looped rib. Also, the face surface can be nearer to the rear surface proximal to the face center than proximal to the face perimeter.

Some embodiments include a golf club. The golf club comprises a shaft and a golf club head coupled to the shaft.

The golf club head comprises a top end and a bottom end opposite the top end, a front end and a rear end opposite the front end, and a toe end and a heel end opposite the toc end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a looped rib. Meanwhile, the face surface can be nearer to the rear surface proximal to the face center than proximal to the face perimeter.

Figure 2:
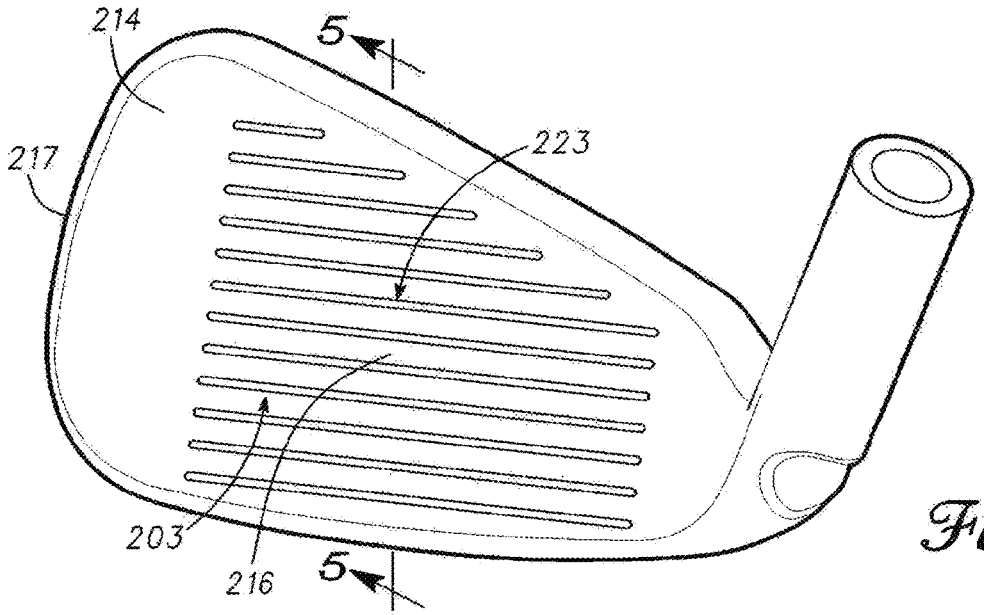
FIG. 2 illustrates a top, front, heel side view of the club head, according to the embodiment of FIG. 1.

Turning to the drawings, FIG. 1 illustrates a top, rear, toe side view of a club head 100, according to an embodiment. Meanwhile, FIG. 2 illustrates a top, front, heel side view of club head 100, according to the embodiment of FIG. 1. Club head 100 is merely exemplary and is not limited to the embodiments presented herein. Club head 100 can be employed in many different embodiments or examples not specifically depicted or described herein.

Figure 14:
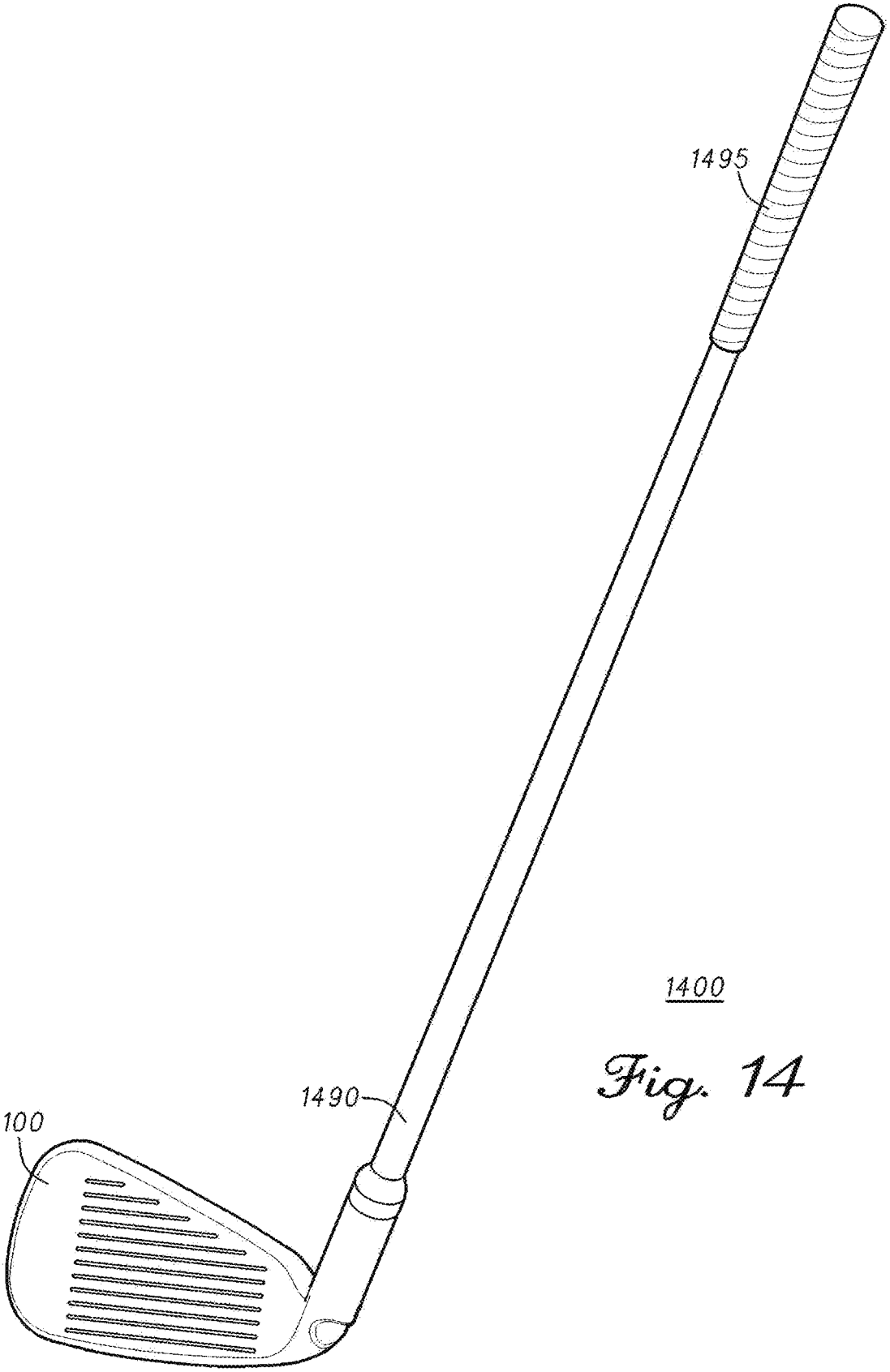
FIG. 14 illustrates a front view of a golf club, according to an embodiment.

Generally, club head 100 can comprise a golf club head. Golf club head 100 can be part of a corresponding golf club. For example, a golf club 1400 (FIG. 14) can comprise golf club head 100 coupled to a shaft 1490 and a grip 1495. Further, the golf club head can be part of a set of golf club heads, and/or the golf club can be part of a set of golf clubs. For example, club head 100 can comprise any suitable iron-type golf club head. In some embodiments, club head 100 can comprise a muscle-back iron-type golf club head or cavity-back iron-type golf club head. Generally, club head 100 can comprise any suitable materials, but in many embodiments, club head 100 comprises one or more metal materials. Notwithstanding the foregoing, the apparatus, methods, and articles of manufacture described herein are not limited in this regard.

For reference purposes, club head 100 comprises a top end 101 and a bottom end 102 opposite top end 101, a front end 203 (FIG. 2) and a rear end 104 opposite front end 203 (FIG. 2), and a toe end 105 and a heel end 106 opposite toe end 105. Also, club head 100 comprises an x-axis 107, a y-axis 108, and a z-axis 109.

Meanwhile, x-axis 107, y-axis 108, and z-axis 109 provide a Cartesian reference frame for club head 100. Accordingly, x-axis 107, y-axis 108, and z-axis 109 are perpendicular to each other. Further, x-axis 107 extends through toe end 105 and heel end 106 and is equidistant between top end 101 and bottom end 102; y-axis 108 extends through top end 101 and bottom end 102 and is equidistant between toe end 105 and heel end 106; and z-axis 109 extends through front end 203 (FIG. 2) and rear end 104 and is equidistant (i) between toe end 105 and heel end 106 and (ii) between top end 101 and rear end 102.

Club head 100 comprises a club head body 110. Club head body 110 can be solid, hollow, or partially hollow. When club head body 110 is hollow and/or partially hollow, club head body 110 can comprise a shell structure, and further, can be filled and/or partially filled with a filler material different from a material of shell structure. For example, the filler material can comprise plastic foam.

Club head body 110 comprises a face element 111 and a reinforcement device 112. In many embodiments, club head body 110 can comprise a perimeter wall element 113.

In many embodiments, face element 111 comprises a face surface 214 (FIG. 2) and a rear surface 115. Meanwhile, face surface 214 (FIG. 2) comprises a face center 216 (FIG. 2) and a face perimeter 217 (FIG. 2), and rear surface 115 comprises a rear center 118 and a rear perimeter 119. Face surface 214 (FIG. 2) can refer to a striking face or a striking plate of club head 100, and can be configured to impact a ball (not shown), such as, for example, a golf ball. In many embodiments, face surface 214 (FIG. 2) can comprise one or more scoring lines 223 (FIG. 2).

In these or other embodiments, face surface 214 (FIG. 2) can be located at front end 203 (FIG. 2), and rear surface 115 can be located at rear end 104. Further, rear surface 115 can be approximately opposite to face surface 214 (FIG. 2); rear center 118 can be approximately opposite face center 216 (FIG. 2); and rear perimeter 119 can be approximately opposite face perimeter 217 (FIG. 2). Generally, in many examples, face center 216 (FIG. 2) can refer to a geometric center of face surface 214 (FIG. 2). Accordingly, in these or other examples, face center 216 (FIG. 2) can refer to a location at face surface 214 (FIG. 2) that is approximately equidistant between toe end 105 and heel end 106 and further that is approximately equidistant between top end 101 and bottom end 102. In various examples, the face center can refer to the face center as defined at *United States Golf Association: Procedure for Measuring the Flexibility of a Golf Clubhead*, USGA-TPX 3004, Revision 1.0.0, p. 6, May 1, 2008 (retrieved May 12, 2014 from http://www.usga.org/equipment/testing/protocols/Test-Protocols-For-Equipment), which is incorporated herein by reference. Likewise, in some examples, rear center 118 can refer to a geometric center of rear surface 115.

By reference, x-axis 107 and y-axis 108 can extend approximately parallel to face surface 214 (FIG. 2), and z-axis 109 can extend approximately perpendicular to face surface 214 (FIG. 2). Meanwhile, each of x-axis 107, y-axis 108, and z-axis 109 can intersect rear center 118 such that rear center 118 comprises the origin of the Cartesian reference frame provided by x-axis 107, y-axis 108, and z-axis 109.

In various embodiments, scoring lines 223 (FIG. 2) can comprise one or more grooves, respectively, and can extend between toe end 105 and heel end 106. In these or other embodiments, scoring lines 223 (FIG. 2) can be approximately parallel to x-axis 107.

In many embodiments, reinforcement device 112 comprises one or more reinforcement elements 120 (e.g., reinforcement element 121). Reinforcement device 112 and/or reinforcement element(s) 120 are located at rear surface 115 and extend out from rear surface 115 toward rear end 104 and away from front end 203 (FIG. 2). In many embodiments, each reinforcement element of reinforcement element(s) 120 comprises an outer perimeter surface and a geometric center. In these or other embodiments, the geometric center(s) of one or more of reinforcement element(s) 120 (e.g., reinforcement element 121) can be located approximately at z-axis 109. For example, reinforcement element 121 can comprise outer perimeter surface 126 and geometric center 130.

Reinforcement device 112 and reinforcement element(s) 120 are configured to reinforce face element 111 while still permitting face element 111 to bend, such as, for example, when face surface 214 (FIG. 2) impacts a ball (e.g., a golf ball). As a result, face element 111 can be thinned to permit mass from face element 111 to be redistributed to other parts of club head 100 and to make face element 111 more flexible without buckling and failing under the resulting bending. Advantageously, because face element 111 can be thinner when implemented with reinforcement device 112 and reinforcement element(s) 120 than when implemented without reinforcement device 112 and reinforcement element(s) 120, the center of gravity, the moment of inertia, and the coefficient of restitution of club head 100 can be altered to improve the performance characteristics of club head 100. For example, implementing reinforcement device 112 and reinforcement element(s) 120 can increase a flight distance of a golf ball hit with face surface 214 (FIG. 2) by increasing a launch angle of the golf ball (e.g., by approximately 1-3 tenths of a degree), increase the ball speed of the golf ball (e.g., by approximately 0.1 miles per hour (mph) (0.161 kilometers per hour (kph) to approximately 3.0 mph (4.83 kph)), and/or decreasing a spin of the golf ball (e.g., by approximately 1-500 rotations per minute). In these examples, reinforcement device 112 and reinforcement element(s) 120 can have the effect of countering some of the gearing on the golf ball provided by face surface 214 (FIG. 2).

Testing of golf clubs comprising an embodiment of golf club head 100 was performed. Overall, when compared to an iron golf club with a standard reinforced strikeface and custom tuning port, the testing showed more forgiveness, as indicated by higher moments of inertia around the x-axis and/or the y-axis and a tighter statistical area of the impact of the golf ball on the face of the golf club head. In some testing, the moment of inertia about the x-axis increased by approximately 2%, the moment of inertia about the y-axis increased by approximately 4%, and/or the statistical area of the impact of the golf ball on the face of the golf club head was reduced by approximately 15-50 percent. Additionally, increased ball speed of the golf ball, higher launch angle of the golf ball, and/or decreased spin of the golf ball were found. As an example, in testing an embodiment of golf club 100 on a 5 iron golf club, it was found that the ball speed of the golf ball increased by approximately 1.5 mph (2.41 kph), the golf ball had an approximately 0.3 degree higher launch angle, and the spin of the golf ball decreased by approximately 250 revolutions per minute (rpm). In another example, in testing an embodiment of golf club 100 on a 7 iron golf club, it was found that the ball speed of the golf ball increased by approximately 2.0 mph (3.22 kph), the golf ball had approximately no launch angle degree change, and the spin of the golf ball decreased by approximately 450 rpm. As an additional example, in testing an embodiment of golf club 100 on a wedge iron golf club, it was found that the ball speed of the golf ball had approximately no change in speed, the golf ball had an approximately 0.1 degree higher launch angle, and the spin of the golf ball decreased by approximately 200 rpm.

Figure 3:
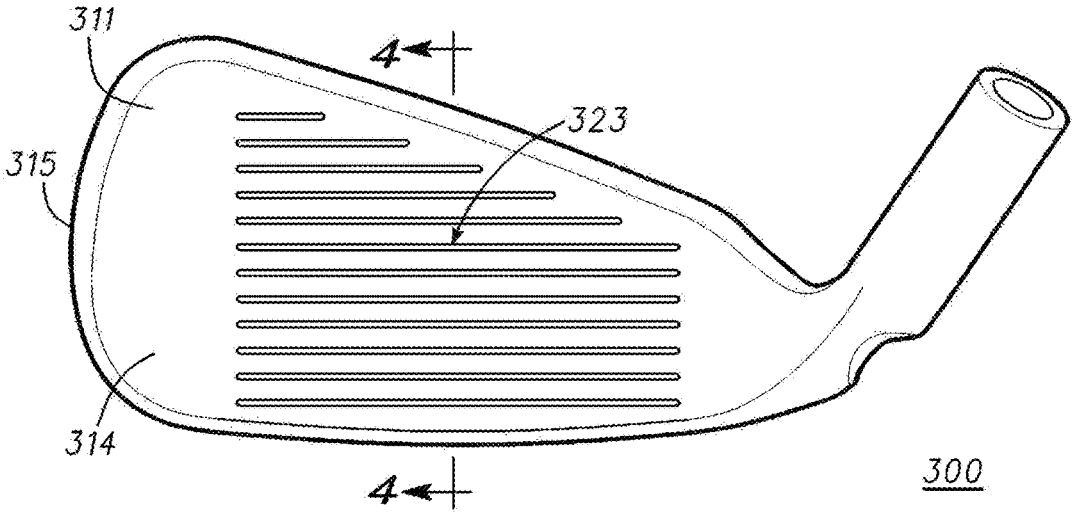
FIG. 3 illustrates a conventional club head, according to an embodiment.
Figure 4:
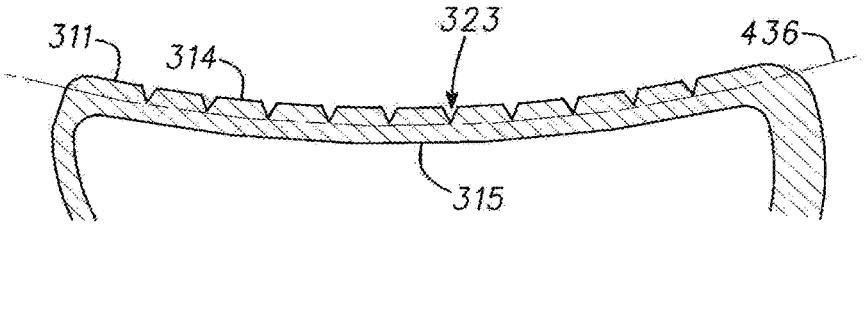
FIG. 4 illustrates a stress-strain analysis of a partial cross-sectional view of the conventional club head taken along section line 4-4 of FIG. 3 simulating a face surface of the conventional club head impacting a golf ball (not shown) where the resulting bending is multiplied three-fold, according to the embodiment of FIG. 3.

Notably, in many examples, when face element 111 comprises scoring line(s) 223 (FIG. 2) and face element 111 is thinned without implementing reinforcement device 112 and reinforcement element(s) 120, buckling and failure of face element 111 can occur at the bottom of scoring line(s) 223, particularly at scoring line(s) 223 (FIG. 2) proximal to face center 216 (FIG. 2), as illustrated at FIGS. 3 & 4 and described as follows with respect to FIGS. 3 & 4.

Club head 100 having reinforcement device 112 may also have a uniform transition thickness 550 (FIG. 5) extending from front end 203 to bottom end 102. Uniform transition thickness 550 absorbs stress directed to the region of club head 100 having reinforcement device 112 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

Specifically, turning ahead in the drawings, FIG. 3 illustrates conventional club head 300, according to an embodiment. Club head 300 can be similar to club head 100 (FIGS. 1 & 2), but unlike club head 100, is devoid of a reinforcement device and reinforcement elements at rear surface 315 of face element 311 of club head 300. Club head 300 comprises one or more scoring lines 323 at face surface 314 of club head 300. Rear surface 315 can be similar to rear surface 115 (FIG. 1); face element 311 can be similar or identical to face element 111 (FIG. 1); face surface 314 can be similar or identical to face surface 214 (FIG. 2); and/or scoring line(s) 323 can be similar or identical to scoring lines 223 (FIG. 2). Further, the absent reinforcement device can be similar to reinforcement device 112 (FIG. 1) and the absent reinforcement element(s) can be similar to reinforcement element(s) 120 (FIG. 1). Meanwhile, FIG. 4 illustrates a stress-strain analysis of a partial cross-sectional view of club head 300 taken along section line 4-4 of FIG. 3 simulating face surface 314 of club head 300 impacting a golf ball (not shown) where the resulting bending is multiplied three-fold, according to the embodiment of FIG. 3.

As demonstrated at FIG. 4, face element 311 behaves similarly to a simply supported beam and thus comprises neutral axis 436. The portion of face element 311 between face surface 314 and neutral axis 436 is in compression, and the portion of face element 311 between neutral axis 436 and rear surface 315 is in tension. Stress builds first at face surface 314 and rear surface 315 and moves inward toward neutral axis 436. However, unlike a simply supported beam, face element 311 also comprises scoring line(s) 323 at the portion of face element 311 that is in compression. When face element 311 bends too much, the mechanical yield of face element 311 in the bottom of scoring line(s) 323 can be reached. If not for scoring line(s) 323, face element 311 would ordinarily be expected to fail first in the portion of face element 311 that is under tension, but scoring line(s) 323 cause failure to occur first at the portion of face element 311 that is in compression. Namely, face element 311 fails at scoring line(s) 323 before the remainder of face element 311 has a chance to reach high enough stress levels to result in failure. Iron-type club heads can be more susceptible to failure at scoring line(s) 323 because iron-type club heads tend to be flat at face surface 314, unlike wood-type golf club head which tend to be convex at face surface 314. As a result, when wood-type golf club heads bend at face surface 314, face surface 314 can still be bowed somewhat outward. On the other hand, when iron-type golf club heads bend at face surface 314, face surface 314 can bend to a concave shape that increases the extent of the compression at the portion of face element 311 that is under compression.

Turning now back to FIGS. 1 & 2, implementing reinforcement device 112 and reinforcement element(s) 120 can reinforce a localized bending in scoring line(s) 223 (FIG. 2), particularly in those scoring line(s) of scoring line(s) 223 that are proximal to face center 216 (FIG. 2), while permitting increased overall bending in face element 111. Reinforcement device 112 and reinforcement element(s) 120 are able to provide these benefits by increasing the localized thickness of face element 111, making face element 111 stiffer and harder in those locations. In effect, reinforcement device 112 and reinforcement element(s) 120 are operable to pull a neutral axis of face element 111 away from face surface 214 (FIG. 2) and closer to rear surface 115.

Meanwhile, reinforcement device 112 and reinforcement element(s) 120 are further able to provide these benefits when implemented as a closed structure (e.g., one or more looped ribs) because such closed structures are able to resist deformation as a result of circumferential (i.e., hoop) stresses acting on reinforcement device 112 and reinforcement element(s) 120. For example, circumferential (i.e., hoop) stresses acting on reinforcement device 112 and reinforcement element(s) 120 can prevent opposing sides of reinforcement device 112 and reinforcement element(s) 120 from rotating away from each other, thereby reducing bending.

Further, reinforcement device 112 and reinforcement element(s) 120 absorb a substantial portion of the stress on club head 100 at impact, thereby preventing stress from being absorbed by other portions of club head 100 at impact, such as face element 111, face surface 214, and rear surface 115. Directing stress toward reinforcement device 112 and reinforcement element(s) 120 improves the durability of face element 111 and club head 100 compared to club head 300, devoid of a reinforcement device and reinforcement elements, or compared to a club head having reinforcement device 112 without or with fewer reinforcement element(s) 120.

In implementation, reinforcement element(s) 120 (e.g., reinforcement element 121) can be implemented in any suitable shape(s) (e.g., polygonal, elliptical, circular, etc.) and/or in any suitable arrangement(s) configured to perform the intended functionality of reinforcement device 112 and/or reinforcement element(s) 120 as described above. Further, when reinforcement element(s) 120 comprise multiple reinforcement elements, two or more reinforcement elements of reinforcement element(s) 120 can be similar to another, and/or two or more reinforcement elements of reinforcement element(s) 120 can be different from another.

In some embodiments, reinforcement element(s) 120 (e.g., reinforcement element 121) can be symmetric about x-axis 107 and/or y-axis 108. When reinforcement element(s) 120 (e.g., reinforcement element 121) are implemented with an oblong shape, in many embodiments, a largest dimension (e.g., major axis) of the reinforcement element(s) can be parallel and/or co-linear with one of x-axis 107 or y-axis 108. However, in other embodiments, the largest dimension (e.g., major axis) can be angled with respect to x-axis 107 and/or y-axis 108, as desired. Further, in many embodiments, reinforcement element(s) 120 (e.g., reinforcement element 121) can be centered at z-axis 109, but in some embodiments, one or more of reinforcement element(s) 120 (e.g., reinforcement element 121) can be biased off-center of z-axis 109, such as, for example, biased toward one or two of top end 101, bottom end 102, toe end 105, and heel end 106.

In many embodiments, each reinforcement element of reinforcement element(s) 120 (e.g., reinforcement element 121) can comprise one or more looped ribs 127 (e.g., looped rib 122). Specifically, reinforcement element 121 can comprise looped rib 122. In these or other embodiments, when looped rib(s) 127 comprise multiple looped ribs, looped rib(s) 127 can be concentric with each other about a point and/or axis (e.g., z-axis 109). In other embodiments, when looped rib(s) 127 comprise multiple looped ribs, two or more of looped rib(s) 127 can be nonconcentric. Further, in these or other embodiments, two or more of looped rib(s) 127 can overlap. Meanwhile, in these embodiments, looped rib 122 can comprise an elliptical looped rib, and in some of these embodiments, looped rib 122 can comprise a circular looped rib. As noted above, implementing reinforcement element(s) 120 as looped rib(s) 127 can be advantageous because of the circumferential (e.g., hoop) stress provided by the closed structure of looped rib(s) 127. In many embodiments, one or more of (or each of) looped rib(s) 127 is a continuous closed loop.

In these or other embodiments, each looped rib of looped rib(s) 127 comprises an outer perimeter surface and an inner perimeter surface. Meanwhile, in these embodiments, the outer perimeter surface of each reinforcement element (e.g., reinforcement element 121) comprises the outer perimeter surface of the looped rib corresponding to that reinforcement element (e.g., looped rib 122). For example, looped rib 122 can comprise outer perimeter surface 128 and inner perimeter surface 129. Further, inner perimeter surface 129 can be steep and substantially orthogonal at rib height 540 (FIG. 13) relative to the rear surface.

In some embodiments, one or more outer perimeter surface(s) of reinforcement element(s) 120 (e.g., outer perimeter surface 126 of reinforcement element 121) can be filleted with rear surface 115. In these or other embodiments, one or more inner perimeter surface(s) of looped rib(s) 127 (e.g., inner perimeter surface 129 of looped rib 122) can be filleted with rear surface 115. Filleting the outer perimeter surface(s) of reinforcement element(s) 120 (e.g., outer perimeter surface 126 of reinforcement element 121) with rear surface 115 can permit a smooth transition of reinforcement element(s) 120 (e.g., outer perimeter surface 126 of reinforcement element 121) into rear surface 115. Further, filleting the outer perimeter surface(s) of reinforcement element(s) 120 (e.g., outer perimeter surface 126 of reinforcement element 121) with rear surface 115 can direct stresses from impact into reinforcement element(s) 120 and away from the face surface 214. Meanwhile, outer perimeter surface(s) of reinforcement element(s) (e.g., outer perimeter surface 126 of reinforcement element 121) or inner perimeter surface(s) of looped rib(s) 127 (e.g., inner perimeter surface 129 of looped rib 122) can be filleted with rear surface 115 with a fillet 117 having a radius of greater than or equal to approximately 0.012 centimeters. For example, in some embodiments, the fillet 117 of the outer perimeter surface 126 with the rear surface 115 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 117 of the inner perimeter surface 129 with the rear surface 115 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface(s) of reinforcement element(s) can be filleted directly with rear surface 115. In these embodiments, the face thickness decreases gradually along the fillet 117 from face thickness at rib height 540 to face thickness at rear surface 115.

Figure 15:
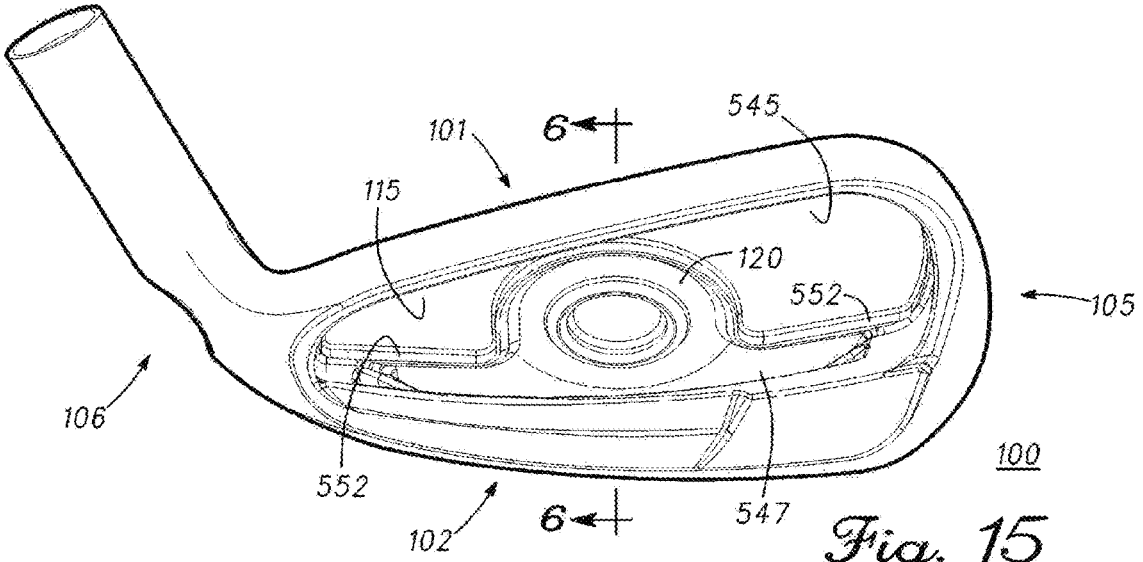
FIG. 15 illustrates a top, rear view of a club head, according to an embodiment.
Figure 16:
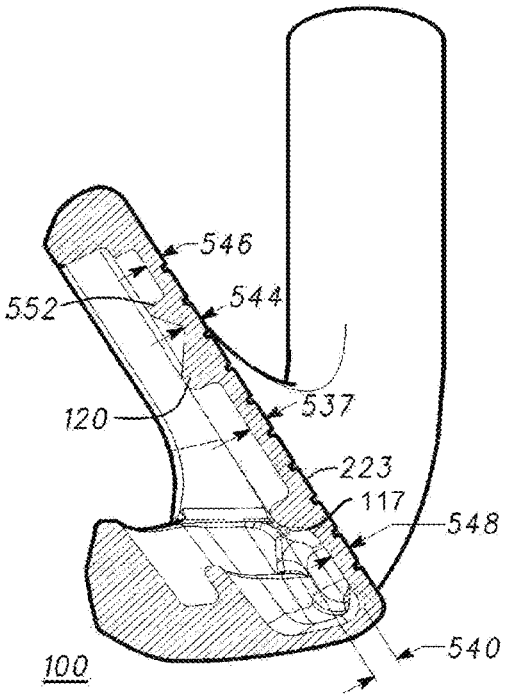
FIG. 16 illustrates a cross-sectional view of the club head taken along section line 6-6 of FIG. 15, according to the embodiment of FIG. 15.
Figure 17:
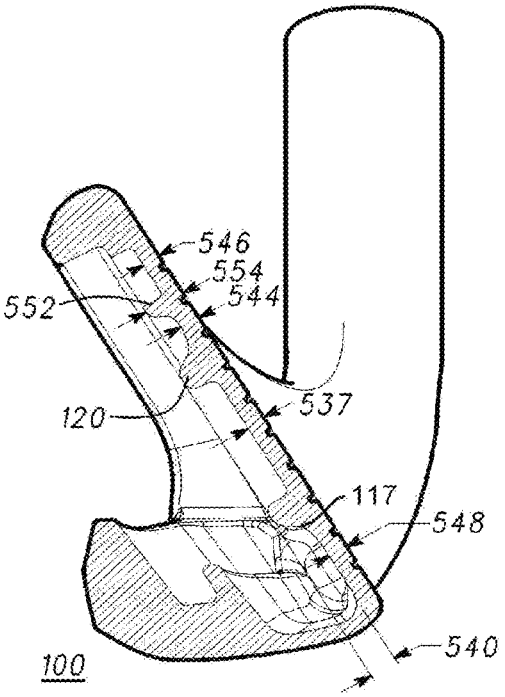
FIG. 17 illustrates a cross-sectional view of a club head according to another embodiment.

In some embodiments, club head 100 can further include a lip 552 on rear surface 115 of club head 100. Referring to FIGS. 15-17, in the illustrated embodiment, the lip 552 extends from the heel end 106 to the toe end 105 around the reinforcement element 120 of club head 100. In these or other embodiments, a fillet 117 on the outer perimeter surface of reinforcement element 120 can transition to the lip 552 such that the face thickness decreases gradually along the fillet 117 from the face thickness at rib height 540 to a minimum thickness 544, then increases gradually from the minimum thickness 544 to the face thickness at lip height 554. In these embodiments, the minimum thickness 544 between the reinforcement element 120 and the lip 552 can be greater than center thickness 537, the minimum thickness 544 between the reinforcement element 120 and the lip 552 can be approximately equal to center thickness 537, or the minimum thickness 544 between the reinforcement element 120 and the lip 552 can be less than center thickness 537. In the embodiment illustrated in FIGS. 15-16, the minimum thickness 544 between reinforcement element 120 and lip 552 is greater than center thickness 537. In the embodiment illustrated in FIG. 17, the minimum thickness 544 between reinforcement element 120 and lip 552 is approximately equal to center thickness 537.

In many embodiments, the minimum thickness 544 between the reinforcement element 120 and the lip 552 corresponds to faceplate bending and ball speed. As the minimum thickness 544 between the reinforcement element 120 and the lip 552 decreases, the outer perimeter surface of reinforcement element 120 can bend more during impact with a golf ball. Increased bending of the outer perimeter surface of reinforcement element 120 on impact allows increased faceplate deflection resulting in increased energy transfer to the golf ball and increased ball speed. For example, the golf club head 100 illustrated in FIG. 17 having a minimum thickness 544 between the reinforcement element 120 and the lip 552 approximately equal to center thickness 537 results in ball speeds up to 1 mile per hour (mph) faster than the club head 100 illustrated in FIGS. 15-16 having a minimum thickness 544 between the reinforcement element 120 and the lip 552 greater than center thickness 537.

Figure 8:
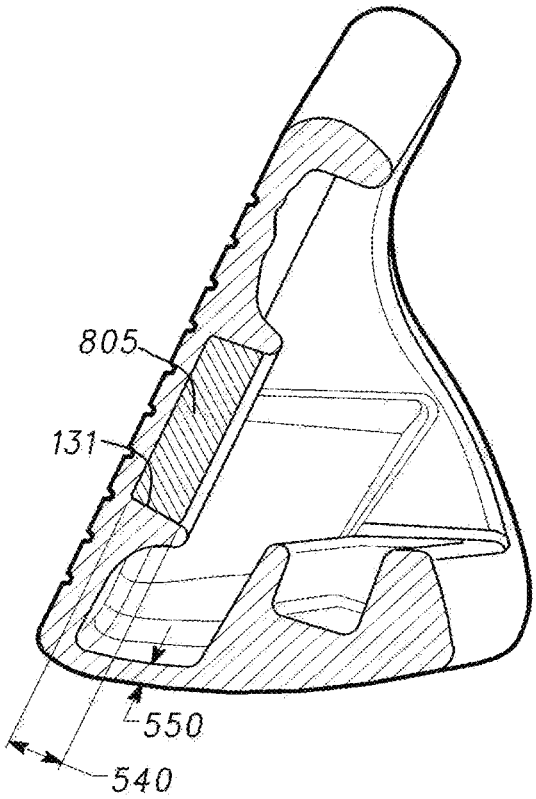
FIG. 8 illustrates a side view of the club head taken along section line 5-5 of FIG. 2, according to a different embodiment of FIG. 1.
Figure 9:
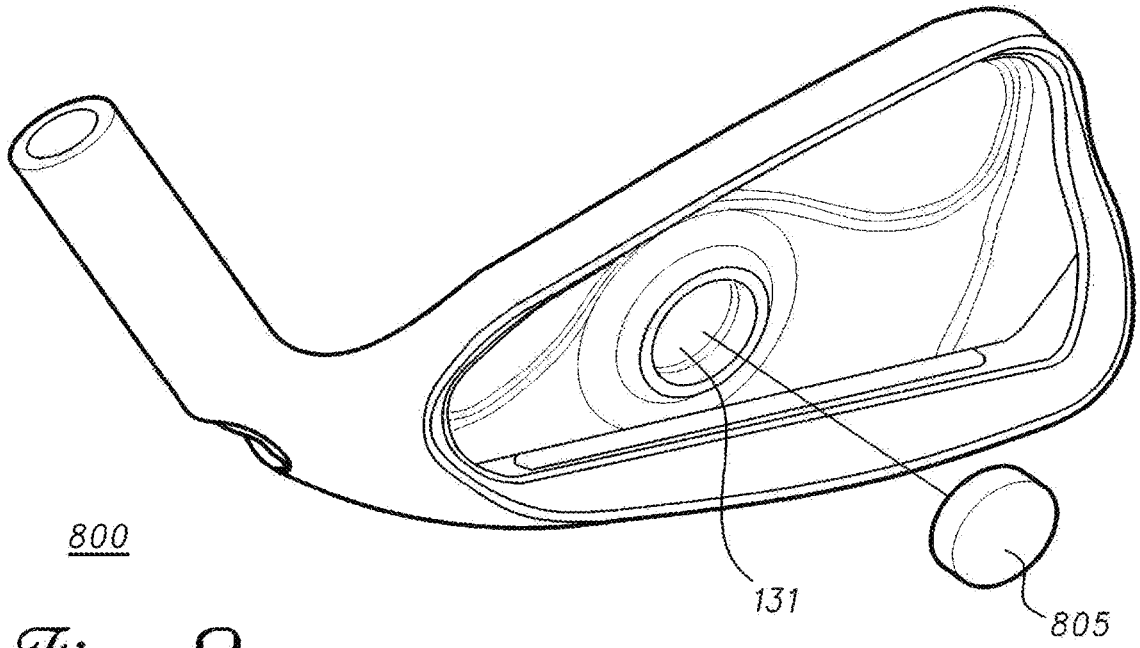
FIG. 9 illustrates a top, rear, heel side view of a club head, according to the embodiment of FIG. 8.

In some embodiments, when reinforcement element 121 comprises looped rib 122, looped rib 122 can comprise cavity 131. In other embodiments, when reinforcement element 121 comprises looped rib 122, looped rib 122 does not comprise cavity 131. In embodiments without cavity 131, the center thickness 537 (FIGS. 5 and 13) can be greater than in embodiments with cavity 131 and can be less than or equal to the face thickness at rib height 542 (FIGS. 5 and 13), which can be measured from face surface 214 (FIG. 2) to the distal end of looped rib 122 (e.g., the combined distance of center thickness 537 (FIG. 5) and rib height 542 (FIG. 5)). Cavity 131 is defined by inner perimeter surface 129 and rear surface 115. In some embodiments, cavity 131 can be a central cavity. In many embodiments, cavity 131 can be devoid of any contents, such as, for example, a weighted insert. In other embodiments, cavity 131 can contain an insert 805 as shown in FIGS. 8 and 9.

As discussed in some detail above, by implementing reinforcement device 112 and reinforcement element(s) 120, face surface 214 (FIG. 2) can be nearer to rear surface 115 (i.e., thinner) proximal to (e.g., at) face center 216 (FIG. 2) than proximal to (e.g., at) face perimeter 217 (FIG. 2). In some embodiments, a portion of face surface 214 (FIG. 2) that is proximal to face center 216 (FIG. 2) can refer to a portion of the surface area of face surface 214 bounding face center 216 (FIG. 2) and representing approximately one percent, two percent, three percent, five percent, ten percent, or twenty percent of a total surface area of face surface 214. In these or other embodiments, the portion of the surface area of face surface 214 (FIG. 2) can correspond to a portion of the surface area of rear face 115 covered by reinforcement element 121. Meanwhile, in some embodiments, a portion of face surface 214 (FIG. 2) that is proximal to face perimeter 217 (FIG. 2) can refer to a region of face surface 214 bounded by face perimeter 217 and an inset boundary located approximately 0.10 centimeters, 0.20 centimeters, 0.25 centimeters, 0.50 centimeters, 1.00 centimeters, or 2.00 centimeters from face perimeter 217 (FIG. 2).

Figure 5:
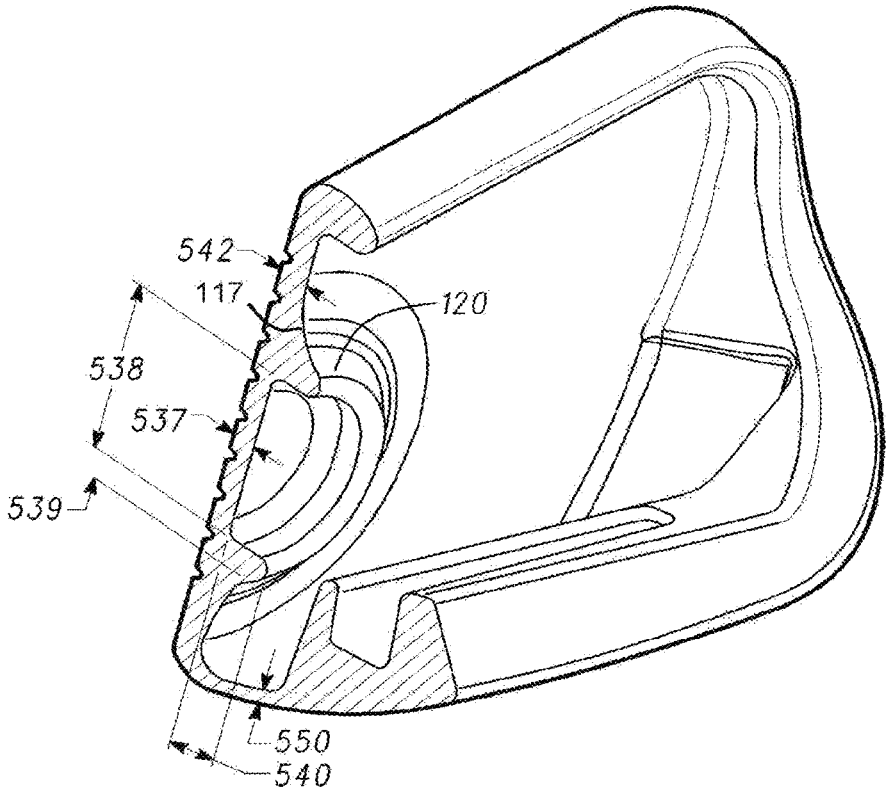
FIG. 5 illustrates a cross-sectional view of the club head taken along section line 5-5 of FIG. 2, according to the embodiment of FIG. 1.
Figure 13:
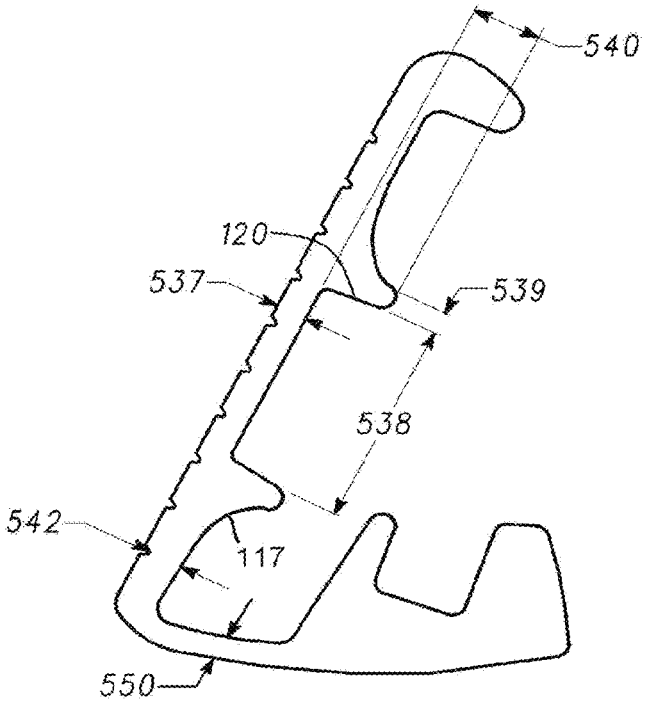
FIG. 13 illustrates a side view of the club head taken along section line 5-5 of FIG. 2, according to the embodiment of FIG. 1.

Turning ahead briefly in the drawings, FIGS. 5 and 13 illustrate a cross-sectional view of club head 100 taken along section line 5-5 of FIG. 2, according to the embodiment of FIG. 1. Club head 100 can comprise center thickness 537. Center thickness 537 can refer to a distance from face center 216 (FIG. 2) to rear center 118 (FIG. 1). In many embodiments, center thickness 537 can be approximately 0.150 cm to approximately 0.300 cm. In some embodiments, center thickness 537 can be less than 0.300 cm, less than 0.255 cm, less than 0.250 cm, less than 0.205 cm, less than 0.200 cm, or less than 0.155 cm. In some embodiments, the center of reinforcement element 120 can be at least partially filled in. For example, the center of reinforcement element 120 can be filled in with a damping material or a vibration attenuating feature (e.g., insert 805 (FIG. 8)) or other material. In many embodiments, center thickness 537 can be thinner than a face thickness at rib height 540. In other embodiments, center thickness 537 can be approximately equal to the face thickness at rib height 540. The face thickness at rib height 540 can be rib height 540 added to center thickness 537. In many embodiments, face thickness 542 outside of reinforcement element 120 can be thicker than center thickness 537, but thinner than the face thickness at rib height 540. In other embodiments, face thickness 542 can be the same as center thickness 537.

In some embodiments, face thickness at rib height 540 can be approximately 0.30 cm to approximately 0.70 cm. In some embodiments, face thickness at rib height 540 can be approximately 0.30 cm to approximately 0.50 cm. In some embodiments, face thickness at rib height 540 can be approximately 0.40 cm to approximately 0.60 cm. In some embodiments, face thickness at rib height 540 can be approximately 0.50 cm to approximately 0.70 cm. In some embodiments, face thickness at rib height 540 can be greater than 0.30 cm, greater than 0.40 cm, greater than 0.50, or greater than 0.60 cm.

In some embodiments, face thickness 542 outside of reinforcement element 120 can vary. FIGS. 15-16 illustrates a top portion 545 of faceplate outside reinforcement element 120 having a top thickness 546, and a bottom portion 547 of faceplate outside reinforcement element 120 having a bottom thickness 548. In some embodiments, top thickness 546 can be the same as bottom thickness 548 (FIGS. 5 and 13). In these embodiments, center thickness 537 can be thinner than top thickness 546 and bottom thickness 548, and top thickness 546 and bottom thickness 548 can be thinner than the face thickness at rib height 540. In some embodiments, top thickness 546 can be different than bottom thickness 548 (FIGS. 15-16). For example, in some embodiments, center thickness 537 can be thinner than top thickness 546, top thickness 546 can be thinner than bottom thickness 548, and bottom thickness 548 can be thinner than the face thickness at rib height 540. For further example, in some embodiments, top thickness 546 can be thinner than center thickness 537, center thickness 537 can be thinner than bottom thickness 548, and bottom thickness 548 can be thinner than the face thickness at rib height 540.

In many embodiments, face thickness 542 outside of reinforcement element 120 can be approximately 0.150 cm to approximately 0.300 cm. In some embodiments, face thickness 542 outside of reinforcement element 120 can be less than 0.300 cm, less than 0.255 cm, less than 0.250 cm, less than 0.205 cm, less than 0.200 cm, or less than 0.155 cm. In many embodiments, top thickness 546 can be approximately 0.150 cm to approximately 0.300 cm. In some embodiments, top thickness 546 can be less than 0.300 cm, less than 0.255 cm, less than 0.250 cm, less than 0.205 cm, less than 0.200 cm, or less than 0.155 cm. In many embodiments, bottom thickness 548 can be approximately 0.150 cm to approximately 0.300 cm. In some embodiments, bottom thickness 548 can be less than 0.300 cm, less than 0.255 cm, less than 0.250 cm, less than 0.205 cm, less than 0.200 cm, or less than 0.155 cm.

In many embodiments, face thickness 542 outside of reinforcement element 120 can be approximately 0.150 cm to approximately 0.300 cm, and center thickness 537 can be approximately 0.150 cm to approximately 0.300 cm, without requiring a backing material for support (e.g. without a filler materials such as an elastomer positioned behind the faceplate). For example, face thickness 542 outside of reinforcement element 120 can be approximately 0.150 cm to approximately 0.300 cm without having an elastomer or other flexible material positioned behind face thickness 542 outside of reinforcement element 120. For further example, center thickness 537 can be approximately 0.150 cm to approximately 0.300 cm without having an elastomer or other flexible material positioned behind face center thickness 537.

Typically, golf club head faceplates are designed to maximize ball speed (e.g. by reducing faceplate thickness) for particular swing speed requirements. Generally, faceplate thickness can be reduced with lower swing speed durability requirements (e.g. for a ladies golf club head compared to a men's golf club head), as the forces on impact with the club head decrease with swing speed. For example, a club head having lower swing speed durability requirements can have a lower center thickness 537, a lower face thickness at rib height 540, a lower top thickness 546, a lower bottom thickness 548, or any combination of the above described reductions in thickness compared to a club head with a higher swing speed durability requirement. In some embodiments, center thickness 537 can be approximately 0.150 cm to approximately 0.250 cm, top thickness 546 can be approximately 0.150 cm to approximately 0.250 cm, and bottom thickness 548 can be approximately 0.150 cm to approximately 0.250 cm, to allow the club head 100 to withstand swing speeds less than 100 miles per hour (mph) (160.9 kilometers per hour, kph), less than 90 mph (144.8 kph), less than 80 mph (128.7 kph), less than 70 mph (112.6 kph), or less than 60 mph (96.6 kph). In some embodiments, center thickness 537 can be approximately 0.200 cm to approximately 0.300 cm, top thickness 546 can be approximately 0.200 cm to approximately 0.300 cm, and bottom thickness 548 can be approximately 0.200 cm to approximately 0.300 cm, to allow the club head 100 to withstand swing speeds less than 130 mph (209.2 kph), less than 120 mph (193.1 kph), less than 110 mph (177.0 kph), less than 100 mph (160.9 kph), or less than 90 mph (144.8 kph).

In many embodiments, scoring lines 223 can have a depth of approximately 0.030 cm to approximately 0.060 cm. In some embodiments, scoring lines 223 can have a depth less than 0.060 cm, less than 0.055 cm, less than 0.050 cm, less than 0.045 cm, less than 0.040 cm, or less than 0.035 cm. For example, in the embodiment illustrated in FIGS. 15-16, the scoring lines 223 have a depth of approximately 0.046 cm. As described herein, measurements for center thickness 537, face thickness 542 outside of reinforcement element 120, top thickness 546, and bottom thickness 548 are determined in regions of the faceplate devoid of scoring lines. Accordingly, a faceplate thickness measured within a scoring line 223 will be lower (by the scoring line depth) than an associated faceplate thickness measured outside of, or adjacent to the scoring line 223 within the same region of the faceplate.

In some embodiments, a width of the rib can change throughout looped rib 122 (FIG. 1). In some embodiments, looped rib 122 (FIG. 1) and/or inner perimeter surface 129 (FIG. 1) can comprise largest rib span 538. Largest rib span 538 can refer to the largest distance from one side of inner perimeter surface 129 (FIG. 1) across to an opposing side of inner perimeter surface 129 (FIG. 1) measured parallel to rear surface 115 (FIG. 1). Accordingly, when looped rib 122 (FIG. 1) comprises an elliptical looped rib, largest rib span 538 can refer to a major axis of inner perimeter surface 129 (FIG. 1). Further, when looped rib 122 (FIG. 1) comprises a circular looped rib, largest rib span 538 can refer to a diameter of inner perimeter surface 129 (FIG. 1). Notably, in many embodiments, largest rib span 538 can be measured at a midpoint of inner perimeter surface 129 (FIG. 1).

Figure 6:
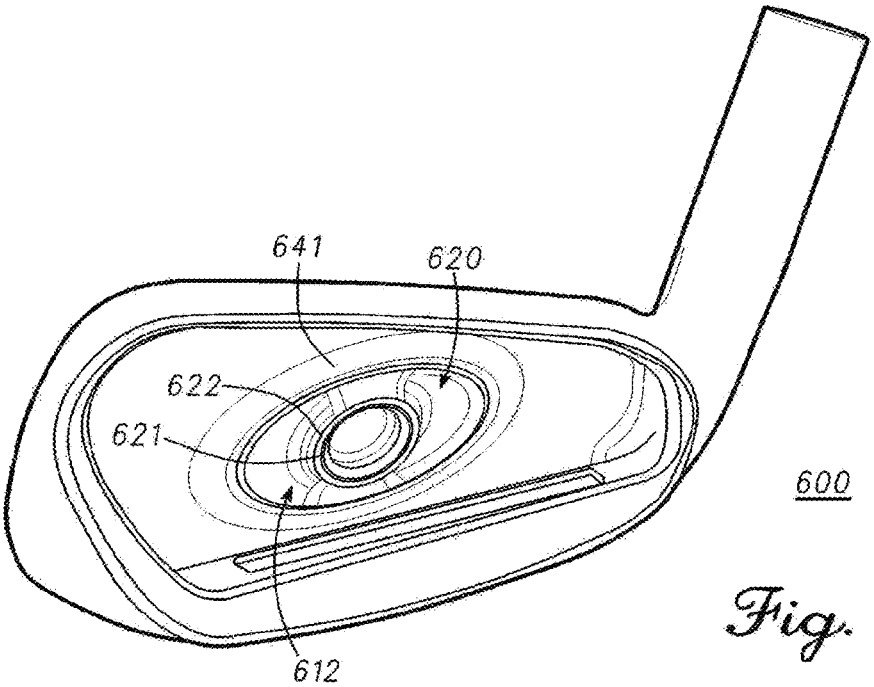
FIG. 6 illustrates a top, rear, toe side view of a club head, according to an embodiment.

In some embodiments, largest rib span 538 can be approximately 0.609 cm to approximately 1.88 cm. In some embodiments, largest rib span 538 can be approximately 1.0 cm. In some embodiments, when largest span 538 is too large (e.g., greater than approximately 1.88 centimeters), looped rib 122 (FIG. 1) can be insufficient to reinforce scoring line(s) 223 (FIG. 2) nearest to face center 216 (FIG. 2). Meanwhile, in these or other embodiments, when largest span 538 is too small (e.g., less than approximately 0.609 centimeters), looped rib 122 can be insufficient to reinforce scoring line(s) 223 (FIG. 2) nearest to face perimeter 217 (FIG. 2). Generally, these upper and lower limits on largest rib span 538 can be a function of a size of face element 111 (FIG. 1). In some embodiments, two or more ribs 621 and 641 can be present, for example as shown in FIG. 6. In this case, the larger rib span or inner or outer diameter of rib 641 (FIG. 6) can be greater than 1.88 centimeters, and the smaller rib span or inner or outer diameter of rib 621 (FIG. 6) can be less than 0.609 centimeters.

Further, looped rib 122 (FIG. 1) can comprise a rib thickness 539. Rib thickness 539 can refer to a distance between inner perimeter surface 129 (FIG. 1) of looped rib 122 (FIG. 1) and outer perimeter surface 128 (FIG. 1) of looped rib 122 (FIG. 1) measured parallel to rear surface 115 (FIG. 1). In some embodiments, the thickness of looped rib 122 (FIG. 1) can vary throughout looped rib 122 (FIG. 1), and rib thickness 539 can be a maximum rib thickness of looped rib 122 (FIG. 1). In many embodiments, rib thickness 539 can be approximately 0.050 cm to approximately 1.50 cm. In some embodiments, rib thickness 539 can be approximately 0.05 cm. In some embodiments, rib thickness 539 can be greater than or equal to approximately 0.25 centimeters. In some embodiments, rib thickness 539 can be approximately 0.50 centimeters. In some embodiments, rib thickness 539 can be approximately 0.75 centimeters. In some embodiments, rib thickness 539 can be approximately 1.00 centimeters. In some embodiments, rib thickness 539 can be approximately 1.25 centimeters. In some embodiments, rib thickness 539 can be approximately 1.50 centimeters. In various embodiments, when looped rib(s) 127 (FIG. 1) comprises multiple looped ribs, two or more looped ribs of looped rib(s) 127 (FIG. 1) can comprise the same rib thicknesses, and/or two or more looped ribs of looped rib(s) 127 (FIG. 1) can comprise different rib thicknesses. Notably, in many embodiments, rib span 539 can be measured at a midpoint of inner perimeter surface 129 (FIG. 1) and/or outer perimeter surface 128 (FIG. 1).

Further still, looped rib 122 (FIG. 1) can comprise rib height 540. Rib height 540 can refer to a distance perpendicular from rear surface 115 (FIG. 1) to a center location of looped rib 122 (FIG. 1) farthest from rear surface 115 (i.e., where outer perimeter surface 128 (FIG. 1) interfaces with inner perimeter surface 129 (FIG. 1). In these or other embodiments, rib height 540 can be greater than or equal to approximately 0.3048 centimeters. In some embodiments, rib height 540 can be approximately 0.1778 cm to approximately 0.3048 cm. In some embodiments, rib height 540 can be approximately 0.17 cm, 0.20 cm, 0.23 cm, 0.26 cm, 0.29 cm, or 0.30 cm. In many embodiments, rib height 540 can be less than or equal to approximately 0.512 cm. In some embodiments, the height of looped rib 122 (FIG. 1) can vary throughout looped rib 122, and rib height 540 can be a maximum rib height of looped rib 122 (FIG. 1). In various embodiments, when looped rib(s) 127 (FIG. 1) comprises multiple looped ribs, two or more looped ribs of looped rib(s) 127 (FIG. 1) can comprise the same rib heights, and/or two or more looped ribs of looped rib(s) 127 (FIG. 1) can comprise different rib heights.

In many embodiments, center thickness 537, largest rib span 538, rib thickness 539, and/or rib height 540 can depend on one or more of each other. For example, center thickness 537 can be a function of rib thickness 539 and rib height 540. That is, for an increase in rib thickness 539 and/or rib height 540, center thickness 537 can be decreased, and vice versa. Meanwhile, rib thickness 539 and rib height 540 can be dependent on each other. For example, increasing rib thickness 539 can permit rib height 540 to be decreased, and vice versa.

Returning now to FIGS. 1 & 2, in many embodiments, perimeter wall element 113 can comprise a first perimeter wall portion 124 and a second perimeter wall portion 125. Perimeter wall element 113 extends (i) at least partially (e.g., entirely) around rear perimeter 119 of rear surface 115, (ii) out from rear surface 115 toward rear end 104 and (iii) away from front end 203 (FIG. 2). Meanwhile, first perimeter wall portion 124 can extend along rear perimeter 119 of rear surface 115 at top end 101, and second perimeter wall portion 125 can extend along rear perimeter 119 of rear surface 115 at bottom end 102. In many embodiments, reinforcement device 112 and reinforcement element(s) 120 are separate and/or located away from perimeter wall element 113 at rear surface 115 so that reinforcement device 112 and reinforcement element(s) 120 float at rear surface 115. By floating reinforcement device 112 and reinforcement element(s) 120, face element 111 can be permitted to bend approximately symmetrically about face center 216 (FIG. 2).

In many embodiments, club head body 110 can comprise (i) a top surface 132 at least partially at first perimeter wall portion 124 and/or top end 101, and/or (ii) a sole surface 133 at least partially at second perimeter wall portion 125 and/or bottom end 102. Accordingly, in some embodiments, first perimeter wall portion 124 can comprise at least part of top surface 132; and/or second perimeter wall portion 125 can comprise at least part of sole surface 133. Further, top surface 132 can interface with face surface 214 (FIG. 2) at top end 101; and/or sole surface 133 can interface with face surface 214 (FIG. 2) at bottom end 102.

In some embodiments, at least part of second perimeter wall portion 125 can be approximately equal thickness with or thinner than face element 111 at face perimeter 217 (FIG. 2) and/or proximal to face perimeter 217. For example, second perimeter wall portion 125 can be equal thickness with or thinner than face element 111 at face perimeter 217 (FIG. 2) and/or proximal to face perimeter 217 at a portion of second perimeter wall portion 125 that is proximal to face perimeter 217 (i.e., where second perimeter wall portion 125 interfaces with face element 111). Implementing this portion of second perimeter wall portion 125 to be equal thickness with or thinner than face element 111 at face perimeter 217 (FIG. 2) and/or proximal to face perimeter 217 can prevent stress risers from forming at second perimeter wall portion 125 when face surface 214 (FIG. 2) impacts a golf ball.

Rear surface 115 comprises a first rear surface portion and a second rear surface portion. The first rear surface portion can refer to the part of rear surface 115 covered by perimeter wall element 113, and the second rear surface portion can refer to the remaining part of rear surface 115. In many embodiments, reinforcement element 121 (e.g., looped rib 122) can cover greater than or equal to approximately 25 percent of a surface area of the second rear surface portion of rear surface 115 and/or less than or equal to approximately 40 percent of a surface area of the second rear surface portion of rear surface 115. In other embodiments, reinforcement element 121 (e.g., looped rib 122) can cover greater than or equal to approximately 30 percent of a surface area of the second rear surface portion of rear surface 115. In some embodiments, reinforcement element 121 (e.g., looped rib 122) can cover approximately 25 percent, 28 percent, 31 percent, 34 percent, 37 percent or 40 percent of a surface area of the second rear surface portion of rear surface 115.

Further, club head body 110 can comprise hosel 134 or any other suitable mechanism (e.g., a bore) for receiving and coupling a shaft to club head 100 and/or club head body 110. The other suitable mechanism can be similar to hosel 134 in one or more respects.

Meanwhile, generally speaking, hosel 134 can be located at or proximate to heel end 106. Although a shaft is not illustrated at the drawings, hosel 134 can be configured to receive a shaft (i.e., via an opening of hosel 134), such as, for example, a golf club shaft. Accordingly, hosel 134 can receive the shaft and permit the shaft to be coupled (e.g., permanently or removably) to club head 100 and/or club head body 110 when hosel 134 receives the shaft.

Further, in some embodiments, second perimeter wall portion 125 can comprise weight cavity 135. In these embodiments, weight cavity 135 can be configured to receive a removable or permanent weighted insert. The weighted insert can be positioned in weight cavity 135 such that the weighted insert is positioned closer to the bottom end 102 of club head 100 than the center of gravity of club head 100. In other words, the weighted insert can be positioned in weight cavity 135 such that the center of gravity of club head 100 is positioned closer to the top end 101 of club head 100 than the weighted insert. The weighted insert can be configured to alter a center of gravity of club head 100.

Figure 7:
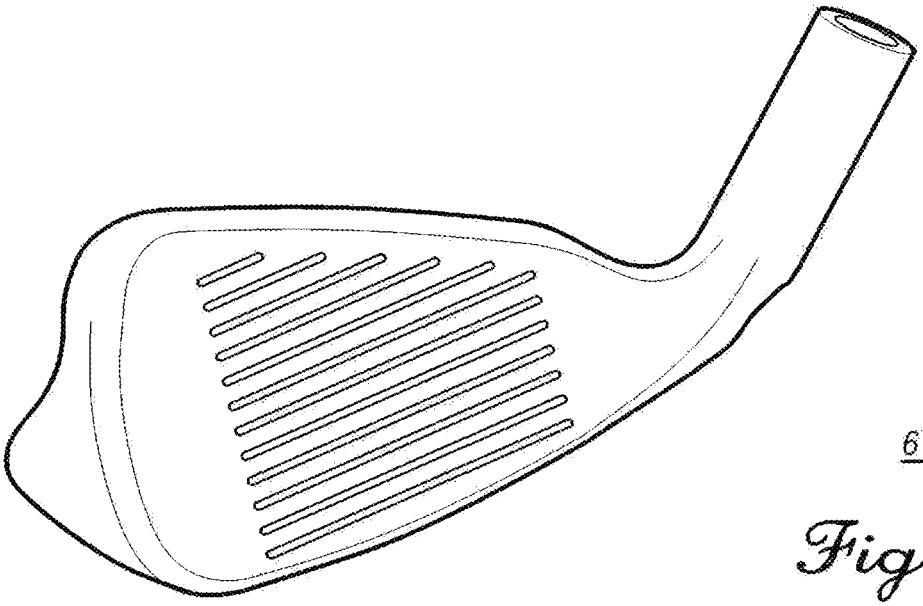
FIG. 7 illustrates a top, front, toe side view of the club head, according to the embodiment of FIG. 6.

Turning ahead in the drawings, FIG. 6 illustrates a top, rear, toe side view of a club head 600, according to an embodiment. Meanwhile, FIG. 7 illustrates a top, front, toe side view of club head 600, according to the embodiment of FIG. 6.

Club head 600 can be similar or identical to club head 100 (FIG. 1). Accordingly, club head 600 can comprise reinforcement device 612, and reinforcement device 612 can comprise reinforcement element(s) 620. Reinforcement device 612 can be similar or identical to reinforcement device 112 (FIG. 1); and reinforcement element(s) 620 can be similar or identical to reinforcement element(s) 120 (FIG. 1).

Reinforcement element(s) 620 can comprise first reinforcement element 621 and second reinforcement element 641. First reinforcement element 621 and/or second reinforcement element 641 each can be similar to first reinforcement element 121 (FIG. 1). Accordingly, first reinforcement element 621 can comprise first looped rib 622, and second reinforcement element 641 can comprise second looped rib 642. First looped rib 622 and/or second looped rib 642 each can be similar to looped rib 122 (FIG. 1).

In these embodiments, first reinforcement element 621 and/or first looped rib 622 can comprise a circular looped rib, and second reinforcement element 622 and/or second looped rib 642 can comprise an elliptical looped rib. Second reinforcement element 622 and/or second looped rib 642 can enclose first reinforcement element 621 and/or first looped rib 622. In many embodiments, a major axis of the elliptical looped rib can be approximately parallel with an x-axis of club head 600. The x-axis can be similar or identical to x-axis 107 (FIG. 1). In the same or different embodiments, the minor axis of the elliptical looped rib can be non-parallel with a y-axis of club head 600. The y-axis can be similar or identical to y-axis 108 (FIG. 1).

Club head 600 having reinforcement device 612 may also have uniform transition thickness 550 (not shown) extending from front end 203 to bottom end 102. Uniform transition thickness 550 absorbs stress directed to the region of club head 600 having reinforcement device 612 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

In another embodiment, FIG. 8 illustrates a side view of club head 800 taken along section line 5-5 of FIG. 2, according to a different embodiment of FIG. 1. Club head 800 shown in FIG. 8 illustrates an insert 805 within cavity 131. FIG. 9 illustrates a top, rear, heel side view of club head 800, according to the embodiment of FIG. 8. In some embodiments, insert 805 can be a vibration attenuating feature. Insert 805 can be a non-metallic material, an elastomeric material such as polyurethane, or another material such as foam. Insert 805 can be used to adjust the sound and feel of club head 800. By absorbing or damping vibration, insert 805 improves the feel of club head 800. In addition, insert 805 absorbs the sound of a golf ball striking the face, making golf club 800 head feel less hollow and more solid. In further embodiments, a badge (not shown) can at least partially cover cavity 131. The badge can be separate from insert 805 or can be integral with insert 805. In other embodiments, the badge can be integral with the reinforcement element, such as reinforcement element 120 (FIG. 1).

In some cases, the weight of insert 805 can be less than about 3 g so as to not significantly affect the swing weight or the center of gravity of club head 800. In other embodiments, insert 805 weight can be more than about 3 g, such as about 5 g to about 10 g, and can contribute substantially to the swing weight and/or the center of gravity of club head 800. In some embodiments, insert 805 can be adhered to cavity 131 using an epoxy adhesive, a viscoelastic foam tape, the vibration attenuating feature, or a high strength tape such as 3M™ VHB™ tape. In other embodiments, insert 805 can be poured and bonded directly into cavity 131. The badge can be bonded with similar adhesives. In some embodiments, insert 805 or the badge can be flush with looped rib 122 (FIG. 1) at the top of rib height 540, or they can be below rib height 540 when fully assembled.

In some embodiments, at least one vibration attenuating feature (e.g., insert 805 (FIG. 8) can be disposed on rear surface 115 (FIG. 1) of the golf club head, such as golf club head 800. The vibration attenuating feature can produce a more desirable sound from the golf club head 800 upon impact. The thin face element 111 (FIG. 1) of golf club head 800 can cause undesirable sounds when striking a golf ball. The vibration attenuating feature can reduce the vibrations leading to a more desirable sound on impact by thin face element 111 (FIG. 1). By providing a more desirable noise, the vibration attenuating component can increase a user's confidence during use. The vibration attenuating feature can also reduce the vibrational shock felt by the user of the golf club upon striking the golf ball. Furthermore, the vibration attenuating feature may reduce vibrational fatigue to decrease wear on golf club 800 and various features such as, but not limited to, cavity 131 or weight cavity 135 (FIG. 1). The reduced vibrational fatigue can further lower the risk of loosening or displacement of parts such as, but not limited to, insert 805 of cavity 131 or an insert in weight cavity 135 (FIG. 1). The reduced vibrational fatigue may extend the performance life of golf club head 800.

Figure 12:
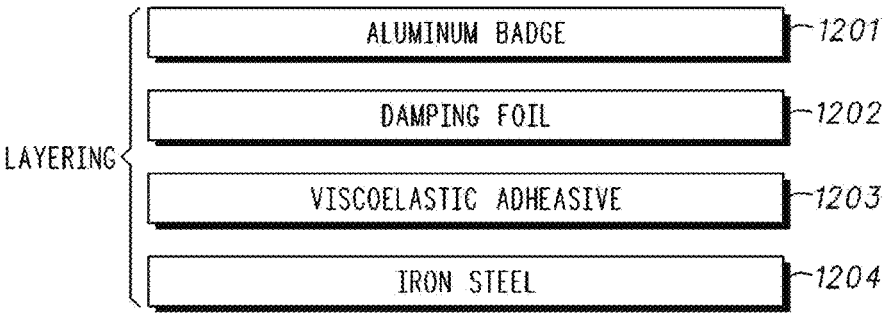
FIG. 12 illustrates a diagram for an embodiment of the layers of a vibration attenuating feature.

As seen in FIG. 12, in further embodiments, the vibration attenuating feature may comprise at least one layer of a viscoelastic damping material. The damping material may comprise a pressure sensitive viscoelastic acrylic polymer and aluminum foil forming a damping foil 1202 such as 3M™ Damping Foil Tape 2552. The damping foil 1202 may comprise an adhesive layer. In one embodiment the vibration attenuating feature may comprise at least one viscoelastic adhesive layer 1203 which may comprise a composition of varying layers of at least one layer of epoxy adhesive, a viscoelastic foam tape, and/or a high strength tape such as 3M™ VHB™ tape. In some embodiments, the vibration attenuating feature may comprise various layer combinations of at least one of viscoelastic adhesive 1203, damping foil 1202, and/or a badge 1201.

Returning to FIG. 8, in some embodiments, the vibration attenuating feature can be disposed on the rear surface 115 (FIG. 1) of the golf club head, such as golf club head 800, which comprises a rear surface material such as iron steel 1204. In another embodiment, the vibration attenuating feature can be disposed in cavity 131, or on or under insert 805 of the golf club head 800. The vibration attenuating feature can be located in various locations of the rear surface 115 (FIG. 1) of the golf club head 800. Generally, the vibration attenuating feature is at least partially located under the profile of the badge on the rear surface 115 (FIG. 1). In some embodiments, the vibration attenuating feature is disposed under the entirety of the badge profile. In other embodiments, the vibration attenuating feature is at least partially disposed under only particular regions of the badge profile such as the aluminum or elastomer regions. The vibration attenuating feature can be disposed under only at least part of the perimeter region of the badge profile. In some embodiments the vibration attenuating feature can be disposed at least partially in cavity 131 of the golf club head 800. The vibration attenuating feature may be disposed at least partially on or under insert 805 within cavity 131. In many embodiments the disposition of the vibration attenuating feature on golf club head 800 will comprise varying combinations the foil being disposed at least partially under the badge, at least partially over insert 805, at least partially in weight cavity 135 (FIG. 1), and/or at least partially in cavity 131. In some embodiments, the vibration attenuating feature will be disposed such that it covers at least 10 percent of the surface area of rear surface 115 (FIG. 1). In other embodiments, the vibration attenuating feature may cover at least 15, 20, 25, 30, 35, 40, 45, 50, 55, 60, 65, 70, 75, 80, 85, 90, 95, or 100 percent of the surface area of rear surface 115.

Club head 800 having insert 805 may also have uniform transition thickness 550 (FIG. 8) extending from front end 203 to bottom end 102. Uniform transition thickness 550 absorbs stress directed to the region of club head 800 having insert 805 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

Figure 18A:
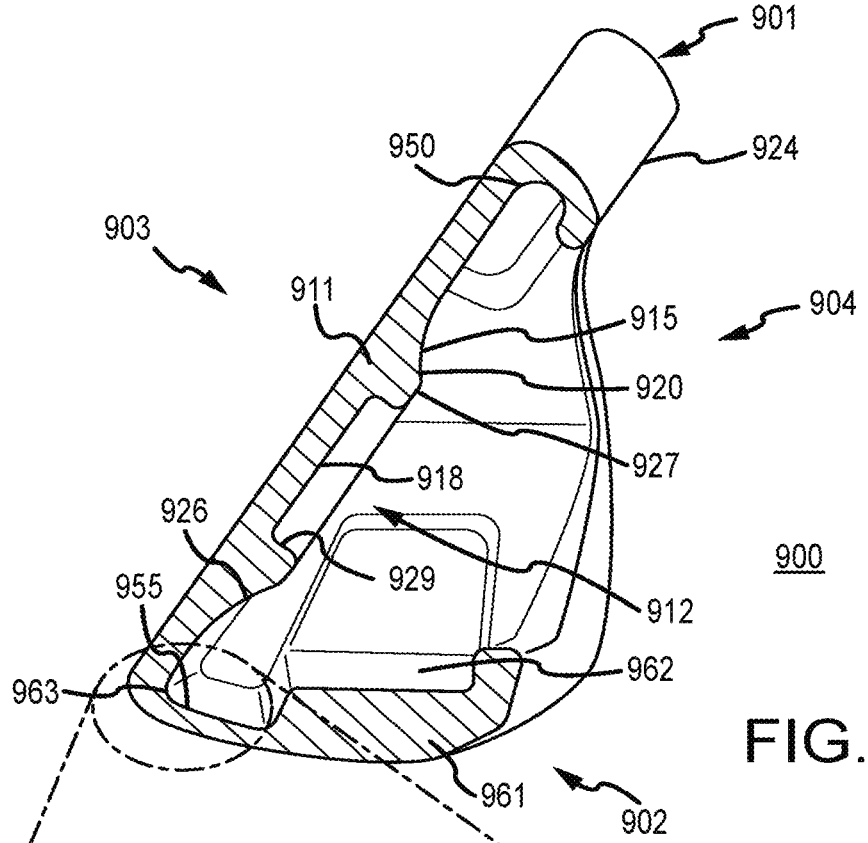
FIG. 18A illustrates a cross-sectional view of a club head according to another embodiment.

In another embodiment, as illustrated in FIG. 18A, is a cross-sectional side view of club head 900. Club head 900 can be similar to club head 100, having a club head body 910 which comprises a top end 901, a bottom end 902, a toe end 905, a heel end 906, a front end 903, a rear end 904, and a face element 911. The face element 911 comprises a face surface 914 (i.e, a strikeface, or striking plate) located on the front end 903, and a rear surface 915 located on the rear end 904, wherein the rear surface 915 comprises a rear center 918.

The top end 901 of the club head body 910 comprises a top rail 924 extending in an arcuate fashion away from the front end 903, toward the rear end 904 and the bottom end 902. The top rail 924 extends along the top end 901, from the toe end 905 to the heel end 906. A recess within the curvature located between the rear surface 915 of the face element 911, and the top rail 924 defines an undercut 950. In many embodiments, the undercut 950 extends along the top rail 924 from the toe end 905 to the heel end 906. In other embodiments, the undercut 950 can extend along the top rail 924, and into a portion of the toe end 905, a portion of the heel end 906, or a combination of a portion of the toe end 905, and a portion of the heel end 906. The undercut 950 can also be applied to club heads 300, 600 and 800.

The face element 911 further comprises a reinforcement device 912 similar to the reinforcement device 112, and 612. The reinforcement device 912 is located on the rear surface 915 generally at the rear center 918. The reinforcement device 912 extends from the rear surface 915 away from the front end 903. The reinforcement device 912 comprises one or more reinforcement elements 920. In many embodiments, each reinforcement element of the reinforcement elements 920 comprises an outer perimeter surface 926, an inner perimeter surface 929, and a geometric center. The reinforcement elements 920 can further comprise looped ribs 927. In these or other embodiments, the geometric center(s) of one or more of reinforcement elements 920 can be at the rear center 918 of the rear surface 915.

In some embodiments, the looped ribs 927 can comprise multiple looped ribs, wherein each looped rib 927 can be concentric with each other. In other embodiments, when looped ribs 927 comprise multiple looped ribs, two or more of looped ribs 927 can be nonconcentric. Further, in these or other embodiments, two or more of looped rib 927 can overlap. Meanwhile, in some embodiments, looped ribs 927 can comprise an elliptical looped rib, and in other embodiments, looped ribs 927 can comprise a circular looped rib.

In implementation, reinforcement element(s) 920 and looped ribs 927 can be implemented in any suitable shape(s) (e.g., polygonal, elliptical, circular, etc.) and/or in any suitable arrangement(s) configured to perform the intended functionality of reinforcement device 912 and/or reinforcement element(s) 920 as described above. Further, when reinforcement element(s) 920 comprise multiple reinforcement elements, two or more reinforcement elements of reinforcement element(s) 920 can be similar to another, and/or two or more reinforcement elements of reinforcement element(s) 1520 can be different from another.

In some embodiments, one or more outer perimeter surfaces 926 of reinforcement elements 920 can be filleted with rear surface 915. In these or other embodiments, one or more inner perimeter surfaces 929 of looped ribs 927 can be filleted with rear surface 915. Filleting the outer perimeter surface 926 of reinforcement elements 920 with rear surface 915 can permit a smooth transition of reinforcement elements 920 into rear surface 915. Further, filleting the outer perimeter surface 926 of reinforcement elements 920 with rear surface 915 can direct stresses from impact into reinforcement elements 920 and away from the face surface 914. Meanwhile, outer perimeter surface 926 of reinforcement elements 920 or inner perimeter surface 929 of looped ribs 927 can be filleted with rear surface 915 with a fillet 923 having a radius of greater than or equal to approximately 0.012 centimeters. For example, in some embodiments, the fillet 923 of the outer perimeter surface 926 with the rear surface 915 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 923 of the inner perimeter surface 929 with the rear surface 915 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface 926 of reinforcement elements 920 can be filleted directly with rear surface 915. In these embodiments, the face thickness decreases gradually along the fillet 923 from face thickness at an apex of the reinforcement element 920 to face thickness at rear surface 915.

In some embodiments, club head 900 can further include a lip (not pictured) on rear surface 915 of club head 900 similar to the lip 552 as described above and FIGS. 9-17. The lip of club head 900 can extend from the heel end 906 to the toe end 905 around the reinforcement element 920 of club head 900. In these or other embodiments, a fillet 923 on the outer perimeter surface 926 of the reinforcement elements 920 can transition to the lip such that the face thickness decreases gradually along the fillet 923 from the apex of the reinforcement element 920 to a minimum thickness between the lip and the reinforcement element 920, then increases gradually from the minimum thickness to the an apex of the lip. In these embodiments, the minimum thickness between the reinforcement element 920 and the lip can be greater than the thickness at the face center 916, the minimum thickness between the reinforcement element 920 and the lip can be approximately equal to the thickness at the face center 916, or the minimum thickness between the reinforcement element 920 and the lip can be less than the thickness at the face center 916.

Figure 18B:
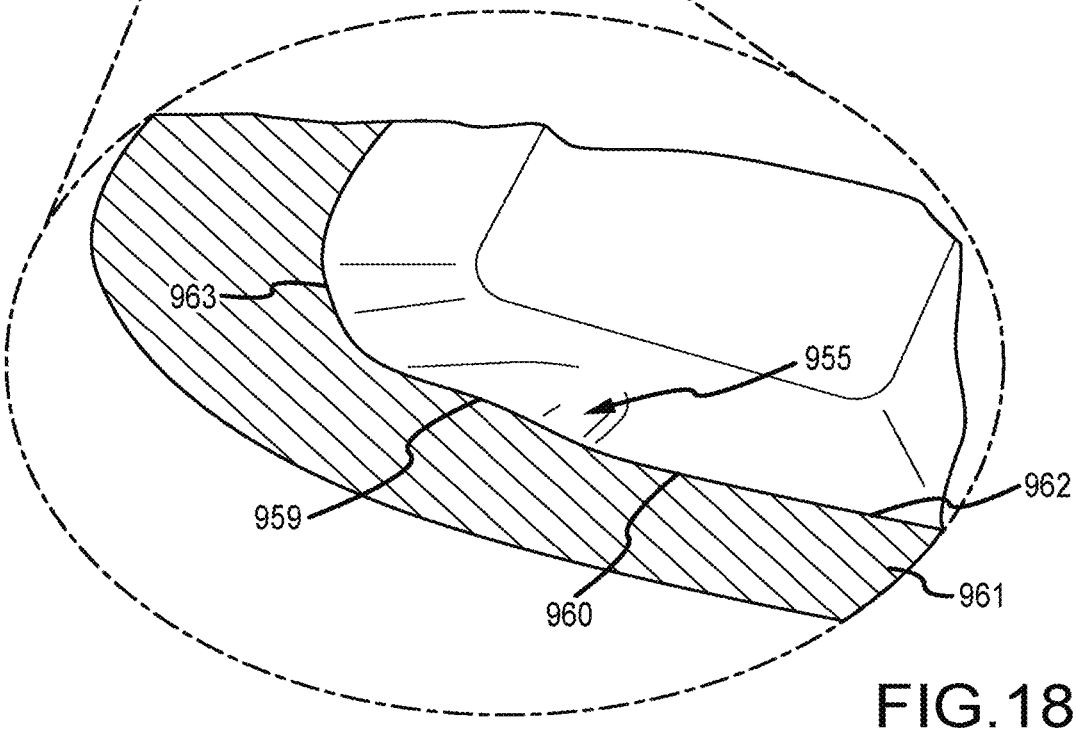
FIG. 18B illustrates a close-up view of the cross-sectional view of the club head according to the embodiment of FIG. 18A.

The bottom end 902 of the club head body 910 may further comprise a sole 961, wherein the sole 961 comprises an inner sole surface 962. Further, the sole 961 can be also be a feature in club heads 300, 600 and 800. As illustrated in FIGS. 18A and 18B, there is an internal radius transition 963 from the rear surface 915 of the of the face element 911 to the inner sole surface 962. The radius transition 963 can comprise a smooth transition or a cascading sole 955 proximate the rear surface 915 of the face element 911. As illustrated in FIG. 18B, the cascading sole 955 can comprise a first tier 959, and a second tier 960, wherein the first tier 959 is proximal the front end 903 and the second tier 960 is proximal the rear end 904 with the first tier 959 transitioning to the second tier 960. Further, the first tier 959 comprises a greater thickness than a thickness of the second tier 960. Further details of the cascading sole 955 are disclosed in U.S. application Ser. No. 14/920,280 for Golf Club Heads with Energy Storage Characteristics.

The undercut 950 increases the structural integrity of the face element 911 of club head 900. More specifically, the location of the undercut allows for a larger distribution area of the stresses the face element 911 experiences at the top end 901 during impact with a ball, wherein the stress moves along the top rail 924. The distribution of stresses in the top rail of the top end 901 can prevent permanent deformation of the face element 911. Maintaining the structural integrity of the face element 911 allow for the club head body 910 to produce consistent optimal performance characteristics and feel, wherein the performance (i.e., ball speed, ball trajectory) do not degrade over time and after multiple uses.

Further, the undercut 950 located directly rearward of the front end 903 on the top end 901 allows the face element 911 to have a greater deflection during impact. The deflection of the face element 911 affects the coefficient of restitution (COR) of the club head 900. The COR measures the elasticity of an object in collision and is the ratio of the object's final relative speed to the objects' initial relative speed. A higher COR results in increased ball speed and distance, and a lower COR results in decreased ball speed and distance. Therefore, the undercut 950 of the club head 900 affects the distance and speed of the ball after impact. As the undercut 950 increases the deflection of the face element 911, the distance and speed of the ball also increases.

Further still, the undercut 950 allows for removal of mass from the top end 901 of the club head. The removed mass can then be redistributed to other locations on the club head (e.g., the bottom end 902, the toe end 905, the heel end 906, or any combination thereof). The redistribution of mass provides the club head with higher performance characteristics such as increased moment of inertia (MOI) and ideal center of gravity (CG) placement. Increased MOI and ideal CG placement can lead to increased ball speeds as well as prevent rotation of the club head 900 from toe end 905 to heel end 906 during a swing. Preventing the rotation of the club head 900 from toe end 905 to heel end 906 allows for better contact with the ball and a more ideal trajectory of the ball (i.e. straight).

As described previously, reinforcement device 912 and reinforcement element(s) 920 are configured to reinforce face element 911 while still permitting face element 911 to bend, such as, for example, when face surface 914 impacts a golf ball. As a result, face element 911 can be thinned to permit mass from face element 911 to be redistributed to other parts of club head 900 and to make face element 911 more flexible without buckling and failing under the resulting bending. Advantageously, because face element 911 can be thinner when implemented with reinforcement device 912 and reinforcement element(s) 920, the center of gravity, the moment of inertia, and the coefficient of restitution of club head 900 can be altered to improve the performance characteristics of club head 900. For example, implementing reinforcement device 912 and reinforcement element(s) 920 can increase a flight distance of a golf ball hit with face surface 914 by increasing launch angle, increasing the ball speed, and/or decreasing spin of the golf ball. In these examples, reinforcement device 912 and reinforcement element(s) 920 can have the effect of countering some of the gearing on the golf ball provided by face surface 914.

The reinforcement device 912 and reinforcement element(s) 920 are further able to provide stress reducing benefits when implemented as a closed structure (i.e., looped ribs 927) because such closed structures are able to resist deformation as a result of circumferential (i.e., hoop) stresses acting on reinforcement device 912 and reinforcement element(s) 920. For example, circumferential (i.e., hoop) stresses acting on reinforcement device 912 and reinforcement element(s) 920 can prevent opposing sides of reinforcement device 912 and reinforcement element(s) 920 from rotating away from each other, thereby reducing bending.

The cascading sole 955 allows some of the stress experienced by the face element 911 near the sole 961, to distribute to the first tier 959 and the second tier 960. The distribution of stress to the first tier 959 and the second tier 960 of the cascading sole 955 prevent the stress from collecting primarily at the thinnest section of the face element 911 near the sole 961. The distribution of stresses in the first tier 959 and the second tier 960 in the sole 961 can prevent permanent deformation, and maintain the structural integrity of the face element 911. Therefore, the face element 911 can produce more consistent performance and feel after a plurality of impacts with the ball.

Figure 19:
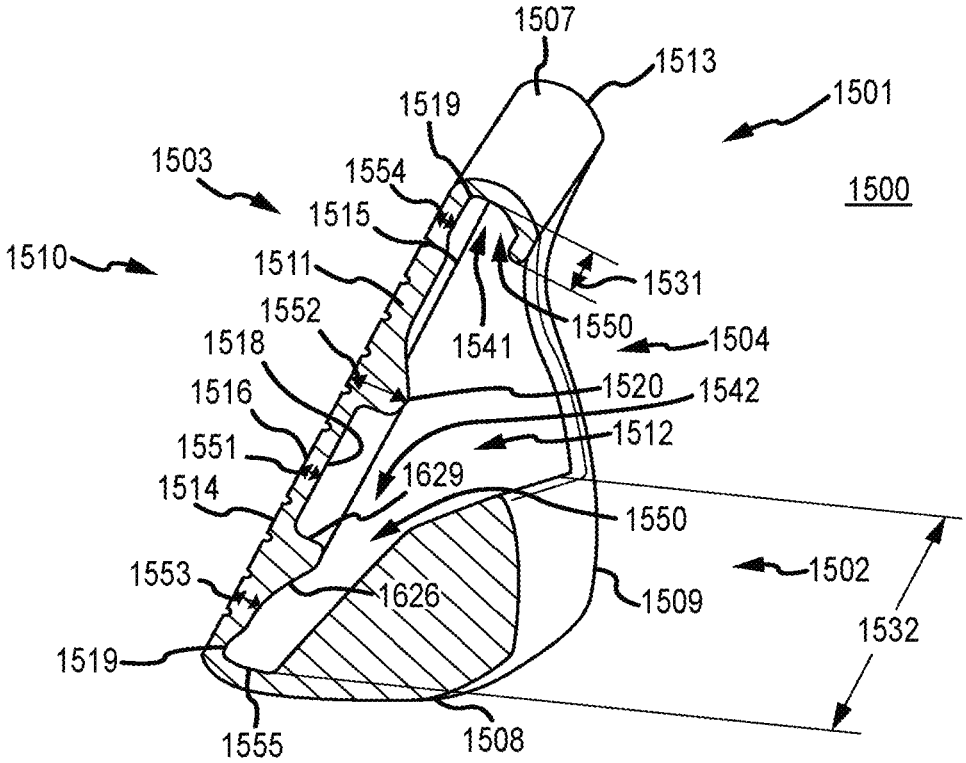
FIG. 19 illustrates a cross-sectional view of a club head according to another embodiment.
Figure 20:
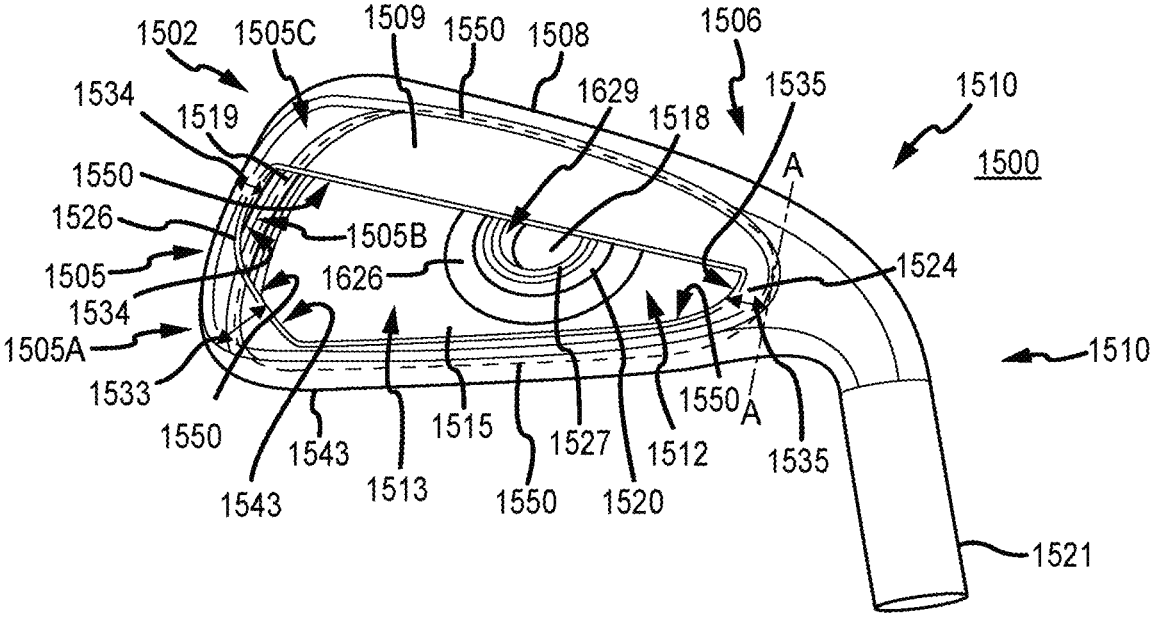
FIG. 20 is a rear view of the club head, according to the embodiment of FIG. 19.
Figure 21:
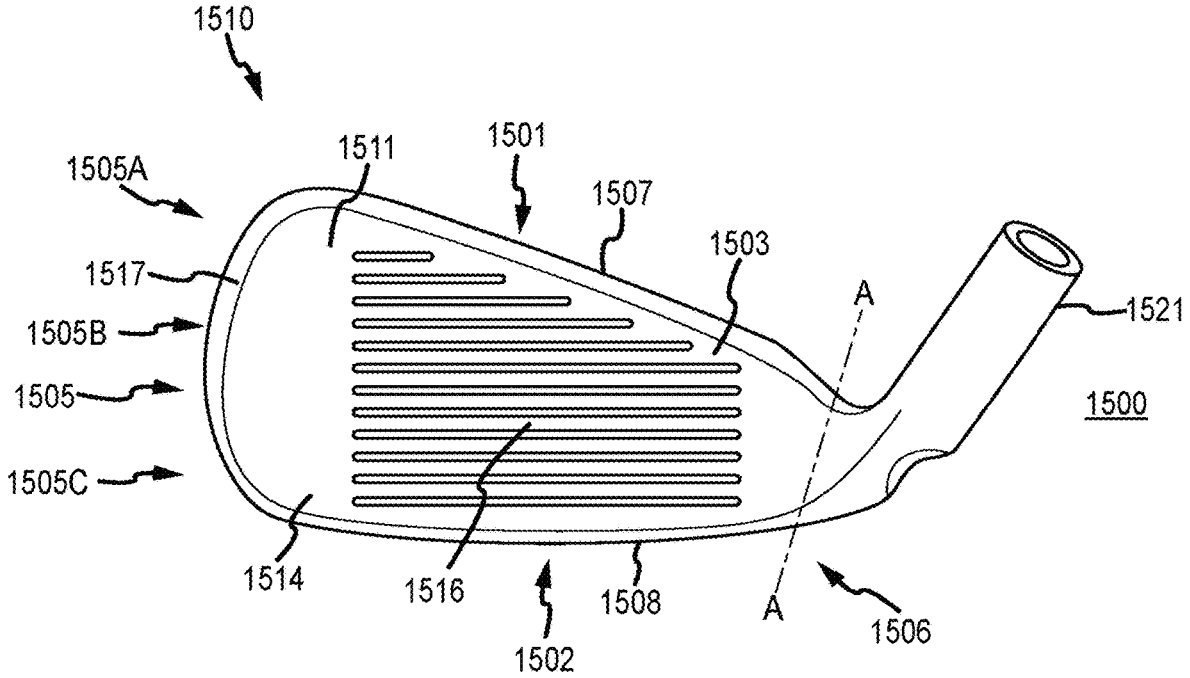
FIG. 21 is a front view of the club head, according to the embodiment of FIG. 19.

FIGS. 19-21 illustrate another embodiment of a club head 1500. FIG. 19 is a cross-sectional side view of club head 1500, while FIG. 20 is a rear perspective view of club head 1500, and FIG. 21 is a front view of club head 1500. Club head 1500 comprises a club head body 1510. As illustrated in FIG. 19, club head body 1510 can be similar to club head body 110, and 910, wherein club head body 1510 comprises a top end 1501, a bottom end 1502 opposite the top end 1501, a front end 1503, a rear end 1504 opposite the front end 1503, a toe end 1505, a heel end 1506 end opposite the toe end 1505, and a face element 1511. The toe end is further divided into a first toc end portion 1505A, a second toe end portion 1505B, and a third toe end portion 1505C. The first toe end portion 1505A is located adjacent and integral formed with the top end 1501. The third toe portion 1505C is located adjacent and integrally formed with the bottom end 1502. The second toe end portion 1505B is located between the first toe end portion 1505A, and the third toe end portion 1505C.

The club head 1500 further comprises a hosel 1521. The hosel 1521 is integrally formed with the club head body 1510. As illustrated in FIGS. 20 and 21, dashed line A-A represents the junction of the hosel 1521 and the club head body 1510, wherein the club head body 1510 ends and the hosel 1521 begins when the face element 1511 transitions from a flat surface to a curve.

In many embodiments, the face element 1511 of the club head body 1510 comprises a face surface 1514 positioned on the front end 1503, and a rear surface 1515 positioned on the rear end 1504 opposite the face surface 1514. The face surface 1514 can refer to a striking face or a striking plate of club head 1500, and be configured to impact a golf ball (not shown). The face surface 1514 comprises a face center 1516 located at a general center of the face surface 1514, and a face perimeter 1517 along the periphery of the face surface 1514, wherein the face perimeter 1517 abuts against the dashed line A-A at the heel end 1506 of the club head body 1510. The rear surface 1515 of the face element 1511 comprises a rear center 1518 opposite the face center 1516, and a rear perimeter 1519 opposite the face perimeter 1517, wherein the rear perimeter 1519 abuts against the dashed line A-A at the heel end 1506 of the club head body 1510.

FIG. 19 illustrates the rear end 1504 of the club head body 1510, wherein several cavities can be formed between the rear surface 1515 and along the perimeter of the face element 1511 and several back wall structures described in more details below. In many embodiments, these cavities are all integral with one another and connect together to form a 360 degree undercut between the rear surface 1515 an the several back wall structures. The several back wall structures form from the top end 1501, the bottom end 1502, the toe end 1505, and the heel end 1506 of the club head body 1510. In other embodiments, some of the cavities can be integral with one another and connect together, while other cavities are interrupted by structures (e.g., ribs, ledges, walls, or any other separating-type structures). In many embodiments, the club head body 1510 comprising the cavities formed can further comprise a reinforcement device 1512 (as described in more details below). In other embodiments, the golf club head comprising the cavities formed can be devoid of the reinforcement device 1512.

Club Head with Undercut

As illustrated in FIGS. 19 and 20, the top end 1501 of the club head body 1510 comprises a top rail 1507. The top rail 1507 extends in an arcuate fashion toward the rear end 1504 and the bottom end 1502 to form a top rail wall 1513. The curvature of the top rail wall 1513 covers a portion of the rear surface 1515, wherein a first cavity 1541 is formed between the rear surface 1515 and the top rail wall 1513. The top rail wall 1513 can extend from the heel end 1506 to the toe end 1505; likewise, the first cavity 1541 at the top end 1501 can extend from the heel end 1506 to the toe end 1505. The top rail wall 1513 can cover approximately 10% to 22% of the rear surface 1515. For example, the top rail wall 1513 can cover approximately 10%, 12%, 14%, 16%, 18%, 20%, or 22% of the rear surface 1515. In some embodiments, the top rail wall 1513 can cover approximately 18% of the rear surface 1515. This percent coverage of the rear surface 1515 by the top rail wall 1513 is related to a first depth 1531 of the first cavity 1541.

As illustrated in FIG. 19, the first depth 1531 of the first cavity 1541 is measured from the opening of the first cavity 1541 to the rear perimeter 1519 at the top of the top rail 1507, parallel to the face surface 1514. The first depth 1531 can be a consistent depth or varies along the first cavity 1541. The first depth 1531 of the first cavity 1541 at the top rail 1507 can range from approximately 0.115 inch to 0.135 inch. For example, the first depth 1531 of the first cavity 1541 can be approximately 0.115 inch, 0.117 inch, 0.119 inch, 0.121 inch, 0.123 inch, 0.0125 inch, 0.127 inch, 0.129 inch, 0.131 inch, 0.133 inch, or 0.135 inch. In some embodiments, the first depth 1531 is approximately 0.125 inch.

The bottom end 1502 of the club head body 1510 comprises a sole 1508 that integrally forms into a rear portion 1509 extending upward toward the top end 1501 over a portion of the rear surface 1515. The rear upward extension of the rear portion 1509 over the rear surface 1515 forms a second cavity 1542 between the rear surface 1515 and the rear portion 1509. The rear portion 1509 can extend from the heel end 1506 to the toe end 1505; likewise, the second cavity 1542 between the rear surface 1515 and the rear portion can extend from the heel end 1506 to the toe end 1505. The rear portion 1509 can cover approximately 30% to 55% of the rear surface 1515. For example, the rear portion 1509 can cover approximately 30%, 35%, 40%, 45%, 50%, or 55% of the rear surface 1515. In some embodiments, the rear portion 1509 extending upward toward the top end 1501 can cover approximately 45% of the rear surface 1515. This percent coverage of the rear portion 1509 over the rear surface 1515 is related to a second depth 1532 of the second cavity 1542.

As illustrated in FIG. 19, the second depth 1532 of the second cavity 1542 is measured from the opening of the second cavity 1542 to the rear perimeter 1519 at the bottom of the sole 1508, parallel to the face surface 1514. The second depth 1532 can be a consistent depth or varies along the second cavity 1542. The second depth 1532 of the second cavity 1542 can range from approximately 0.460 inch to 0.580 inch. For example, the second depth 1532 can be approximately 0.460 inch, 0.480 inch, 0.500 inch, 0.520 inch, 0.540 inch, 0.560 inch or 0.580 inch. In some embodiments, the second depth 1532 of the second cavity 1542 can be approximately 0.500 inch.

At the toe end 1505 of the club head body 1510, as illustrated in FIG. 20, a toe ledge 1526 can extend in a curved manner toward the top rail 1507, the sole 1508, and the heel end 1506. The toe ledge 1526 extends from the top end 1501 toward the bottom end 1502, wherein the toe ledge is integrally formed with the rear portion 1509 of the sole 1508, and the top rail wall 1513 of the top rail 1507. More specifically, the toe ledge 1526 at the first toe end portion 1505A is adjacent and integrally formed with the top rail 1507, and the toe ledge 1526 at the third toe end portion 1505C is adjacent and integrally formed with the rear portion 1509. The toe ledge 1526 extending toward the top rail 1507 and the heel end 1506 can form a third cavity 1543 between the rear surface 1515 and the toe ledge 1526 at the first toe end portion 1505A. The third cavity 1543 is adjacent to and can be integral to the first cavity 1541 at the top rail 1507. Below the third cavity 1543, a fourth cavity 1544 can further be formed between the rear surface 1515 and the toe ledge 1526 at the second toe end portion 1505B. The fourth cavity 1544 is adjacent to and can be integral with the second cavity 1542 at the sole 1508.

The toe ledge 1526 can cover a portion of the rear surface 1515. More specifically, the toc ledge 1526 at the first toe end portion 1505A can cover approximately 7% to 15% of the rear surface 1515. For example the toe ledge 1526 at the first toe end portion 1505A can cover approximately 7%, 9%, 11%, 13%, or 15% of the rear surface 1515. In some embodiments, the toe ledge 1526 at the first toe end portion 1505A covers approximately 9% of the rear surface 1515. The percent coverage of the toe ledge 1526 is greatest and most pronounced at the first toc end portion 1505A; likewise a third depth 1533 (explained in greater detail below) of third cavity 1543 associated with the percent coverage of the toe ledge 1526 at the first toe end portion 1505A is very also pronounced. The percent coverage by the toe ledge at the first end is more pronounce, this can help to increase the top/toe weighting to improve the moment of inertia. The percent coverage by the toe ledge 1526 at the first toe end portion 1505A decreases toward the second toe end portion 1505B, wherein the percent coverage of the toe ledge 1526 at the second toe end portion 1505B is the smallest of the two.

As illustrated in FIG. 20, the third cavity 1543 of the toe end 1505 and adjacent to the top rail 1507 comprises the third depth 1533. The third depth 1533 is measured from the opening of the third cavity 1543 to the rear perimeter 1519 at the edge first toc end portion 1505A, parallel to the face surface 1514. The third depth 1533 can be a consistent depth or varies along the third cavity 1543. The third depth 1533 of the third cavity 1543 can range from approximately 0.215 inch to 0.245 inch. For example, the third depth 1533 can be approximately 0.215 inch, 0.219 inch, 0.223 inch, 0.227 inch, 0.231 inch, 0.235 inch, 0.239 inch, 0.243 inch, or 0.245 inch. In some embodiments, the third depth 1533 of the third cavity 1543 can be approximately 0.230 inch.

The fourth cavity 1544 of the toe end 1505 and adjacent to the sole 1508 is associated with the toe ledge 1526 at the second toe end portion 1505B. The toe ledge 1526 at the second toe end portion 1505B can cover a portion of the rear surface 1515 ranging from approximately 4% to 10%. For example. The toe ledge 1526 at the second toe end portion 1505B can cover approximately 4%, 5%, 6%, 7%, 8%, 9%, or 10% of the rear surface 1515. In some embodiments, the toe ledge 1526 at the second toe end portion 1505B can cover approximately 5% of the rear surface 1515. The percent coverage of the toe ledge 1526 is the least at the second toe end portion 1505B; similarly, a fourth depth 1534 (described in more details below) of the fourth cavity 1544 associated with the percent coverage of the toe ledge 1526 at the second toe end portion 1505B is also very small. The percent coverage of the toe ledge 1526 at the second toe end portion 1505B is much smaller than the percent coverage at the first toe end portion 1505A. In other embodiments, the percent coverage of the rear surface 1515 at the second toe end portion 1505B can be greater, or the same as the percent coverage of the rear surface 1515 at the first toe end portion 1505A. The percent coverage of the toe ledge 1526 at the second toe end portion 1505B is kept substantially constant and slightly increases toward the third toe end portion 1505C until it integrally forms with the rear portion 1509.

The fourth cavity 1544 of the toe end 1505 between the third cavity 1543 adjacent the top rail 1507, and the second cavity 1542 at the sole 1508 comprises the fourth depth 1534. The fourth depth 1534 is the distance measured from the opening of the fourth cavity 1544 to the rear perimeter 1519 at edge of the second toe end portion 1505B, parallel to the face surface 1514. It can be seen the fourth depth 1534 varies along the fourth cavity 1544, but in other embodiments, could also be consistent along the fourth cavity 1544. The fourth depth 1534 of the fourth cavity 1544 can range from approximately 0.140 inch to 0.165 inch. For example, the fourth depth 1534 can be approximately 0.140 inch, 0.144 inch, 0.148 inch, 0.152 inch, 0.156 inch, 0.160 inch, or 0.165 inch. In some embodiments, the fourth depth 1534 of the fourth cavity 1544 can be approximately 0.150 inch. As stated above, the fourth depth 1534 of the fourth cavity 1544 is correlated with the percent of the rear surface 1515 covered by the toe ledge 1526 at the second toe end portion 1505B. Because the percent coverage of the rear surface 1515 by the toe ledge 1526 is smaller at the second toe end portion 1505B than at the first toe end portion 1505A, thereby the fourth depth 1534 is smaller than the third depth 1533. In other embodiments, wherein the percent coverage of the rear surface 1515 by the toe ledge 1526 is greater at the second toe end portion 1505B than the first toe end portion 1505A, the fourth depth 1534 can also be greater than the third depth 1533. In other embodiments, wherein the percent coverage of the rear surface 1515 by the toe ledge 1526 is the same at the second toc end portion 1505B and the first toe end portion 1505A, the fourth depth 1534 can also be the same as the third depth 1533.

At the heel end 1506 of the club head body 1510 a heel ledge 1524 can extend in a curved manner toward the top rail 1507, the sole 1508, and the toe end 1505. A fifth cavity 1545 is formed between the rear surface 1515 and the heel ledge 1524. The heel ledge 1524 extends from the top end 1501 to the bottom end 1502 and is integrally formed with the top rail 1507, and the rear portion 1509. The heel ledge 1524 can cover a portion of the rear surface 1515. The heel ledge 1524 can cover approximately 3% to 8% of the rear surface 1515. For example, the heel ledge 1524 can cover approximately 3%, 4%, 5%, 6%, 7%, or 8% of the rear surface 1515. In some embodiments, the heel ledge 1524 can cover approximately 4% of the rear surface 1515. The percent coverage of the heel ledge 1524 over the rear surface 1515 is related to a fifth depth 1535 of the fifth cavity 1545.

As illustrated in FIG. 20, the fifth depth 1535 of the fifth cavity 1545 is measured from the opening of the fifth cavity 1545 to the rear perimeter 1519 at the heel end 1506 (abutting the dashed line A-A), parallel to the face surface 1514. The fifth depth 1535 can be a consistent depth or varies along the fifth cavity 1545. The fifth depth 1535 of the fifth cavity 1545 can range from approximately 0.080 inch to 0.110 inch. For example, the fifth depth 1535 can be approximately 0.080 inch, 0.082 inch, 0.084 inch, 0.086 inch, 0.088 inch, 0.090 inch, 0.092 inch, 0.094 inch, 0.096 inch, 0.098 inch, 0.100 inch 0.102 inch, 0.104 inch, 0.106 inch, 0.108 inch, or 0.110 inch. In some embodiments, the fifth cavity 1545 can have a fifth depth 1535 of approximately 0.100 inch.

As illustrated in FIG. 20, the first cavity 1541, second cavity 1542, third cavity 1543, fourth cavity 1544, and fifth cavity 1545 as describe above are all integrally connected with one another, defining a continuous 360 degree undercut 1550. In the exemplary embodiment, the undercut 1550 can comprises the first cavity 1541, the second cavity 1542, the third cavity 1543, the fourth cavity 1544, and the fifth cavity 1545. The undercut 1550 further comprises 100% of the rear perimeter 1519 of the face element 1511 of the club head body 1510. The undercut 1550 of the club head body 1510 can help save weight as well as increase bending within the face element 1511. In other embodiments, the cavities (e.g., first cavity 1541, second cavity 1542, third cavity 1543, fourth cavity 1544, and fifth cavity 1545) can be disconnected in any combination wherein the undercut 1550 comprises 70% to 100% of the rear perimeter 1519. For example, the cavities can be interrupted and non-continuous between the first cavity 1541 and the second cavity 1542, or between the third cavity 1543 and the fourth cavity 1544, or any combination of the first, second, third, fourth, and fifth cavities 1541, 1542, 1543, 1544, and 1545. In some embodiments, the interruption between the cavities can be structures (not pictured) such as ribs, lips, ledges, walls, protrusions, or any other interrupting structures. In these exemplary embodiments, the undercut 1550 can comprise 70%, 75%, 80%, 85%, 90%, 95% or 100% of the rear perimeter 1519.

The face element 1511 of the club head body 1510 comprising the several cavities described above to form a 360 undercut 1550 can further comprise a face thickness. The face thickness of the face element 1511 can help distribute stress and allow for further face inflection during ball impact along with the undercut 1550. In many embodiments, the face thickness of the face element 1511 can vary from the toe end 1505 to the heel end 1506, from the top end 1501 to the bottom end 1502, or any combination thereof.

As illustrated in FIG. 19, the face thickness of the face element 1511 can comprise a first thickness 1551, a second thickness 1552, a third thickness 1553, and a fourth thickness 1554. The first thickness 1551 of the face element is measured perpendicular from the face center 1516 to the rear center 1518. The first thickness 1551 can range from approximately 0.055 inch to 0.075 inch, 0.055 inch to 0.065 inch, 0.065 inch to 0.075 inch, or 0.060 inch to 0.070 inch. For example, the first thickness 1551 can be 0.055 inch, 0.057 inch, 0.059 inch, 0.061 inch, 0.063 inch, 0.065 inch, 0.067 inch, 0.069 inch, 0.071 inch, 0.073 inch, or 0.075 inch. In some embodiments, the first thickness 1551 of the face element 1511 can be approximately 0.065 inch.

As illustrated in FIG. 19, the second thickness 1552 is the face thickness measured perpendicular from the face surface 1514 to an apex of a reinforcement elements 1520 (described in more detail below). In some embodiments devoid of the reinforcement device 1512, the second thickness is measured perpendicular from the face surface 1514 to the rear surface 1515 adjacent the rear center 1518. The second thickness 1552 can range from approximately 0.150 inch to 0.200 inch, 0.150 inch to 0.160 inch, 0.160 inch to 0.170 inch, 0.170 inch to 0.180 inch, 0.180 inch to 0.190 inch, 0.190 inch to 0.200 inch, 0.150 inch to 0.175 inch, or 0.175 inch to 0.200 inch. For example, the second thickness 1552 can be approximately 0.150 inch, 0.155 inch, 0.160 inch, 0.165 inch, 0.170 inch, 0.175 inch, 0.180 inch, 0.185 inch, 0.188 inch, 0.190 inch, 0.195 inch or 0.200 inch. In some embodiments, the second thickness 1552 of the face element 1511 can be approximately 0.188 inch.

As illustrated in FIG. 19, the third thickness 1553 is the face thickness devoid of the reinforcement device 1512 and adjacent the rear perimeter 1519 and distal the rear center 1518, measured perpendicular from the face surface 1514 to the rear surface 1515. The third thickness 1553 can range from approximately 0.050 inch to 0.060 inch, 0.060 inch to 0.070 inch, 0.070 inch to 0.080 inch, 0.080 inch to 0.090 inch, 0.090 inch to 0.100 inch, 0.050 inch to 0.75 inch, or 0.075 inch to 0.100 inch. For example, the third thickness 1553 can be approximately 0.050 inch, 0.55 inch, 0.060 inch, 0.065 inch, 0.070 inch, 0.075 inch, 0.080 inch, 0.085 inch, 0.088 inch, 0.090 inch, 0.095 inch, or 0.100 inch. In some embodiments, the third thickness 1553 of the face element 1511 can be approximately 0.088 inch.

As illustrated in FIG. 19, the fourth thickness 1554 is the face thickness measured perpendicular from the face surface 1514 to the very edge of the rear perimeter 1519 of the rear surface 1515. The fourth thickness 1554 can range from approximately 0.050 inch to 0.090 inch, 0.050 inch to 0.085 inch, 0.050 inch to 0.080 inch, 0.050 inch to 0.070 inch, 0.050 inch to 0.060 inch, 0.060 inch to 0.070 inch, 0.050 inch to 0.058 inch, 0.058 inch to 0.064 inch, or 0.064 inch to 0.070 inch. For example, the fourth thickness 1554 can be approximately 0.50 inch, 0.052 inch, 0.054 inch, 0.056 inch, 0.058 inch, 0.060 inch, 0.062 inch, 0.064 inch, 0.066 inch, 0.068 inch, 0.070 inch, 0.072 inch, 0.074 inch, 0.076 inch, 0.078 inch, 0.080 inch, 0.082 inch, 0.084 inch, 0.086 inch, 0.088 inch, or 0.090 inch. In some embodiments, the fourth thickness 1554 of the face element 1511 can be approximately 0.060 inch.

In some embodiments, the club head body 1510 can be void of a reinforcement device 1512 and reinforcement elements 1520. In these exemplary embodiments, the face element 1511 near the face center 1516 (the first thickness 1551 and the second thickness 1552) can comprise a face thickness greater than 0.088 inch (from approximately 0.088 inch to 0.100 inch, 0.088 inch to 0.220 inch, 0.100 inch to 0.220 inch, or 0.140 inch to 0.180 inch) inch to absorb distribute stress. For example, the face element 1511 near the face center 1516 can comprise a first thickness 1551, and a second thickness 1552 of approximately 0.088 inch, 0.090 inch, 0.092 inch, 0.094 inch, 0.096 inch, 0.098 inch, 0.100 inch, 0.110 inch, 0.114 inch, 0.180 inch, or 0.220 inch.

Club Head with Undercut and Reinforcement Device

In some embodiments, as illustrated in FIGS. 19 and 20, the club head body 1510 further comprises the reinforcement device 1512 similar to the reinforcement device 112, 612 and 912. In other embodiments, the club head body 1510 can be devoid of reinforcement device 1512. The reinforcement device 1512 is located on the rear surface 1515 of the face element 1511, generally at the rear center 1518. The reinforcement device 1512 extends from the rear surface 1515 away from the front end 1503. The reinforcement device 1512 comprises one or more reinforcement elements 1520. In many embodiments, each reinforcement element of the reinforcement elements 1520 comprises an outer perimeter surface 1626, an inner perimeter surface 1629, and a geometric center. The reinforcement element 1520 further comprises looped ribs 1627. In these or other embodiments, the geometric center(s) of one or more of reinforcement elements 1520 can be at the rear center 1518 of the rear surface 1515.

In some embodiments, looped ribs 1527 can comprise multiple looped ribs, wherein each looped rib 1527 can be concentric with each other. In other embodiments, when looped ribs 1527 comprise multiple looped ribs, two or more of looped ribs 1527 can be nonconcentric. Further, in these or other embodiments, two or more of looped rib 1527 can overlap. Meanwhile, in some embodiments, looped ribs 1527 can comprise an elliptical looped rib, and in other embodiments, looped ribs 1527 can comprise a circular looped rib.

In implementation, reinforcement element(s) 1520 and looped ribs 1527 can be implemented in any suitable shape(s) (e.g., polygonal, elliptical, circular, etc.) and/or in any suitable arrangement(s) configured to perform the intended functionality of reinforcement device 1512 and/or reinforcement element(s) 1520 as described above. Further, when reinforcement element(s) 1520 comprise multiple reinforcement elements, two or more reinforcement elements of reinforcement element(s) 1520 can be similar to another, and/or two or more reinforcement elements of reinforcement element(s) 1520 can be different from another.

In some embodiments, one or more outer perimeter surfaces 1626 of reinforcement elements 1520 can be filleted with rear surface 1515. In these or other embodiments, one or more inner perimeter surfaces 1629 of looped ribs 1627 can be filleted with rear surface 1515. Filleting the outer perimeter surface 1626 of reinforcement elements 1520 with rear surface 1515 can permit a smooth transition of reinforcement elements 1520 into rear surface 1515. Further, filleting the outer perimeter surface 1626 of reinforcement elements 1520 with rear surface 1515 can direct stresses from impact into reinforcement elements 1520 and away from the face surface 1514. Meanwhile, outer perimeter surface 1626 of reinforcement elements 1520 or inner perimeter surface 1629 of looped ribs 1627 can be filleted with rear surface 1515 with a fillet 1523 having a radius of greater than or equal to approximately 0.012 centimeters. For example, in some embodiments, the fillet 1523 of the outer perimeter surface 1626 with the rear surface 1515 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 1523 of the inner perimeter surface 1629 with the rear surface 1515 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface 1626 of reinforcement elements 1520 can be filleted directly with rear surface 1515. In these embodiments, the face thickness decreases gradually along the fillet 1523 from face thickness at the second face thickness 1552 (face surface 1514 to the apex of the reinforcement element 1520) to face thickness at rear surface 1515.

In some embodiments, club head 1500 can further include a lip (not pictured) on rear surface 1515 of club head 1500 similar to the lip 552 as described above and FIGS. 15-17. The lip of club head 1500 can extend from the heel end 1506 to the toe end 1505 around the reinforcement element 1520 of club head 1500. In these or other embodiments, a fillet 1523 on the outer perimeter surface 1626 of the reinforcement elements 1520 can transition to the lip such that the face thickness decreases gradually along the fillet 1523 from the second thickness 1552 to a minimum thickness between the lip and the reinforcement element 1520, then increases gradually from the minimum thickness to the an apex of the lip. In these embodiments, the minimum thickness between the reinforcement element 1520 and the lip can be greater than the first thickness 1551 at the face center 1516, the minimum thickness between the reinforcement element 1520 and the lip can be approximately equal to the first thickness 1551, or the minimum thickness between the reinforcement element 1520 and the lip can be less than the first thickness 1551.

As described previously, reinforcement device 1512 and reinforcement element(s) 1520 are configured to reinforce face element 1511 while still permitting face element 1511 to bend, such as, for example, when face surface 1514 impacts a golf ball. As a result, face element 1511 can be thinned to permit mass from face element 1511 to be redistributed to other parts of club head 1500 and to make face element 1511 more flexible without buckling and failing under the resulting bending. Advantageously, because face element 1511 can be thinner when implemented with reinforcement device 1512 and reinforcement element(s) 1520, the center of gravity, the moment of inertia, and the coefficient of restitution of club head 1500 can be altered to improve the performance characteristics of club head 1500. For example, implementing reinforcement device 1512 and reinforcement element(s) 1520 can increase a flight distance of a golf ball hit with face surface 1514 by increasing launch angle, increasing the ball speed, and/or decreasing spin of the golf ball. In these examples, reinforcement device 1512 and reinforcement element(s) 1520 can have the effect of countering some of the gearing on the golf ball provided by face surface 1514.

The reinforcement device 1512 and reinforcement element(s) 1520 are further able to provide stress reducing benefits when implemented as a closed structure (i.e., looped ribs 1527) because such closed structures are able to resist deformation as a result of circumferential (i.e., hoop) stresses acting on reinforcement device 1512 and reinforcement element(s) 1520. For example, circumferential (i.e., hoop) stresses acting on reinforcement device 1512 and reinforcement element(s) 1520 can prevent opposing sides of reinforcement device 1512 and reinforcement element(s) 1520 from rotating away from each other, thereby reducing bending.

The undercut 1550 of the club head body 1510 can produce similar performance characteristics of the reinforcement device 1512 as described above. In some embodiments, the club head body 1510 can be devoid of the reinforcement device 1512, wherein the club head body 1510 comprising the undercut 1550 can perform similar to a club head body 1510 with both the reinforcement device 1512, and the undercut 1550. The undercut extending in 360 degrees comprising the first cavity 1541, the second cavity 1542, the third cavity 1543, the fourth cavity 1544 and the fifth cavity 1545 allow for optimal bending and deflection of the face element 1511 during impact. In similar club head bodies void of a 360 degree undercut, the face element cannot bend or deflect as much. More specifically, similar club head bodies void of a third cavity 1543, a fourth cavity 1544, and/or a fifth cavity 1545 cannot bend or deflect at the heel end and at the toe end. The deflection of similar club heads are limited at the heel end 1506 and toe end 1505 is due to the rear surface of the face element not having any space to bend back. The 360 degree undercut 1550 of the club head body 1510 specifically comprising the third cavity 1543, and the fourth cavity 1544 at the toe end 1505, and the fifth cavity 1545 at the heel end 1506 prevents the rear surface 1515 of the face element 1511 from contacting the toe ledge 1526 and heel ledge 1524 during impact, thus the face element 1511 can freely bend for greater deflection. The fourth depth 1534 of the fourth cavity 1544 further prevents the rear surface 1515 of the face element 1511 from coming into contact with the toe ledge 1526 during impact for increased deflection; due to the small fourth depth 1534 of the fourth cavity 1543 (i.e., the toe ledge 1526 is not as pronounced), the face element 1511 near the toe end 1505 can extend farther back.

The deflection of the face element 1511 affects the coefficient of restitution (COR) of the club head 1500. The COR measures the elasticity of an object in collision and is the ratio of the object's final relative speed to the objects' initial relative speed. A higher COR results in increased ball speed and distance, and a lower COR results in decreased ball speed and distance. Therefore, the increased deflection of the 360 degree undercut 1550 of the club head 1500 affects the distance and speed of the ball after impact. As the undercut 1550 increases the deflection of the face element 1511, the distance and speed of the ball also increases.

Further still, the 360 degree undercut 1550 allows for removal of mass from the perimeter of the face element 1511 that experiences the least amount of stress (i.e., the rear perimeter 1519 between located between the rear surface 1515, and the rear portion 1509 top rail 1507, toe ledge 1526, and heel ledge 1524). The removed mass can then be redistributed to other locations on the club head 1500 (e.g., the bottom end 1502, near the toe end 1505, near the heel end 1506, or any combination thereof). The redistribution of mass can shift the center of gravity (CG) lower and back toward the rear end 1504, which can provide the club head with higher performance characteristics such as increased moment of inertia (MOI). The width of the first portion 1526A can further affect the mass distribution for CG and MOI. The width of the first portion 1526A as illustrated in FIG. 20 adds to the mass in the toe end 1505 to help improve MOI. Better CG placement and increased MOI can lead to increased ball speeds as well as prevent rotation of the club head 1500 from toe end 1505 to heel end 1506. Preventing the rotation of the club head 1500 from toe end 1505 to heel end 1506 allows for better contact with the ball upon impact, which can result in optimal ball speed, spin, and trajectory. In some embodiments to further effect the CG, a weight (not pictured) can be disposed within the second cavity 1542 between the rear surface 1515 and the rear portion 1509. The weight positioned within the second cavity 1542 allows the CG to shift toward the rear end 1504 and the sole 1508. The weight disposed within the second cavity 1542 can further absorb stress and vibration experienced by the club head body 1510 during impact. Stress and vibration absorbing by the weight can help maintain the durability and structural integrity of the club head body 1510 as well as improve feel for a player.

The club head body 1510 can further comprise a cascading sole 1555 located on an inner cavity the sole 1508 at the bottom of the second cavity 1542 located between the rear portion 1509 and the rear surface 1515. The cascading sole 1555 of club head body 1510 can be similar to the cascading sole 955 of club head body 910 as described above having a first tier (not pictured) and a second tier (not pictured). The cascading sole 1555 of club head body 1510 allows some of the stress experienced by the face element 1511 near the sole 1508, to distribute to the first tier and the second tier of the club head body 1510. The first tier and the second tier of the cascading sole 1555 of club head body 1510 prevent the stress from collecting primarily at the thinnest section of the face element 1511 near the sole 1508. The distribution of stresses in the first tier and the second tier in the sole 1508 can prevent permanent deformation of the face element 1511, thus more consistent performance characteristic and feel after a plurality of impacts with the ball.

Club Head with Arcuate Toe Ledge

Figure 22:
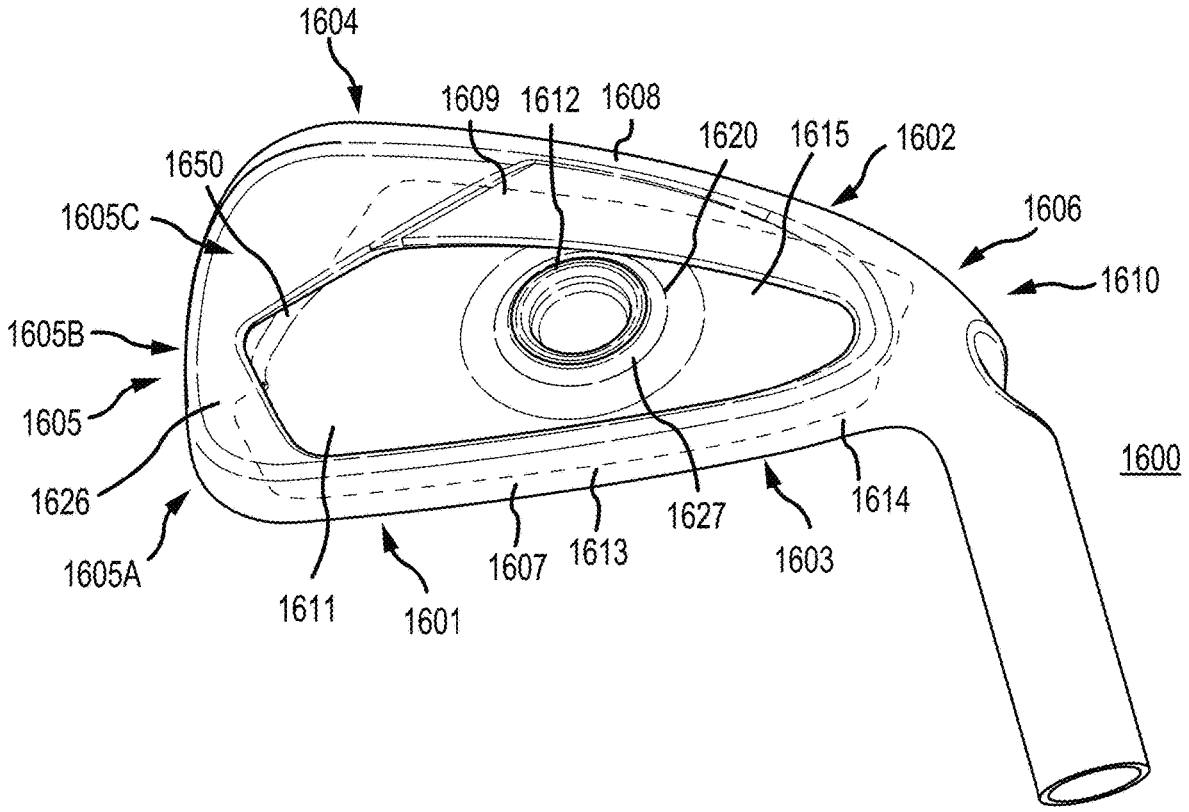
FIG. 22 illustrates a rear view of a club head according to another embodiment.

In some embodiments, as illustrated in FIG. 22, the club head can comprise a toe end with an arcuate toe ledge to increase the perimeter weighting of the club head and improve the moment of inertia of the golf club head. The toe end of the club head can comprise a toe ledge that covers a greater portion of a rear surface. In one embodiment, a club head 1600 can comprise a toe end 1605 with a third toe end portion 1605C that covers a greater portion of the rear surface 1615 than a first toe end portion 1605A and a second toe end portion 1605B. Club head 1600 comprises a club head body 1610. As illustrated in FIG. 22, the club head body 1610 can be similar to the club head body 110, 910, or 1510 as described above. The club head body 1610 comprises a top end 1601, a bottom end 1602 opposite the top end 1601, a front end 1603, a rear end 1604 opposite the front end 1603, a toe end 1605, a heel end 1606 end opposite the toe end 1605, and a face element 1611. The toe end 1605 is further divided into a first toe end portion 1605A, a second toe end portion 1605B, and a third toe end portion 1605C. The first toe end portion 1605A is adjacent to and integral with the top end 1601. The third toe end portion 1605C is adjacent to and integral with the bottom end 1602. The second toe end portion 1605B is located between the first toe end portion 1605A and the third toe end portion 1605C.

In many embodiments, the face element 1611 of the club head body 1610 comprises a face surface 1614 positioned on the front end 1603, and a rear surface 1615 positioned on the rear end 1604 opposite the face surface 1614. The face surface 1614 can refer to a striking face or a striking plate, where the face surface 1614 is configured to impact a golf ball (not shown).

The top end 1601 of the club head body 1610 comprises a top rail 1607. The top rail 1607 extends in an arcuate fashion or directionality from the top end 1601 toward the rear end 1604, and the bottom end 1602 to form a top rail wall 1613. The curvature of the top rail wall 1613 covers a portion of the rear surface 1615. The top rail wall 1613 can extend from the heel end 1606 to the toe end 1605. The top rail wall 1613 can cover approximately 10% to 22% of the rear surface 1615. For example, the top rail wall 1613 can cover approximately 10%, 12%, 14%, 16%, 18%, 20%, or 22% of the rear surface 1615. In some embodiments, the top rail wall 1613 can cover approximately 18% of the rear surface 1615.

The bottom end 1602 of the club head body 1610 comprises a sole 1608 that integrally forms into a rear portion 1609 extending upward toward the top end 1601 over a portion of the rear surface 1615. The rear portion 1609 can extend from the heel end 1606 to the toe end 1605. The rear portion 1609 can cover approximately 30% to 55% of the rear surface 1615. For example, the rear portion 1609 can cover approximately 30%, 35%, 40%, 45%, 50%, or 55% of the rear surface 1615. In some embodiments, the rear portion 1609 extending upward toward the top end 1601 can cover approximately 45% of the rear surface 1615.

At the toe end 1605 of the club head body 1610, as illustrated in FIG. 22, a toe ledge 1626 can extend in a curved manner from the top end 1601 to the bottom end 1602. The toc ledge 1626 extends from the top rail 1607 to the rear portion 1609, wherein the toe ledge 1626 is integrally formed with the rear portion 1609 and the top rail wall 1613. More specifically, the toe ledge 1626 at the first toe end portion 1605A is adjacent to and integral with the top rail 1607, and the toc ledge 1626 at the third toe end portion 1605C is adjacent to and integral with the rear portion 1609.

The toe ledge 1626 at the first toe end portion 1605A can cover a portion of the rear surface 1615. More specifically, the toe ledge 1626 at the first toe end portion 1605A can cover approximately 7% to 15% of the rear surface 1615. For example, the toe ledge 1626 at the first toe end portion 1605A can cover approximately 7%, 9%, 11%, 13%, or 15% of the rear surface 1615. In some embodiments, the toe ledge 1626 at the first toe end portion 1605A covers approximately 9% of the rear surface 1615. The percent coverage by the toe ledge 1626 at the first toe end portion 1605A is greater than the percent coverage by the toe ledge 1626 at the second toe end portion 1605B. The percent coverage by the toe ledge 1626 at the first toe end portion 1605A can help increase the top end/toe end weighting to improve the moment of inertia. The percent coverage by the toe ledge 1626 at the first toe end portion 1605A decreases toward the second toe end portion 1605B, wherein the percent coverage of the toe ledge 1626 at the second toe end portion 1605B is the smallest out of the three toe end portions.

The toe ledge 1626 at the second toe end portion 1605B can cover a portion of the rear surface 1615. More specifically, the toe ledge 1626 at the second toe end portion 1605B can cover approximately 4% to 10% of the rear surface 1615. For example, the toe ledge 1626 at the second toe end portion 1605B can cover approximately 4%, 5%, 6%, 7%, 8%, 9%, or 10% of the rear surface 1615. In some embodiments, the toe ledge 1626 at the second toe end portion 1605B can cover approximately 5% of the rear surface 1615. The percent coverage by the toe ledge 1626 is the least at the second toe end portion 1605B. The percent coverage by the toe ledge 1626 at the second toe end portion 1605B is less than the percent coverage at the first toe end portion 1605A. In other embodiments, the percent coverage of the rear surface 1615 at the second toe end portion 1605B can be greater, or the same as the percent coverage of the rear surface 1615 at the first toe end portion 1605A. The percent coverage by the toe ledge 1626 at the second toe end portion 1605B is kept substantially constant between the first toe end portion 1605A and the third toe end portion 1605C.

The toe ledge 1626 at the third toe end portion 1605C can cover a portion of the rear surface 1615. More specifically, the toe ledge 1626 at the third toe end portion 1605C can cover approximately 12% to 20% of the rear surface 1615. For example, the toe ledge 1626 at the third toe end portion 1605C can cover approximately 12%, 14%, 16%, 18%, or 20% of the rear surface 1615. The percent coverage by the toe ledge 1626 is greatest at the third toe end portion 1605C. The percent coverage by the toe ledge 1626 at the third toe end portion 1605C can be greater than the percent coverage by the toe ledge 1626 at the first toe end portion 1605A and the percent coverage by the toe ledge 1626 at the second toe end portion 1605B. The percent coverage by the toe ledge 1626 at the third toe end portion 1605C can help to increase the bottom end/toe end weighting to improve the moment of inertia. The percent coverage by the toe ledge 1626 at the third toe end portion 1605C substantially increases toward the rear portion 1609 until it integrally forms with the rear portion 1609. The percentage coverage by the toe ledge 1626 at the third toe end portion 1605C can be the greatest of the three toe end portions.

The club head 1600 can comprise several cavities formed along the perimeter of the face element 1611 between the rear surface 1615 and several back wall structures as described above. In many embodiments, these cavities are integral with one another and connect together to form a 360 degree undercut between the rear surface 1615 and the several back wall structures. The several back wall structures can be form from the top end 1601, the bottom end 1602, the toe end 1605, and the heel end 1606 of the club head body 1610. In other embodiments, some of the cavities can be integral with one another and connect together, while other cavities are interrupted by structures (e.g., ribs, ledges, walls, or any other separating-type structures). In many embodiments, the club head body 1610 comprising the cavities can further comprise a reinforcement device 1612 (as described above). The reinforcement device 1612 can comprise one or more reinforcement elements 1620 or looped ribs 1627 similar to the reinforcement device 1512 as described above. In other embodiments, the golf club head 1600 comprising the cavities can be devoid of the reinforcement device 1612.

Further advantages of the toe end 1605 of the club head 1600 include an increase in weighting on the toe end 1605. More specifically, an increase weighting on the bottom end 1602 at the toe end 1605. The club head 1600 can comprise 5 to 15 grams more weight at the toe end 1605 than the toe end 1505 of the club head 1500. In other embodiments, the club head 1600 can comprise 5 to 10 grams, or 10 to 15 grams more weight at the toe end 1605 than the toe end 1505 of the club head 1500. For example, the club head 1600 can comprise 5, 6, 7, 8, 9, 10, 11, 12, 13, 14, or 15 grams more weight at the toe end 1605 than the toe end 1505 of club head 1500. The increase in weighting at the toe end 1605 allows for a greater moment of inertia thereby reducing the amount of twisting the club head 1600 experiences for off center golf ball hits.

Club Head with Undercut and Variable Face Element Thickness

In some embodiments, as illustrated in FIGS. 23-26, the club head can comprise a face element with one or more thickness regions instead of a reinforcement device. In one embodiment, a club head 1700 can comprise a face element 1711 with a thickened central region 1764 and a thinned perimeter region 1760, and a 360 degree undercut 1750 that extends along a perimeter of the face element 1711. Club head 1700 comprises a club head body 1710. The club head body 1710 can be similar to the club head body 110, 910, 1510, or 1610 as described above, but devoid of a reinforcement device. The club head body 1710 comprises a top end 1701, a bottom end 1702 opposite the top end 1701, a front end 1703, a rear end 1704 opposite the front end 1703, a toe end 1705, a heel end 1706 end opposite the toe end 1705, and a face element 1711. The toe end 1705 is further divided into a first toc end portion 1705A, a second toe end portion 1705B, and a third toe end portion 1705C. The toe end 1705 with the first toe end portion 1705A, the second toe end portion 1705B, and the third toe end portion 1705C can be similar to the toe end 1505 or the toe end 1605 as described above.

Figure 23:
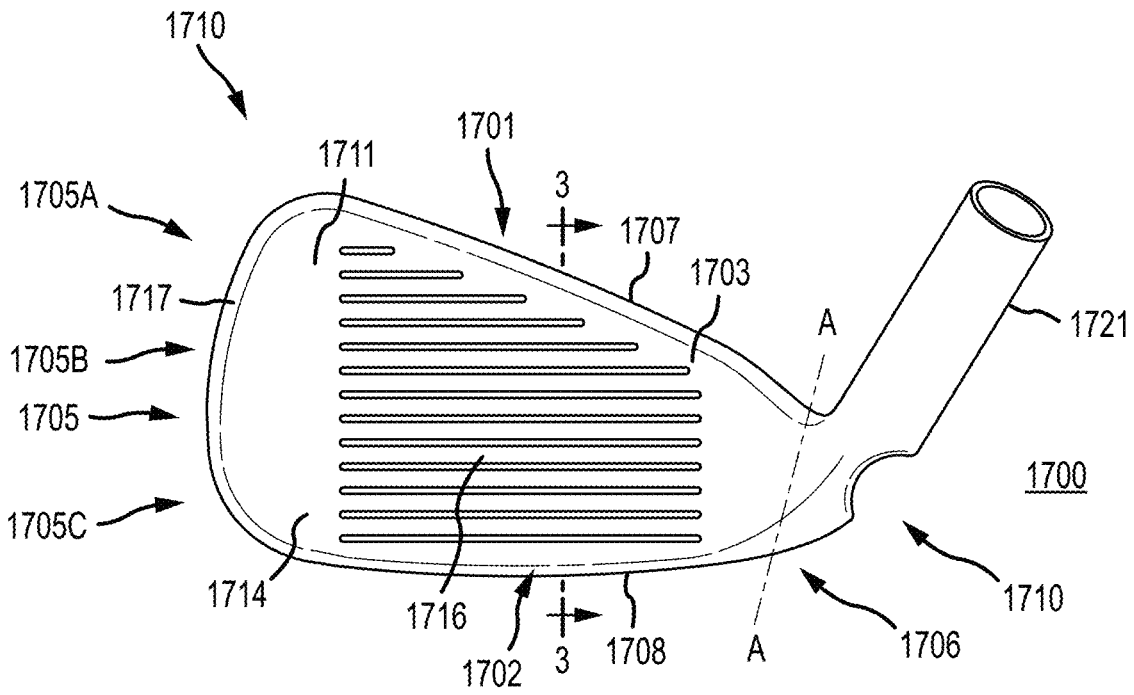
FIG. 23 illustrates a front view of a club head according to another embodiment.
Figure 25:
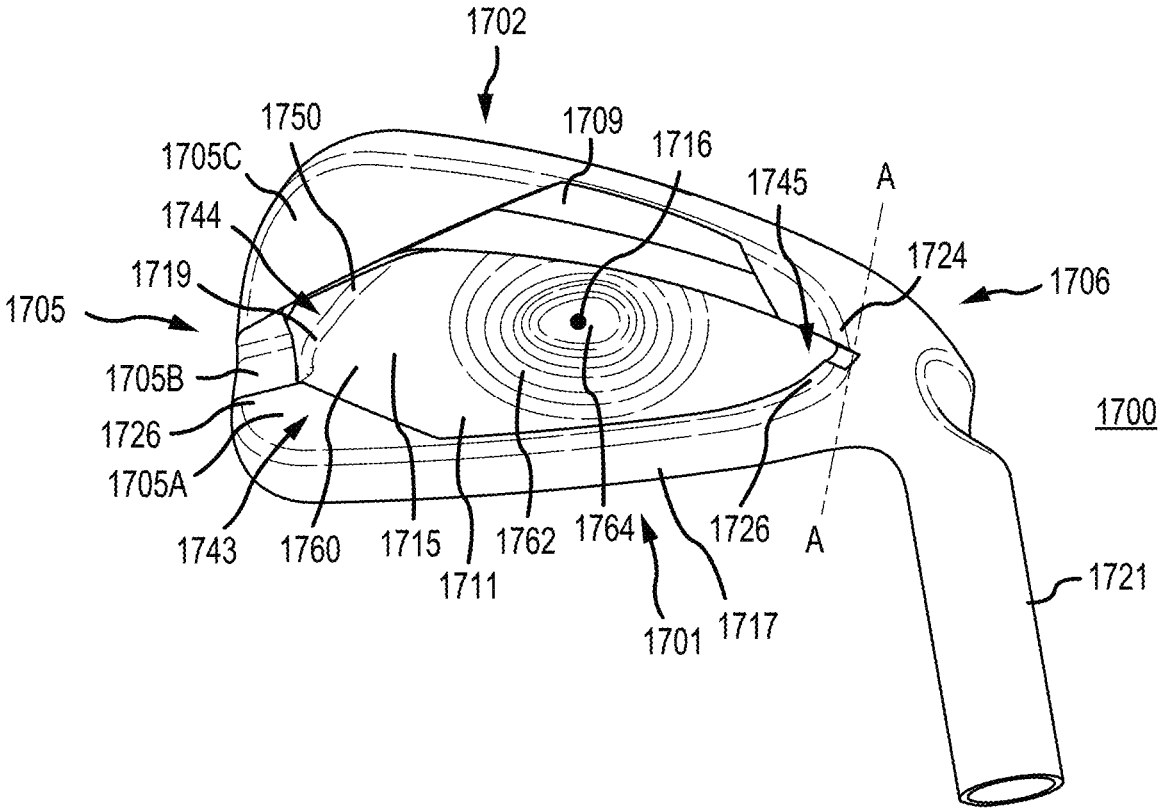
FIG. 25 illustrates a rear view of the club head according to the embodiment of FIG. 23.

The club head 1700 further comprises a hosel 1721. The hosel 1721 is integral with the club head body 1710. As illustrated in FIGS. 23 and 25, dashed line A-A represents the junction of the hosel 1721 and the club head body 1710, wherein the club head 1700 transitions from the club head body 1710 comprising a flat surface to the hosel 1721 comprising a curved surface. The hosel 1721 can be configured to receive a shaft (not shown).

In many embodiments, the face element 1711 of the club head body 1710 comprises a face surface 1714 positioned on the front end 1703, and a rear surface 1715 positioned on the rear end 1704 opposite the face surface 1714. The face surface 1714 can refer to a striking face or a striking plate, where the face surface 1714 is configured to impact a golf ball (not shown). The face surface 1714 comprises a face center 1716 located at a geometric center of the face surface 1714, and a face perimeter 1717 along the periphery of the face surface 1714, wherein the face perimeter 1717 abuts against the dashed line A-A at the heel end 1706 of the club head body 1710.

Figure 24:
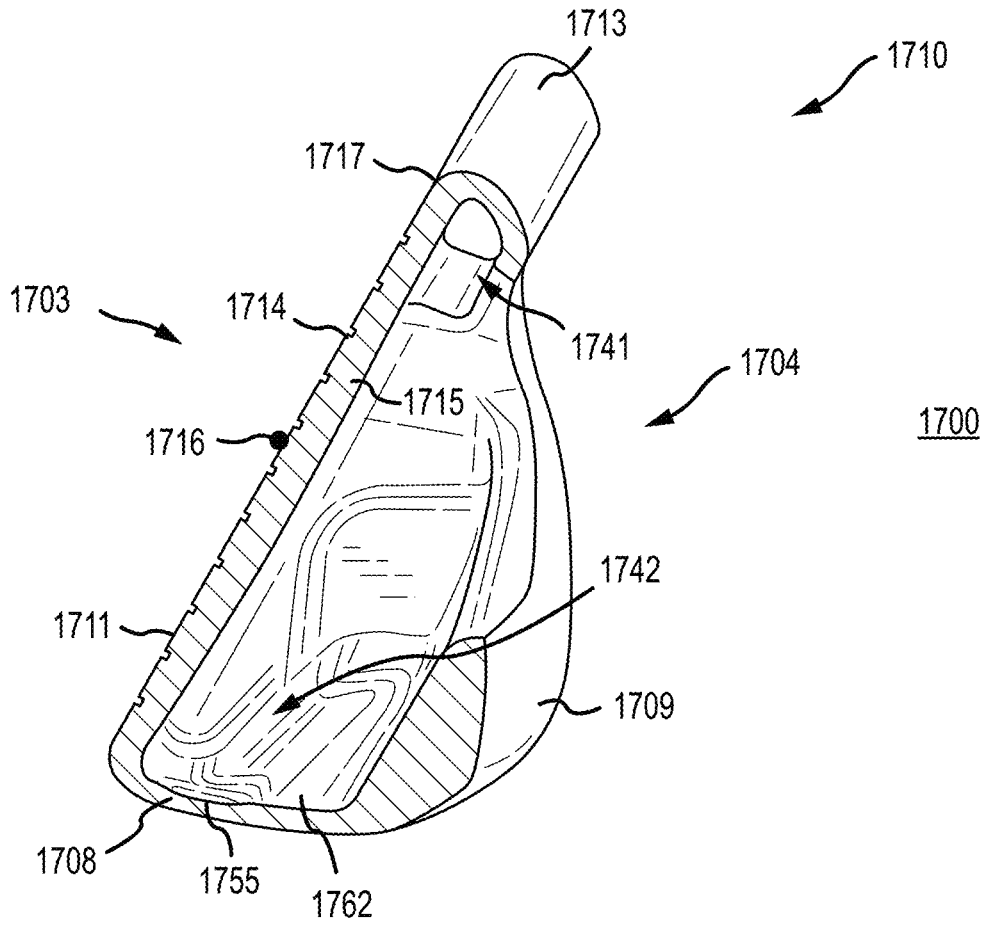
FIG. 24 illustrates a cross-sectional view of the club head according to the embodiment of FIG. 23.

FIGS. 24 and 25 illustrate the club head body 1710, wherein several cavities can be formed between the rear surface 1715 and several back wall structures along the perimeter of the face element 1711. In many embodiments, these cavities are integral with one another and connect together to form a 360 degree undercut 1750 between the rear surface 1715 and the several back wall structures. The undercut 1750 of club head 1700 can be similar to the undercut 1550 of club head 1500 as described above. Further, the cavities and the cavity depths of undercut 1750 can be similar to the cavities and the cavity depths of undercut 1550 as described above. The several back wall structures can be formed from the top end 1701, the bottom end 1702, the toe end 1705, and the heel end 1706 of the club head body 1710. In other embodiments, some of the cavities can be integral with one another and connect together, while other cavities are interrupted by structures (e.g., ribs, ledges, walls, or any other separating-type structures). In some embodiments, the club head body 1710 comprising the undercut 1750 can further comprise a face element 1711 comprising one or more thickness regions (as described in more detail below).

As described above and illustrated in FIG. 26, the face center 1716 defines an orgin of a coordinate system having an x-axis 107 and a y-axis 108. The x-axis 107 and the y-axis 108 are perpendicular to each other. Accordingly, the x-axis 107 extends through the face center 1716 from near the heel end 1706 to near the toe end 1705 in a direction parallel with a ground plane 6000. The ground plane 6000 is tangent to the sole 1708 of the club head 1700 at an address position. The y-axis 108 extends through the face center 1716 from near the top end 1701 to near the sole 1708 of the club head 1700 in a direction perpendicular to the ground plane 6000.

Figure 26:
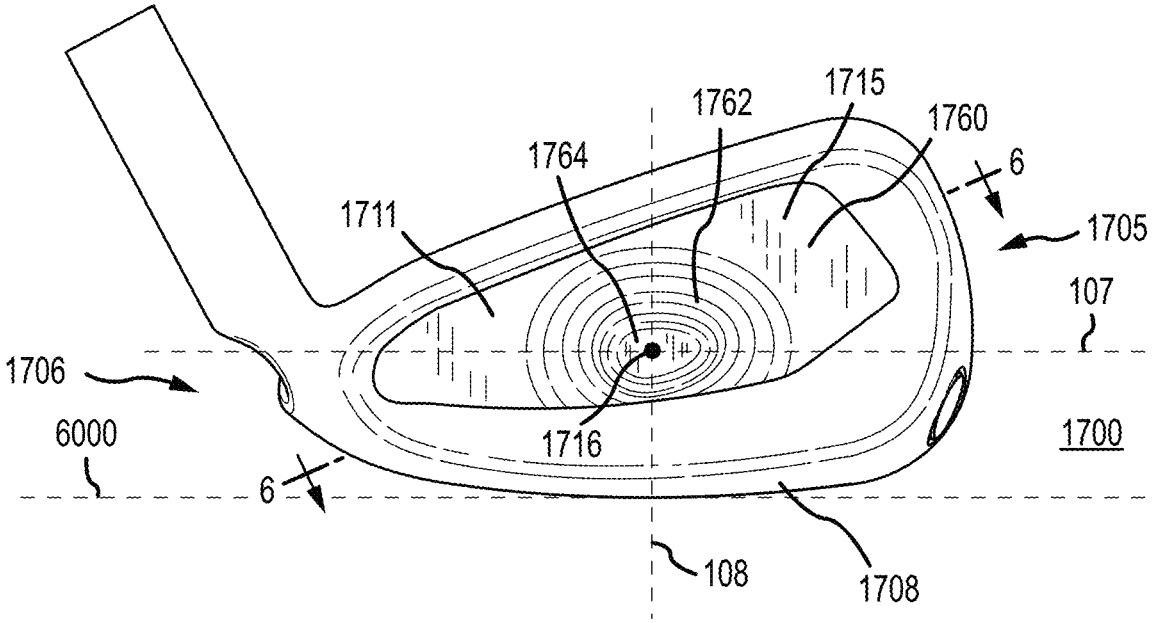
FIG. 26 illustrates a rear view of the club head according to the embodiment of FIG. 23.
Figure 27:
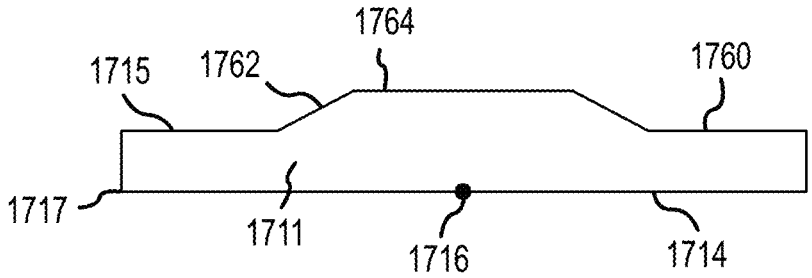
FIG. 27 illustrates a cross-sectional view of the club head according to the embodiment of FIG. 23.
Figure 28:
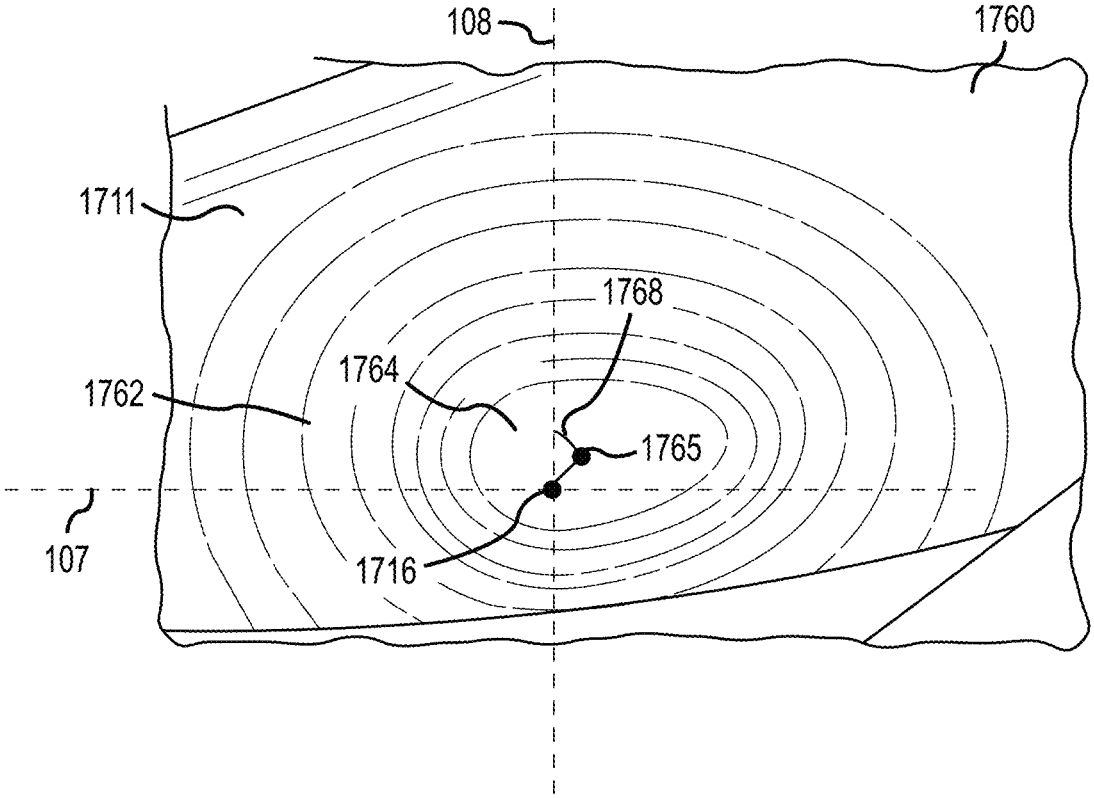
FIG. 28 illustrates an enlarged rear view of the club head according to the embodiment of FIG. 23.

Referring to FIGS. 26-28, the face element 1711 comprises a thickness measured from the face surface 1714 to the rear surface 1715 in a direction perpendicular to the face surface 1714. The thickness of the face element 1711 varies and is described below with reference to one or more regions extending radially from the face center 1716 to the face perimeter 1717 (i.e. in a direction of a radius, extending in a direction from the face center 1716 outward toward the face perimeter 1617, or extending in a direction from the face perimeter 1717 inward towards the face center 1716).

As illustrated in FIGS. 26 and 27, the one or more regions comprise a perimeter region 1760, a transition region 1762, and a central region 1764. The perimeter region 1760 abuts or contacts the face perimeter 1717 and extends inward toward the face center 1716. The perimeter region 1760 comprises a perimeter thickness that is constant and defines the boundary of the perimeter region 1760. In some embodiments, the perimeter thickness can comprise a minimum thickness of the face element 1711. The perimeter thickness can be less than or equal to 0.10 inch, less than or equal to 0.09 inch, or less than or equal to 0.08 inch. In other embodiments, the perimeter thickness can range from 0.05 inch to 0.10 inch. In other embodiments still, the perimeter thickness can range from 0.05 inch to 0.075 inch, or 0.075 inch to 0.10 inch. In other embodiments still, the perimeter thickness can range from 0.06 inch to 0.10 inch, 0.07 inch to 0.10 inch, or 0.07 inch to 0.10 inch. For example, the perimeter thickness can be 0.05, 0.06, 0.07, 0.08, 0.09, or 0.10 inch. In another example, the perimeter thickness can be 0.088 inch.

The transition region 1762 abuts or contacts the perimeter region 1760 and extends inward toward the face center 1716 from the perimeter region 1760. The transition region 1762 comprises a transition thickness that varies in a direction from the perimeter region 1760 toward the face center 1716. In some embodiments, the transition thickness increases in a direction from the perimeter region 1760 toward the face center 1716. In other embodiments, the transition thickness decreases in a direction from the central region 1764 toward the face perimeter 1717.

The central region 1764 abuts or contacts the transition region 1762 and extends inward toward the face center 1716 from the transition region 1762. The central region 1764 can encompass the face center 1716. The central region 1764 comprises a central thickness that is constant. In some embodiments, the central thickness comprises a maximum thickness of the face element 1711, where the central thickness is positioned over the face center 1716. The central thickness can be greater than or equal to 0.09 inch, greater than or equal to 0.10 inch, greater than or equal to 0.11 inch, greater than or equal to 0.12 inch, or greater than or equal to 0.13 inch. In other embodiments, the central thickness can range from 0.09 inch to 0.20 inch. In some embodiments, the central thickness can range from 0.09 inch to 0.15 inch, or 0.15 to 0.20 inch. In some embodiments, the central thickness can range from 0.09 inch to 0.125 inch, 0.125 inch to 0.15 inch, 0.15 inch to 0.175 inch, or 0.175 inch to 0.20 inch. In other embodiments, the central thickness can range from 0.10 inch to 0.20 inch, 0.11 inch to 0.20 inch, 0.12 inch to 0.20 inch, 0.13 inch to 0.20 inch, or 0.14 inch to 0.20 inch. For example, the central thickness can be 0.09, 0.10, 0.11, 0.12, 0.13, 0.14, 0.15, 0.16, 0.17, 0.18, 0.19, or 0.20 inch. In another example, the central thickness can be 0.113 inch.

Further, in some embodiments, as illustrated in FIG. 28, the central region 1764 can encompass a central region center 1765 offset from the face center 1716. The center region center 1765 is positioned at a geometric center of the central region 1764. The central region center 1765 can be offset from the face center 1716 in a direction towards the top end 1701, the bottom end 1702, the toe end 1705, or the heel end 1706 of the club head 1700. In other embodiments, the central region center 1765 can be offset from the face center 1716 at an angle 1768 in relation to the y-axis 108. The offset angle 1768 of the central region center 1765 can be measured from the y-axis 108 to a line extending through the face center 1716 and the central region center 1765. In some embodiments, the offset angle 1768 can range from 0 to 10 degrees. In other embodiments, the offset angle 1768 can range from 0 to 5 degrees, or 5 to 10 degrees. The offset angle 1768 between the central region center 1765 and the y-axis 108 corresponds to a central region 1764 that is angled in relation to the y-axis 108. As illustrated in FIGS. 25, 26, and 28, the central region 1764 can be angled towards the toe end 1705 and/or the top end 1701 to provide reinforcement for golf ball impacts near the toe end 1705 of the face surface 1714.

The face element 1711 comprising one or more thickness regions is configured to reinforce the face element 1711 while still permitting the face element 1711 to bend, such as, for example, when the face surface 1714 impacts a golf ball. As a result, face element 1711 can be thinned to permit mass from face element 1711 to be redistributed to other parts of club head 1700, similar to club head 1500 as described above, and to make face element 1711 more flexible without buckling and failing under the resulting bending. Advantageously, because face element 1711 can be thinner near the face perimeter 1717, the center of gravity, the moment of inertia, and the coefficient of restitution of club head 1700 can be altered to improve the performance characteristics of club head 1700. For example, implementing the face element 1711 with one or more thickness regions can increase a flight distance of a golf ball hit with face surface 1714 by increasing launch angle, increasing the ball speed, and/or decreasing spin of the golf ball. In these examples, the face element 1711 with one or more thickness regions can have the effect of countering some of the gearing on the golf ball provided by face surface 1714. Further advantages of the club head 1700 comprising both the undercut 1750 and the face element 1711 with one or more thickness region is described below in Example 3.

The club head body 1710 with both the undercut 1750 and the face element 1711 with one or more thickness regions can produce similar performance characteristics to the club head body 1510 with both the reinforcement device 1512 and the undercut 1550. The undercut 1750 comprises a first cavity 1741, a second cavity 1742, a third cavity 1743, a fourth cavity 1744, and a fifth cavity 1745. The 360 degree undercut 1750 comprising the first cavity 1741, the second cavity 1742, the third cavity 1743, the fourth cavity 1744 and the fifth cavity 1745 allows for optimal bending and deflection of the face element 1711 during impact. In similar club head bodies void of a 360 degree undercut, the face element cannot bend or deflect as much. More specifically, similar club head bodies void of the third cavity 1743, the fourth cavity 1744, and/or the fifth cavity 1745 cannot bend or deflect at the heel end and at the toe end. The deflection of similar club heads are limited at the heel end 1706 and toe end 1705 due to the rear surface of the face element not having any space to bend back. The 360 degree undercut 1750 of the club head body 1710 specifically comprising the third cavity 1743, and the fourth cavity 1744 at the toe end 1705, and the fifth cavity 1745 at the heel end 1706 prevents the rear surface 1715 of the face element 1711 from contacting the toe ledge 1726 and heel ledge 1724 during impact, thus the face element 1711 can freely bend for greater deflection.

The deflection of the face element 1711 affects the coefficient of restitution (COR) of the club head 1700. The COR measures the elasticity of an object in collision and is the ratio of the object's final relative speed to the objects' initial relative speed. A higher COR results in increased ball speed and distance, and a lower COR results in decreased ball speed and distance. Therefore, the increased deflection of the 360 degree undercut 1750 of the club head 1700 affects the distance and speed of the ball after impact. As the undercut 1750 increases the deflection of the face element 1711, the distance and speed of the ball also increases.

The club head body 1710 with both the undercut 1750 and the face element 1711 with one or more thickness regions is configured to use a strong material that reinforces the club head 1700 while still being malleable to bend the hosel 1721 for loft or lie angle adjustments. The club head body 1710 of the club head 1700 can comprise a material with a yield strength of between 80 to 90 kilopound per square inch (ksi). The club head body 1510 with both the undercut 1550 and the reinforcement device 1512 is configured to use a strong material that reinforces the club head 1500, but is not malleable enough to easily bend the hosel 1521 for loft or lie angle adjustments. The club head body 1510 of club head 1500 can comprise a material with a yield strength of at least 130 ksi. The club head body 1610 of club head 1600 can use a similar material as club head body 1510 of club head 1500. The material of the club head 1700 comprises a lower yield strength, which allows the club head 1700 to be malleable to bend the hosel 1721 for loft or lie angle adjustments. The material of the club head 1500 comprises a greater yield strength, which does not allow the club head 1500 to be malleable enough to bend the hosel easily for loft or lie angle adjustments. The materials of the club head 1500 and the club head 1700 can be various compositions of steels or stainless steels. For example, the club head 1700 can comprise a 17-4 stainless steel with a yield strength of between 80 to 90 ksi, and the club head 1500 or 1600 can comprise a 17-4 stainless steel with a yield strength of at least 130 ksi.

The club head body 1710 can further comprise a cascading sole 1755 located on an inner cavity the sole 1708 at the bottom of the second cavity 1742 located between the rear portion 1709 and the rear surface 1715. The cascading sole 1755 of club head body 1710 can be similar to the cascading sole 955 of club head body 910, or the cascading sole 1555 of the club head body 1510 as described above, where the casacading sole 1755 comprises a first tier (not shown) and a second tier (not shown). The cascading sole 1755 of club head body 1710 allows some of the stress experienced by the face element 1711 near the sole 1708, to distribute to the first tier and the second tier of the club head body 1710. The first tier and the second tier of the cascading sole 1755 of club head body 1710 prevent the stress from collecting primarily at the thinnest section of the face element 1711 near the sole 1708. The distribution of stresses in the first tier and the second tier in the sole 1708 can prevent permanent deformation of the face element 1711, thus providing more consistent performance characteristics and feel after a plurality of impacts with the ball.

In other embodiments, the cascading sole 1755 can comprise a first tier, a second tier, and a third tier (not shown). Each tier comprises a constant thickness throughout the tier extending in a direction from the heel end 1706 to the toe end 1705. The first tier can comprise a greater thickness than a thickness of the second tier, and the second tier can comprise a greater thickness than a thickness of the third tier. The thickness of the first, second, and third tier is measured from the sole 1708 to a inner sole surface 1762 in a direction perpendicular to the sole 1708. In some embodiments, the first tier can be approximately 0.055 inch (0.140 cm) to approximately 0.085 inch (0.216 cm) thick, or approximately 0.060 inch (0.152 cm) to approximately 0.080 inch thick (0.203 cm), and the second tier can be approximately 0.045 inch (0.114 cm) to approximately 0.075 inch (0.191 cm) thick, or approximately 0.050 inch (0.127 cm) to approximately 0.070 inch (0.178 cm) thick. In some embodiments, the third tier is approximately 0.030 inch (0.076 cm) to approximately 0.060 inch (0.152 cm) thick, or approximately 0.035 inch (0.089 cm) to approximately 0.055 inch (0.140 cm) thick. In one example, the first tier can be approximately 0.067 inch, the second tier can be approximately 0.057 inch, and the third tier can be approximately 0.042 inch.

The first tier can comprise a first tier length, the second tier can comprise a second tier length, and the third tier can comprise a third tier length. In some embodiments, the first tier length can be greater than the second tier length, and the second tier length can be greater than the third tier length. In other embodiments, the first tier length, the second tier length, and the third tier length can be same. The cascading sole 1755 of club head body 1710 allows some of the stress experienced by the face element 1711 near the sole 1708, to distribute to the first tier, the second tier, and the third tier of the club head body 1710. The additional third tier allows the stress to move even further away from the face element 1711, preventing permanent deformation of the face element 1711.

Club Head with First and Second Weights

Figure 29:
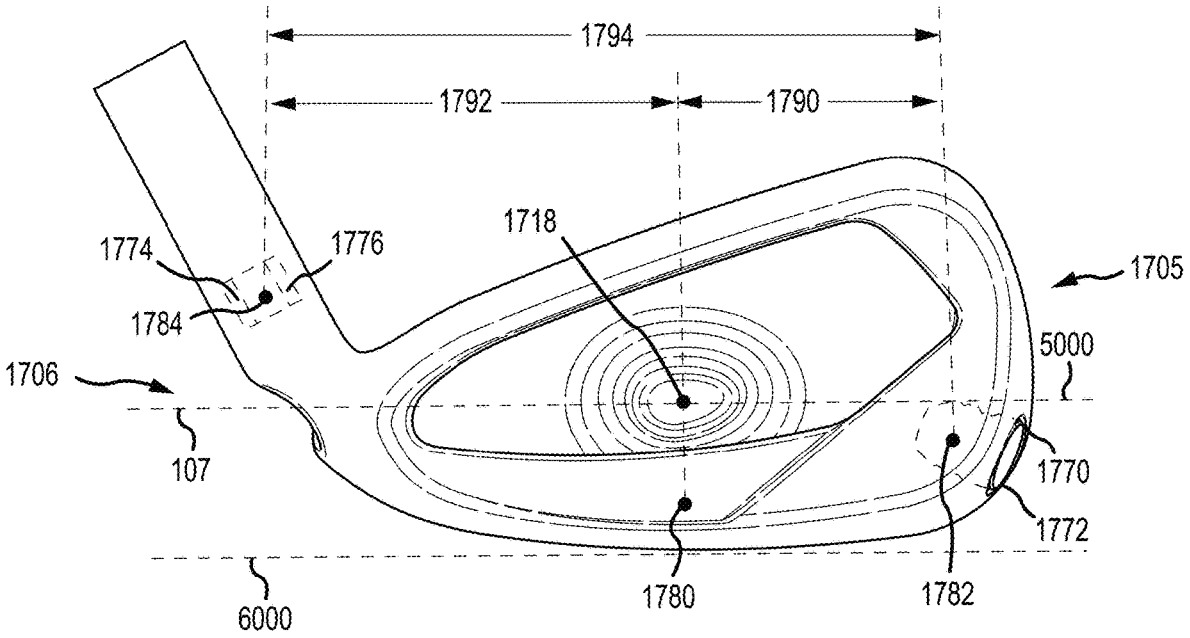
FIG. 29 illustrates a rear view of the club head according to embodiment of FIG. 23.

In some embodiments, as illustrated in FIG. 29, the club head 1700 can further comprise a first aperture 1770 located at the toe end 1705, and a second aperture 1774 located in the hosel 1721. The first aperture 1770 can be configured to receive a first weight 1772 (i.e. toe weight), and the second aperture 1774 can be configured to receive a second weight 1776 (i.e. tip weight). In other embodiments, the club head 100, 900, 1500, or 1600 can comprise a first and second aperture configured to receive a first and second weight. The first weight 1772 and the second weight 1776 can comprises various shapes and dimensions that are complimentary to the first 1770 and the second aperture 1774. The first weight 1772 and the second weight 1776 allow for the redistribution of mass toward the perimeter of the club head 1700 to shift the center of gravity (CG) lower and back toward the rear end 1704, which can provide the club head with higher performance characteristics such as increased moment of inertia (MOI), increased ball speed, trajectory control, and/or tigheter dispersion.

In some embodiments, the first weight 1772 can be offset from the face element 1711 or the rear portion 1709. In some embodiments, the first weight 1772 does not intersect the undercut 1750, where the first weight 1772 does not protrude into the fourth cavity 1744. In other embodiments, the first weight 1772 does intersect the undercut 1750, where the first weight 1772 protrudes into the fourth cavity 1744.

In some embodiments, the first weight 1772 or the second weight 1776 can comprise a single elemental metal such as aluminum, copper, titanium, tungsten, steel, stainless steel, or any other suitable metals. In some embodiments, the first weight 1772 or the second weight 1776 can comprise a metal alloy such as aluminum alloy, copper alloy, tungsten alloy, steel alloy, stainless steel alloy, titanium alloy, or any other suitable metal alloy. In other embodiments, the first weight 1772 or the second weight 1776 can comprise a plastic such as a thermoplastic, thermoplastic composite, or any other suitable plastic.

In some embodiments, the first weight 1772 can comprise a weight greater than the weight of the second weight 1776. In some embodiments the second weight 1776 can comprise a weight less than the weight of the first weight 1772. In some embodiments, the first weight 1772 can comprise a specific gravity greater than the specific gravity of the second weight 1776. In some embodiments, the second weight 1776 can comprise a specific gravity less than the specific gravity of the first weight 1772.

In some embodiments, the first weight 1772 can comprise a weight greater than or equal to 1 gram, greater than or equal to 5 grams, greater than or equal to 10 grams, greater than or equal to 15 grams, or greater than or equal to 20 grams. In other embodiments, the weight of the first weight 1772 can range from 1 to 20 grams. In other embodiments, the weight of the first weight 1772 can range from 1 to 10 grams, or 10 to 20 grams. In other embodiments still, the weight of the first weight 1772 can range from 2 to 5 grams, 5 to 10 grams, 10 to 15 grams, or 15 to 20 grams. For example, the weight of the first weight 1772 can be 1, 2, 3, 4, 5, 6, 7, 8, 9, 10, 11, 12, 13, 14, 15, 16, 17, 18, 19, or 20 grams.

In some embodiments, the first weight 1772 can comprise a specific gravity greater than or equal to 1, greater than or equal 5, greater than or equal 10, greater than or equal to 15, or greater than or equal to 20. In other embodiments, the specific gravity of the first weight 1772 can range from 1 to 25. In other embodiments, the specific gravity of the first weight 1772 can range from 1 to 15, or 15 to 25. In other embodiments still, the specific gravity of the first weight 1772 can range from 1 to 5, 5 to 10, 10 to 15, 15 to 20, or 20 to 25. For example, the specific gravity of the first weight 1672 can be 1, 2, 3, 4, 5, 6, 7, 8, 9, 10, 11, 12, 13, 14, 15, 16, 17, 18, 19, 20, 21, 22, 23, 24, or 25.

In some embodiments, the second weight 1776 can comprise a weight greater than or equal to 0.5 gram, greater than or equal to 5 grams, greater than or equal to 10 grams, greater than or equal to 15 grams, or greater than or equal to 20 grams. In other embodiments, the weight of the second weight 1776 can range from 0 to 20 grams. In other embodiments, the weight of the second weight 1776 can range from 0 to 10 grams, or 10 to 20 grams. In other embodiments still, the weight of the second weight 1776 can range from 0 to 5 grams, 5 to 10 grams, 10 to 15 grams, or 15 to 20 grams. For example, the weight of the second weight 1776 can be 0, 1, 2, 3, 4, 5, 6, 7, 8, 9, 10, 11, 12, 13, 14, 15, 16, 17, 18, 19, or 20 grams.

In some embodiments, the second weight 1776 can comprise a specific gravity greater than or equal to 0.5, greater than or equal to 1, greater than or equal 5, greater than or equal 10, greater than or equal to 15, or greater than or equal to 20. In other embodiments, the specific gravity of the second weight 1776 can range from 0.5 to 25. In some embodiments, the specific gravity of the second weight 1776 can range from 0.5 to 12.5, or 12.5 to 25. In some embodiments, the specific gravity of the second weight 1776 can range from 0.5 to 5, 5 to 10, 10 to 15, 15 to 20, or 20 to 25. For example, the specific gravity of the second weight 1776 can be 0.5, 1, 2, 3, 4, 5, 6, 7, 8, 9, 10, 11, 12, 13, 14, 15, 16, 17, 18, 19, 20, 21, 22, 23, 24, or 25.

Referring to FIG. 29, the first weight 1772 and the first aperture 1770 can comprise a confined shape such that the first aperture 1770 receives the first weight 1772 in only one direction. Similarly, the second weight 1776 and the second aperture 1774 can comprise a confined shape such that the second aperture 1774 receives the second weight 1776 in only one direction. The first weight 1772 and the second weight 1776 can be coupled to the first aperture 1770 and the second aperture 1674 respectively by swaging, centrifugal co-casting, welding, mechanical interlock such as threads, press-fit, adhesives, or any combination thereof.

Further, the club head 1700 comprises a center of gravity position 1780 (hereafter "the club head CG position"). The first weight 1772 located at the toe end 1705 comprises a center of gravity position 1782 (hereafter "the first weight CG position"). The second weight 1776 located in the hosel 1721 comprises center of gravity position 1784 (hereafter "the second weight CG position"). As described above and illustrated in FIG. 29, the club head 1700 comprises the x-axis 107 that extends through the face center 1716 from near the heel end 1706 to the toe end 1705 in a direction parallel to the ground plane 6000. The club head 1700 comprises a first distance 1790 measured between the club head CG position 1780 and the first weight CG position 1782 in a direction parallel to x-axis 107. In some embodiments, the first distance 1790 can be greater than or equal to 0.5 inch, greater than or equal to 1.0 inch, greater than or equal to 1.25 inch, greater than or equal to 1.5 inch, or greater than or equal to 2.0 inch. In other embodiments, the first distance 1790 can range from 0.5 to 2.0 inch. In some embodiments, the first distance 1790 can range from 0.5 to 1.0 inch, or 1.0 to 2.0 inch. For example, the first distance 1790 can be 0.5, 0.6, 0.7, 0.8, 0.9, 1.0, 1.1, 1.2, 1.3, 1.4, 1.5, 1.6, 1.7, 1.8, 1.9, or 2.0 inch.

The club head 1700 comprises a second distance 1792 measured between the club head CG position 1780 and the second weight CG position 1784 in a direction parallel to the x-axis 107. In some embodiments, the second distance 1792 can be equal to the first distance 1790.

In other embodiments, the second distance 1792 can be greater than the first distance 1790. In some embodiments, the second distance 1792 can be greater than or equal to 0.5 inch, greater than or equal to 1.0 inch, greater than or equal to 1.25 inch, greater than or equal to 1.5 inch, or greater than or equal to 2.0 inch. In other embodiments, the second distance 1792 can range from 0.5 to 2.0 inch. In some embodiments, the second distance 1792 can range from 0.5 to 1.0 inch, or 1.0 to 2.0 inch. For example, the second distance 1792 can be 0.5, 0.6, 0.7, 0.8, 0.9, 1.0, 1.1, 1.2, 1.3, 1.4, 1.5, 1.6, 1.7, 1.8, 1.9, or 2.0 inch.

The club head 1700 comprises a third distance 1794 measured between the first weight CG position 1782 and the second weight CG position 1784 in a direction parallel to the x-axis 107. In some embodiments, the third distance 1794 is greater than the first distance 1790 and the second distance 1792. In some embodiments, the third distance 1794 can be greater than or equal to 1 inch, greater than or equal to 2 inch, greater than or equal to 3 inch, greater than or equal to 4 inch, or greater than or equal to 5 inch. In other embodiments, the third distance 1794 can range from 1 to 5 inch. In some embodiments, the third distance 1794 can range from 1 to 2.5 inch, or 2.5 to 5.0 inch. For example, the third distance 1794 can be 1.0, 1.5, 2.0, 2.5, 3.0, 3.5, 4.0, 4.5, or 5.0 inch. Adjustment of the first distance 1790, the second distance 1792, and the third distance 1794 allows for increased moment of inertia which reduces the amount of twisting the club head 1700 experiences during golf ball impacts. By increasing the first distance 1790 or the second distance 1792, the moment of inertia increases because the first weight 1772 or the second weight 1776 is further away from the club head CG position 1780. In another example, by decreasing the first distance 1790 or the second distance 1792, the moment of inertia decreases because the first weight 1772 or the second weight 1776 is closer to the club head CG position 1780.

Further, as illustrated in FIG. 29, the first weight 1670 and the second weight 1677 can be positioned in relation to the x-axis 107. A midplane 5000 intersects the face center 1716 and extends along the x-axis 107, where the midplane 6000 extends in a direction from the heel end 1706 to the toe end 1705 of the club head 1700, and extends in a direction from the front end 1703 to the rear end 1704 of the club head 1700. The midplane 5000 is parallel to the ground plane 6000 when the club head is in the address position. In some embodiments, the first weight 1772 can be located below the midplane 5000, and the second weight 1676 can be located above the midplane 5000. In other embodiments, the first weight 1772 can be located above the midplane 5000, and the second weight 1776 can be located below the midplane 5000. In other embodiments still, the first weight 1772 and the second weight 1776 can both be located above the midplane 5000 or below the midplane 5000. The position of the first weight 1772 and the second weight 1776 in relation to the midplane 5000 allow for the redistribution of mass toward the perimeter of the club head 1700 to shift the center of gravity (CG) lower and back toward the rear end 1704, which can provide the club head 1700 with higher performance characteristics such as increased moment of inertia (MOI), increased ball speed, trajectory control, and/or tigheter dispersion.

The golf club head 100, 300, 600, 800, 900, 1500, 1600, 1700 can be part of a set of club heads having varying loft angles. In some embodiments, center thickness 537, face thickness 542 outside reinforcement element 120, top thickness 546, bottom thickness 548, face thickness at rib height 540, or a combination of the described thicknesses can vary with loft angle of the club heads within the set of club heads.

Figure 10:
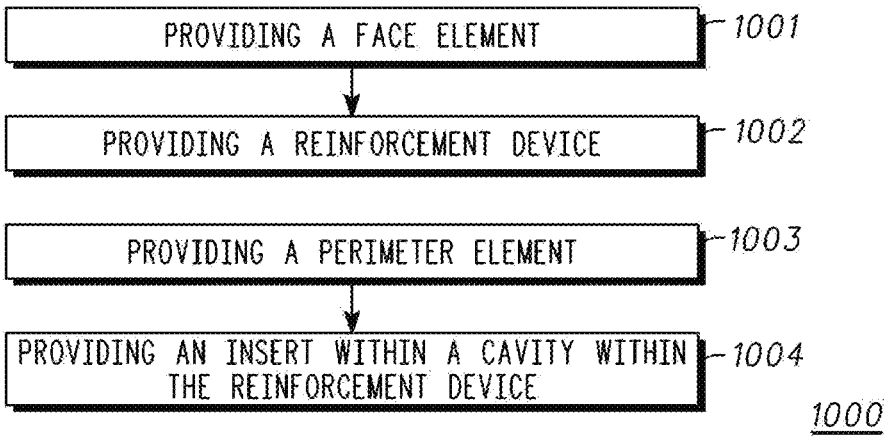
FIG. 10 illustrates a flow chart for an embodiment of a method of providing a golf club head.

Turning now to the next drawing, FIG. 10 illustrates a flow chart for an embodiment of method 1000 of providing a golf club head. Method 1000 is merely exemplary and is not limited to the embodiments presented herein. Method 1000 can be employed in many different embodiments or examples not specifically depicted or described herein. In some embodiments, the activities, the procedures, and/or the processes of method 1000 can be performed in the order presented. In other embodiments, the activities, the procedures, and/or the processes of method 1000 can be performed in any other suitable order. In still other embodiments, one or more of the activities, the procedures, and/or the processes in method 1000 can be combined or skipped. In many embodiments, the golf club head can be similar or identical to golf club head 100 (FIGS. 1 & 2), golf club head 600 (FIGS. 6 & 7), and/or golf club head 800 (FIGS. 8 & 9).

Method 1000 can comprise an activity 1001 of providing a face element. The face element can be similar or identical to face element 111 (FIG. 1).

Figure 11:
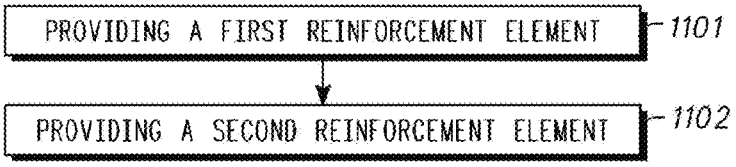
FIG. 11 illustrates an exemplary activity of providing a reinforcement device, according to the embodiment of FIG. 10.

Method 1000 can comprise an activity 1002 of providing a reinforcement device. The reinforcement device can be similar or identical to reinforcement device 112 (FIG. 1). FIG. 11 illustrates an exemplary activity 1002, according to the embodiment of FIG. 10.

For example, activity 1002 can comprise an activity 1101 of providing a first reinforcement element. The first reinforcement element can be similar or identical to first reinforcement element 121 (FIG. 1), reinforcement element 621 (FIG. 6), any one reinforcement element of reinforcement element(s) 120 (FIG. 1), and/or any one reinforcement element of reinforcement element(s) 620 (FIG. 6).

Further, activity 1002 can comprise an activity 1102 of providing a second reinforcement element. The second reinforcement element can be similar or identical to second reinforcement element 641 (FIG. 6) and/or any one reinforcement element of reinforcement element(s) 620 (FIG. 6). In some embodiments, activity 1101 and activity 1102 can be performed approximately simultaneously. In other embodiments, activity 1102 can be omitted.

Turning back to FIG. 10, method 1000 can comprise an activity 1003 of providing a perimeter wall element. The perimeter wall element can be similar or identical to perimeter wall element 113 (FIG. 1). In some embodiments, activity 1003 can be omitted.

In some embodiments, method 1000 can comprise an activity 1004 of providing an insert within a central cavity within the reinforcement device provided in activity 1002. In some embodiments, activity 1004 can be omitted.

In many embodiments, two or more of activities 1001-1004 can be performed sequentially or can be performed approximately simultaneously with each other. In these or other embodiments, activities 1001-1004 can be performed implementing any suitable manufacturing techniques (e.g., casting, forging, molding, machining, joining, etc.).

Although the golf club head(s) and related methods herein have been described with reference to specific embodiments, various changes may be made without departing from the spirit or scope of the present disclosure. For example, to one of ordinary skill in the art, it will be readily apparent that activities 1001-1004 of FIG. 10 and activities 1101 and 1102 of FIG. 11 may be comprised of many different procedures, processes, and activities and be performed by many different modules, in many different orders, that any element of FIGS. 1-4 may be modified, and that the foregoing discussion of certain of these embodiments does not necessarily represent a complete description of all possible embodiments.

EXAMPLES

Example 1

360 Degree Undercut Vs. Partial Undercut

Referring to Table 1 below, a Finite Element Analysis (FEA) test was done to evaluate the internal energy (measured in lbf·inches) of two similar golf club heads during impact with a golf ball at 90 mph. Three points of impact on the face element of the golf club heads were chosen for the FEA test, the toe end, the face center, and the heel end. The first golf club head tested was club head 1500, which comprised the 360 degree undercut 1550 wherein the undercut 1550 is continuous and comprises the first, second, third, fourth, and fifth cavities 1541, 1542, 1542, 1544, and 1545 as described above of club head body 1510. For comparative measure, the control golf club head used was similar in size and structure, comprising an cavity within the top rail, and the sole, but was devoid of a 360 degree undercut (i.e., devoid of a cavity in the heel end and the toe end).

TABLE 1

Deflection and Ball Speed Performance of Club Head 1500 vs. Control

| | Peak Face Element Bending (inches) | Ball Speed At The Heel End (mph) | Ball Speed At The Center (mph) | Ball Speed At The Toe End (mph) |
|---|---|---|---|---|
| Club Head 1500 | 0.040-0.050 | 123.0 | 125.3 | 123.2 |
| Control Club Head | 0.030-0.040 | 122.4 | 124.3 | 121.9 |

The FEA test measured the internal energy produced by the face element, wherein 7.8 lbf·inches equated to approximately 1 mph. As shown in Table 1 above, the golf club head produced golf ball speeds of approximately 123.0 mph at the heel end 1506, approximately 125.3 mph at the face center 1516, and approximately 123.2 mph at the toe end 1505. Compared to the club head 1500, the control golf club head produced slower golf ball speeds of approximately 122.4 mph at the heel end, approximately 124.3 mph at the face center, and approximately 121.9 mph at the toe end. The club head 1500 comprised of the full 360 undercut 1550 comprising the integrally continuous first cavity 1541, second cavity 1542, third cavity 1543, fourth cavity 1544, and fifth cavity 1545 had an increase in ball speed in all three points tested, compared to the similar control golf club head with only a cavity in the top rail and the sole (i.e., devoid of a cavity in the heel end and the toe end). More specifically, the club head 1500 had an increase of approximately 0.5-0.75 mph (approximately 0.5% increase) in the heel end 1506, an increase of approximately 1 mph (approximately 0.8% increase) in the face center, and an increase of approximately 1-1.5 mph (approximately 1.1% increase) in the toe end 1505 over the control golf club head.

The FEA test further showed the peak deflection the face elements of the golf club heads experienced during impact with the golf ball. The peak deflection was measured in FEA from a face surface of the face element at a starting position to the face surface of the face element at an end of impact position, prior to the face element rebounding back to the start position. The face element 1511 of the club head 1500 having the 360 degree undercut experienced a peak deflection of 0.040 inch to 0.050 inch, while the face element of the control golf club head had a cavity in the top rail, and a cavity in the sole, but devoid of the cavity in the heel end and the toe end experienced a peak deflection of 0.030 inch to 0.040 inch. Therefore, the face element 1511 of the club head 1500 having the 360 degree undercut has a 28.6% increase in peak deflection.

As shown in Table 1 and explained above, the club head 1500 increased ball speed in the heel end 1506, the face center 1516, and the toe end 1505, as well as increased peak deflection of the face element 1511 compared to the control golf club head. The increased performance results of the club head 1500 are due mainly to the 360 undercut 1550 comprised of the first cavity 1541, the second cavity 1542, the third cavity 1543, the fourth cavity 1544, and the fifth cavity 1545; this is compared to the similarly structured and sized control golf club head that had a cavity in the top rail and a cavity in the sole but was devoid of the cavity in the heel end and the toe end.

A continuous 360 degree undercut 1550, specifically comprising the third and fourth cavities 1543, and 1544 at the toe end 1505, and the fifth cavity 1545 at the heel end 1506, allowed more room for the face element 1511 to deflect. Therefore, more internal energy was produced, which equates to more ball speed. A higher ball speed can result in other performance characteristics, such as launch angle ball spin and tightening the statistical area in which the ball lands, which all effect the distance of the ball during a game. More specifically, the increase ball speed experienced by the club head 1500 can equate to a 0.1 to 0.3 degree higher launch angle and a 100 revolutions per minute (rpm) to 300 rpm lower ball spin compared to the similar control club had with only the top rail and sole cavities. A higher launch angle and lower ball spin can increase the distance the ball travels after impact. The increase in launch angle and decrease in spin rate of the club head 1500 comprising the first, second, third, fourth, and fifth cavities 1541, 1542, 1542, 1544, and 1545 had an increase of 2 yards to 5 yards of ball distance compared to the control club head devoid of a toe and heel end cavity.

The club head 1500 comprised of the 360 degree undercut 1550 not only increased in ball speed, but maintained a similar MOI as the control club head with only the top rail and sole cavities. Having a similar MOI as a club head with lower balls speeds means the club head 1500 can behave as a more forgiving club without giving up faster ball speeds. The club head 1500 is further forgiving, due to more consistent ball speeds across the face element 1511 (from the toe end 1505 to the heel end 1506). A more consistent ball speed across the face element 1511 can thereby produce more consistent ball flight and distance during mishits (i.e., impact at the heel end 1506 or the toe end 1505).

Example 2

Reinforcement Device Stress Tests

An exemplary golf club 100 comprising a reinforcement device 112 having a looped rib was compared to a similar control club head, devoid of the reinforcement device 112 using finite element analysis to simulate impact stresses. The reinforcement device 112 of the exemplary club head 100 includes a fillet between the outer perimeter surface of the reinforcement device 112 and the rear surface 115 of the face element 111, a face thickness that is thinner within the inner perimeter surface 129 relative to the outer perimeter surface 126 of the reinforcement device 112, and a rib span of 1.65 centimeters. Areas of high stress concentration on the exemplary club head 100 discussed in this example are indicated with reference number 8000 (see FIGS. 31 and 34). Areas of high stress concentration on the control club head discussed in this example are indicated with reference number 7000 (see FIGS. 30, 32, and 33).

i. Fillet

The reinforcement element 120 on the rear surface 115 of the face element 111 comprising a fillet between the outer perimeter surface of the reinforcement element 120 and the rear surface 115 of the face element 111, beneficially allows impact stresses to be transferred from the face element 111 into the reinforcement element 120.

One of ordinary skill would expect the fillet between the outer perimeter surface 126 of the reinforcement element 120 and the rear surface 115 of the face element 111 to distribute impact stresses generally over a larger area at the interface between the face element 111 and the reinforcement element 120. Upon impact with a golf ball, the fillet not only distributes stresses over a larger area at or near this interface, but also transfers stresses away from the interface, up and towards the end portion or rear end of the reinforcement element 120, away from the face element 111.

Figure 30A:
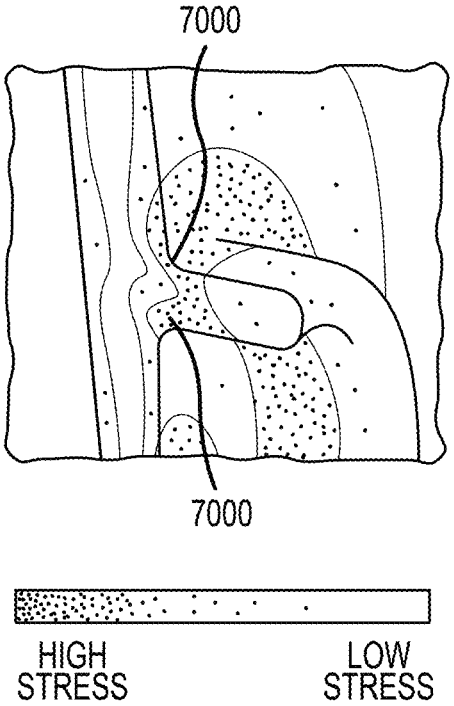
FIG. 30A a perspective side cross-sectional view of a stress simulation of a control club head having a reinforcement device devoid of a fillet during impact with a golf ball.
Figure 30B:
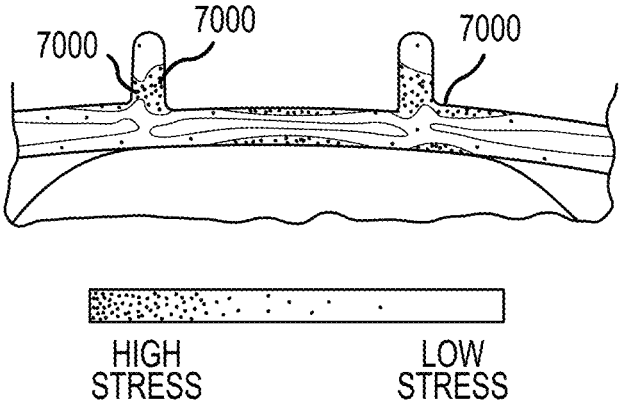
FIG. 30B is a side cross-sectional view of a stress simulation of a control club head having a reinforcement device devoid of a fillet during impact with a golf ball.
Figure 31A:
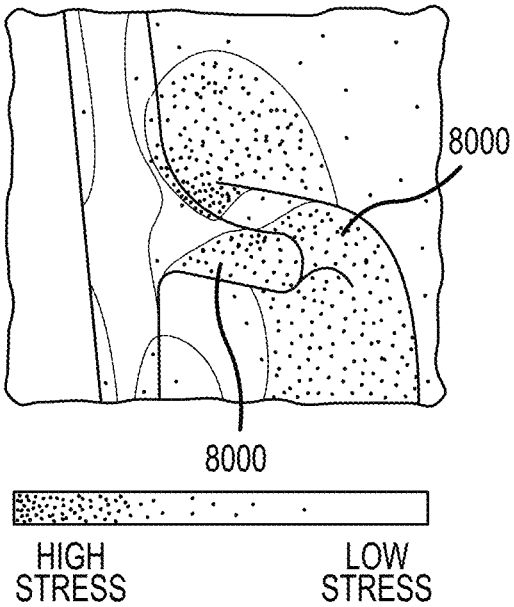
FIG. 31A is a perspective side cross-sectional view of a stress simulation of an exemplary golf club head having a reinforcement device with a fillet during impact with a golf ball.
Figure 31B:
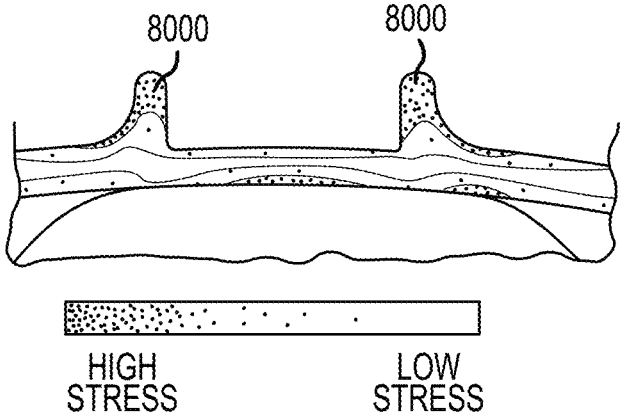
FIG. 31B is a side cross-sectional view of a stress simulation of an exemplary golf club head having a reinforcement device with a fillet during impact with a golf ball.

The transfer of stress at impact with a golf ball is illustrated in FIGS. 30 and 31 for the club head 100 having the reinforcement device 112 compared to a control club head having a reinforcement element devoid of the fillet. Referring to FIGS. 30A and 30B, at impact, areas of greatest stress 7000 are generated on the control club head at the interface of the reinforcement element with the face element and exhibit a familiar pattern associated with that of a stress concentrator at those locations. FIGS. 31A and 31B illustrate the efficient transfer of stress from the face element 111 and into the end or rear portion of the reinforcement device 112, as a result of the fillet between the outer perimeter surface 126 and the face element 111 (particularly shown at the junction between the inner perimeter of the reinforcement device and the face element).

ii. Face Thickness

The transfer of impact stress away from the face element 111 and into the reinforcement element 120 allows the center of the face element 111 to be thinned to a thickness of approximately 0.075 inch to increase face deflection and ball speed on impact with a golf ball. Accordingly, the face element 111 can be thinner within the inner perimeter surface 129 relative to the outer perimeter surface 126 of the reinforcement element 120. Reduced face thickness allows greater bending at impact, thereby increasing energy transfer to a ball on impact to increase ball speed and travel distance.

Normally, reducing face thickness increases stress in the face element 111 upon impact with a golf ball. The reduction in face thickness of the club head 100 can be achieved without sacrificing durability (in fact, while reducing the stress on the face element), as a result of the reinforcement device 120. The efficient reduction in impact stress on the face element 111, while reducing the face element 111 thickness within the inner perimeter surface 129 of the reinforcement device 120 relative to outside the outer perimeter surface 126 of the reinforcement device 120 results from the unique stress transfer properties of the fillet, as described above.

iii. Rib Span

The reinforcement device 112 of the exemplary club head 100 comprises a rib span 538 of 1.65 centimeters. The rib span 538 plays an important role in the amount of stress that is transferred from the face element 111 into the end portion or rear end of the reinforcement device 112 due to the fillet. Specifically, the rib span 538 size allows the transfer of impact stress generated at the face into a hoop stress within the reinforcement device 112.

FIGS. 32-34 illustrate the transfer of stress at impact with a golf ball for the exemplary club head 100 having reinforcement device 112 compared to control club heads having a reinforcement element with a larger rib span and a smaller rib span than the exemplary club head 100.

Figure 32A:
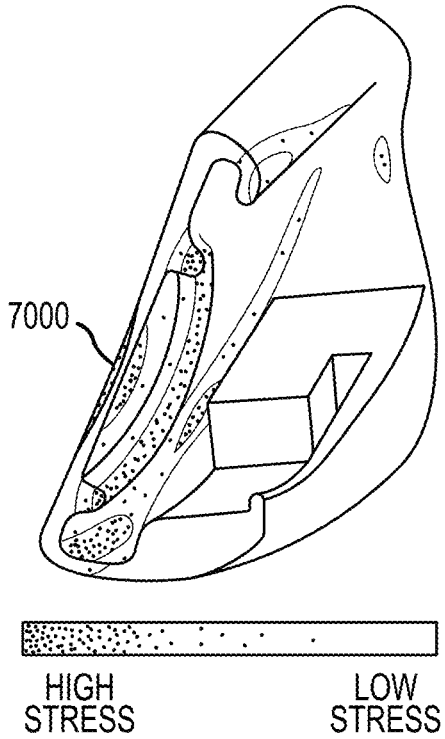
FIG. 32A is a perspective side cross-sectional view of a stress simulation of a control golf club head having a reinforcement device with a large rib span during impact with a golf ball.
Figure 32B:
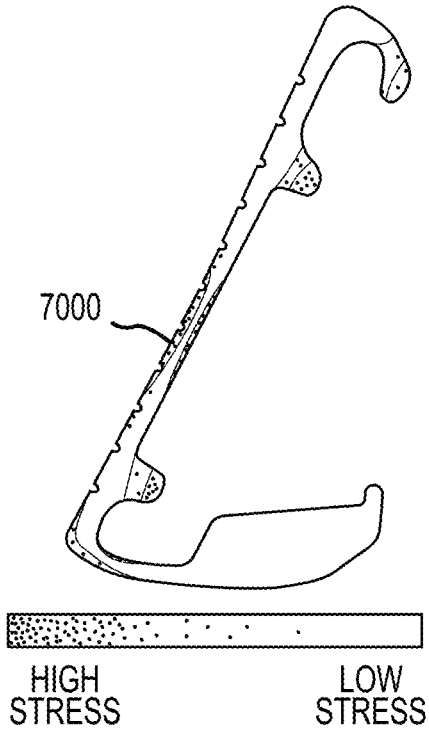
FIG. 32B is a side cross-sectional view of the club head of FIG. 32A.
Figure 32C:
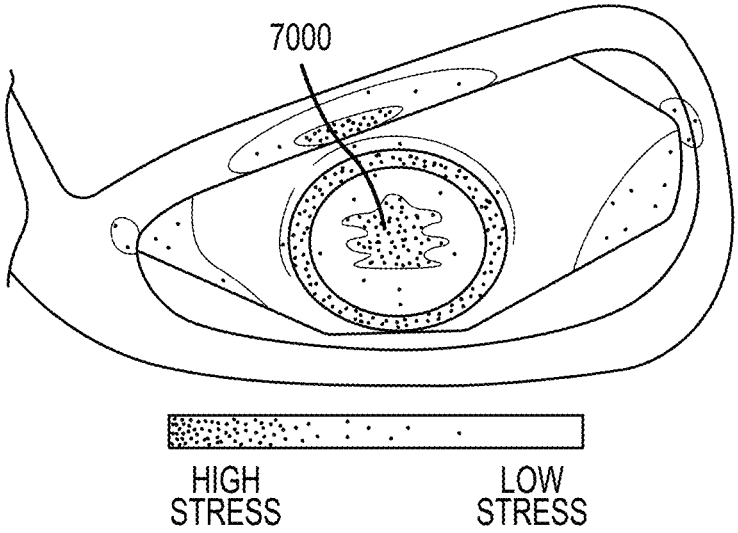
FIG. 32C is a rear perspective view of the club head of FIG. 32A.

Referring to FIGS. 32A-32C, a control club head comprises a reinforcement device having a rib span of 2.54 centimeters, larger than the rib span of the reinforcement device of the exemplary club head 100. The rib span larger than the described rib span results in a large portion of the impact stress concentrating centrally on the front and rear of the face element, creating a stress riser on the face element.

Figure 33A:
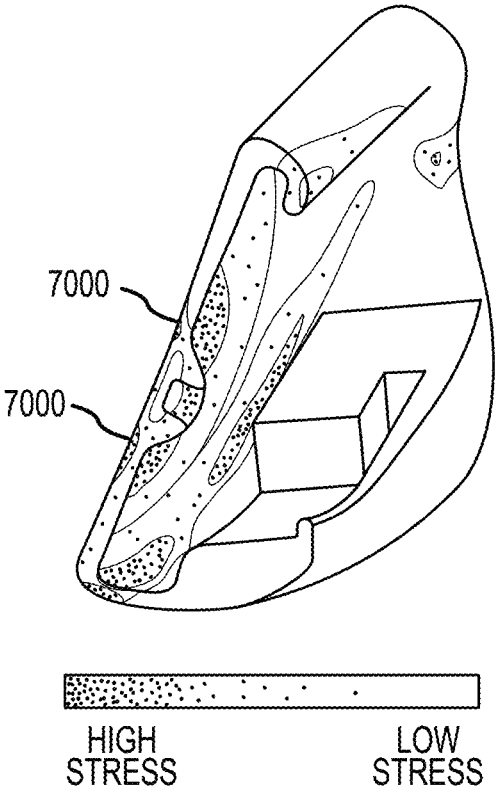
FIG. 33A is a perspective side cross-sectional view of a stress simulation of a control golf club head having a reinforcement device with a small rib span during impact with a golf ball.
Figure 33B:
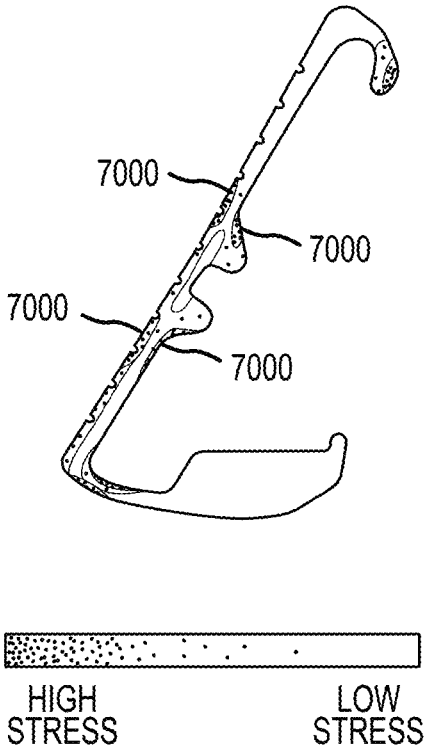
FIG. 33B is a side cross-sectional view of the club head of FIG. 33A.
Figure 33C:
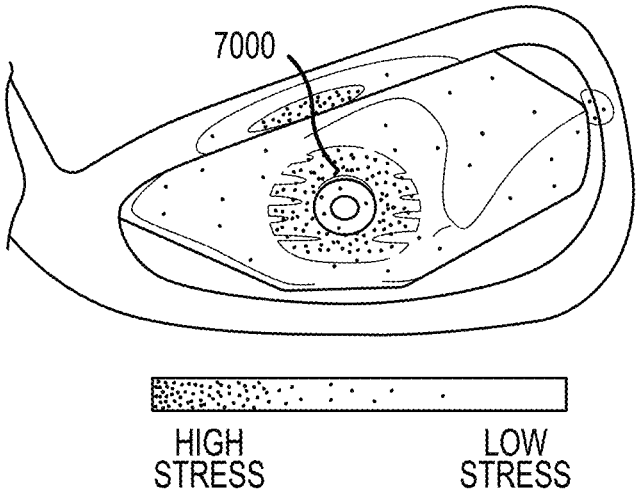
FIG. 33C is a rear perspective view of the club head of FIG. 33A.

Referring to FIGS. 33A-33C, a control club head comprises a reinforcement device having a rib span of 0.51 centimeters, smaller than the rib span of the reinforcement device 112 of the exemplary club head 100. The rib span smaller than the described rib span can result in a large portion of the impact stress concentrating on the front and rear of the face element around the perimeter of the reinforcement element, creating a stress rise on the face element.

Figure 34A:
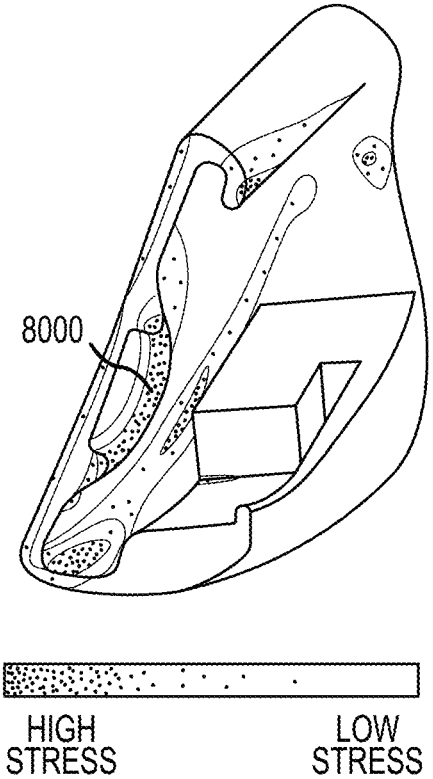
FIG. 34A is a perspective side cross-sectional view of a stress simulation of an exemplary golf club head having a reinforcement device with a rib span according to the disclosure during impact with a golf ball.
Figure 34B:
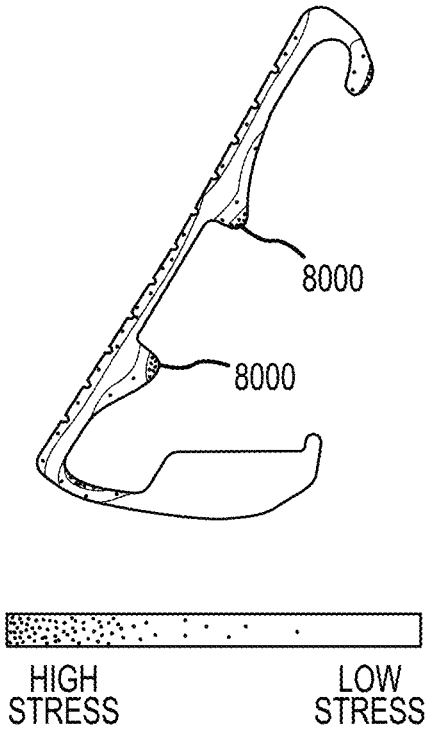
FIG. 34B is a side cross-sectional view of the club head of FIG. 34A.
Figure 34C:
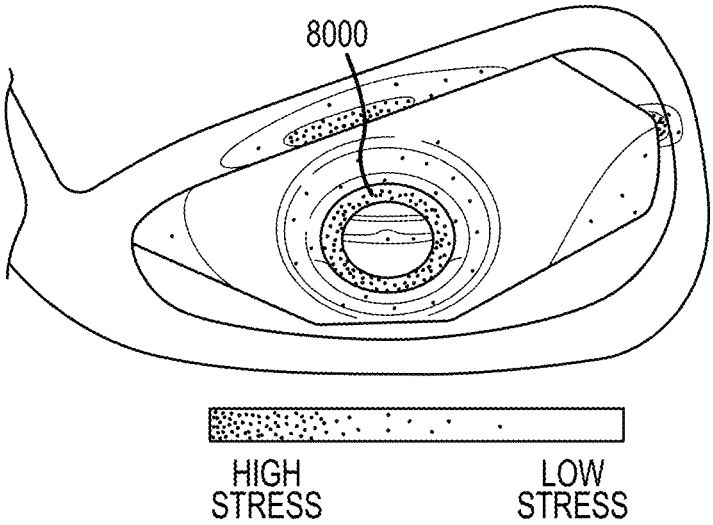
FIG. 34C is a rear perspective view of the club head of FIG. 34A.

Referring to to FIGS. 34A-34C, the exemplary club head having a rib span 538 of 1.65 centimeters, corresponding to the impact area of a golf ball results in significant stresses being transferred away from the face element 111 and into the reinforcement device 112, thereby reducing the stress on the face element 111. The low tensile stress observed on the rear surface of the face element 111, as illustrated in FIGS. 34A-34C, having the described rib span 538 and fillet, is an efficient stress distribution for a golf club/golf ball impact.

The exemplary club head 100 comprising the reinforcement device 112 having a fillet between the outer perimeter surface of the reinforcement device 112 and the rear surface 115 of the face element 111, a face thickness of approximately 0.075 inch within the inner perimeter surface 129 relative to the outer perimeter surface 126 of the reinforcement device 112, and a rib span of 1.65 centimeters allows the club head 100 to transfer stress away from the face element 111 and into the reinforcement device 112 thereby improving club head durability while increasing face deflection and ball speed during golf ball impacts.

Example 3

Variable Face Thickness Vs. Reinforcement Device Test

An exemplary iron-type club head 1700 comprising a face element having an angled variable face element thickness (VFT), and a 360 undercut was compared to a control iron-type club head 1600 comprising a reinforcement device and a 360 undercut. The exemplary iron-type club head 1700 comprises a central thickness of 0.113 inch, a perimeter thickness of 0.088 inch, and a variable face thickness angled towards the toe end and the top end. The control iron-type club head 1600 comprises a central thickness of 0.075 inch and a perimeter thickness of 0.088 inch.

A test was conducted to compare the ball speed between the exemplary iron-type club head 1700 and the control iron-type club head 1600. The test used finite element simulations that modeled an impact of a golf ball on the face element with a ball speed of 100 mph. The test measured the internal energy (lbf-inch) vs. time (seconds). The test resulted in the exemplary iron-type club head 1700 having an internal energy of approximately 52 lbf-inch and the control iron-type club head 1600 having an internal energy of approximately 48 lbf-inch. The internal energy increase of 4 lbf-inch between the exemplary club head 1700 and the control club head 1600 approximately equates to an increase of 0.5 to 0.85 mph in ball speed, and approximately a increase of 4 to 6 yards in ball carry distance. The increased ball speed of the exemplary club head 1700 is due to the combination of the 360 undercut and the angled variable face thickness providing a greater sweet spot for off center hits. Although the control club head 1600 has a thinner face element at the center for greater deflection, the larger sweet spot of the angled VFT and 360 undercut provides an overall greater deflection with optimal ball flight, spin, and distance. More specifically, a player can hit off center hits near the toc end of the exemplary club head 1700, and still achieve optimal ball speed and distance. Further, the reinforcement device of the control club head 1500 provides a smaller sweet spot thereby requiring the player to hit precise shots at the center of the face element to achieve optimal ball speed and distance.

Further, while the above examples may be described in connection with an iron-type golf club head, the apparatus, methods, and articles of manufacture described herein may be applicable to other types of golf clubs such as a wood-type golf club or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

Clause 1: A golf club head comprising: a front end and a rear end; a face element comprising a face surface located at the front end and a rear surface located at the rear end; the face element comprises a face center, a face perimeter, and a thickness measured from the face surface to the rear surface; the face element includes a perimeter region comprising a constant perimeter thickness and extending inward from the face perimeter toward the face center; the face element includes a transition region comprising a varying transition thickness and extending inward from the perimeter region toward the face center; the face element includes a central region encompassing the face center, the central region comprising a constant central thickness and extending inward from the transition region toward the face center; wherein the perimeter thickness comprises a minimum thickness of the face element; wherein the central thickness comprises a maximum thickness of the face element; a top end and a bottom end; the top end having a top rail extending in an arcuate fashion toward the bottom end to form a top rail wall; the bottom end having a sole and a rear portion that integrally forms with the sole, where the rear portion extends upward toward the top end; a toe end and a heel end; the toc end divided into a first toe end portion, a second toe end portion, and a third toe end portion; wherein the first toe end portion is adjacent to and integral with the top end, the third toe end portion is adjacent to and integral with the bottom end, and the second toe end portion is positioned between the first toe end portion and the third toe end portion; wherein the toe end comprises a toe ledge extending in a curved manner toward the top rail, the sole, and the heel end, the toe ledge is integral with the top rail wall and the rear portion; and wherein the heel end comprises a heel ledge extending in a curved manner toward the top rail, the sole, and the toe end, the heel ledge is integral with the top rail wall and the rear portion; an undercut comprising a first cavity, a second cavity, a third cavity, a fourth cavity, and a fifth cavity; wherein: the first cavity is formed between the rear surface and the top rail wall, the first cavity having a first depth ranging from 0.115 inch to 0.135 inch; the second cavity is formed between the rear surface and the rear portion, the second cavity having a second depth ranging from 0.460 inch to 0.580 inch; the third cavity is formed between the rear surface and the toe ledge at the first toe end portion having a third depth ranging from 0.215 inch to 0.245 inch; the fourth cavity is formed between the rear surface and the toe ledge at the second toe end portion having a fourth depth ranging from 0.140 inch to 0.165 inch; the fifth cavity is formed between the rear surface and the heel ledge, the fifth cavity having a fifth depth ranging from 0.080 inch to 0.110 inch.

Clause 2: The golf club head of clause 1, wherein the first cavity, the second cavity, the third cavity, the fourth cavity, and the fifth cavity are interrupted and non-continuous by an interrupting structure.

Clause 3: The golf club head of clause 1, wherein: the perimeter thickness ranges from 0.06 inch to 0.10 inch; and the central thickness ranges from 0.09 inch to 0.15 inch.

Clause 4: The golf club head of clause 1, further comprising a cascading sole at the bottom end of the second cavity, wherein the cascading sole comprises a first tier, a second tier, and a third tier.

Clause 5: The golf club head of clause 4, wherein the first tier comprises a greater thickness than a thickness of the second tier, and the second tier comprises a greater thickness than a thickness of the third tier.

Clause 6: The golf club head of clause 1, wherein the toe ledge at third toe end portion covers a greater percentage of the rear surface than the first toe end portion and the second toe end portion.

Clause 7: The golf club head of clause 1, wherein the central region comprises a central region center offset from the face center.

Clause 8: The golf club head of clause 1, further comprising a first aperture positioned at the toe end of the club head and a second aperture positioned in a hosel of the club head, wherein the first aperture is configured to receive a first weight and the second aperture is configured to receive a second weight.

Clause 9: The golf club head of clause 8, wherein the club head comprises a club head center of gravity position, the first weight comprise a first weight center of gravity position, the second weight comprises a second weight center of gravity position.

Clause 10: The golf club head of clause 9, wherein a first distance is defined between the club head center of gravity position and the first weight center of gravity position, and a second distance is defined between the club head center of gravity position and the second weight center of gravity position, wherein the first distance and the second distance are equal.

Clause 11: A golf club head comprising: a front end and a rear end; a face element comprising a face surface located at the front end and a rear surface located at the rear end; the face element comprises a face center, a face perimeter, and a thickness measured from the face surface to the rear surface; the face element includes a perimeter region comprising a constant perimeter thickness and extending inward from the face perimeter toward the face center; the face element includes a transition region comprising a varying transition thickness and extending inward from the perimeter region toward the face center; the face element includes a central region encompassing the face center, the central region comprising a constant central thickness and extending inward from the transition region toward the face center; wherein the perimeter thickness comprises a minimum thickness of the face element; wherein the central thickness comprises a maximum thickness of the face element; a top end and a bottom end; the top end having a top rail extending in an arcuate fashion toward the bottom end to form a top rail wall; the bottom end having a sole and a rear portion that integrally forms with the sole, where the rear portion extends upward toward the top end; a toe end and a heel end; the toc end divided into a first toc end portion, a second toe end portion, and a third toc end portion; wherein the first toe end portion is adjacent to and integral with the top end, the third toc end portion is adjacent to and integral with the bottom end, and the second toe end portion is positioned between the first toe end portion and the third toe end portion; wherein the toe end comprises a toe ledge extending in a curved manner toward the top rail, the sole, and the heel end, the toe ledge is integral with the top rail wall and the rear portion; and wherein the heel end comprises a heel ledge extending in a curved manner toward the top rail, the sole, and the toc end, the heel ledge is integral with the top rail wall and the rear portion; an undercut comprising a first cavity, a second cavity, a third cavity, a fourth cavity, and a fifth cavity; wherein: the first cavity is formed between the rear surface and the top rail wall, the first cavity having a first depth ranging from 0.115 inch to 0.135 inch; the second cavity is formed between the rear surface and the rear portion, the second cavity having a second depth ranging from 0.460 inch to 0.580 inch; the third cavity is formed between the rear surface and the toe ledge at the first toe end portion having a third depth ranging from 0.215 inch to 0.245 inch; the fourth cavity is formed between the rear surface and the toe ledge at the second toe end portion having a fourth depth ranging from 0.140 inch to 0.165 inch; the fifth cavity is formed between the rear surface and the heel ledge, the fifth cavity having a fifth depth ranging from 0.080 inch to 0.110 inch; and the first cavity, the second cavity, the third cavity, the fourth cavity, and the fifth cavity are all integrally connected and continuous.

Clause 12: The golf club head of clause 11, wherein: the perimeter thickness ranges from 0.06 inch to 0.10 inch; and the central thickness ranges from 0.09 inch to 0.15 inch.

Clause 13: The golf club head of clause 11 further comprising a cascading sole at the bottom end of the second cavity, wherein the cascading sole comprises a first tier, a second tier, and a third tier.

Clause 14: The golf club head of clause 13, wherein the first tier comprises a greater thickness than a thickness of the second tier, and the second tier comprises a greater thickness than a thickness of the third tier Clause 15: The golf club head of clause 11, wherein the toe ledge at third toe end portion covers a greater percentage of the rear surface than the first toe end portion and the second toe end portion.

Clause 16: The golf club head of clause 11, wherein the central region comprises a central region center offset from the face center.

Clause 17: The golf club head of clause 11, further comprising a first aperture positioned at the toe end of the club head and a second aperture positioned in a hosel of the club head, wherein the first aperture is configured to receive a first weight and the second aperture is configured to receive a second weight.

Clause 18: The golf club head of clause 17, where the first weight comprises a weight greater than a weight of the second weight.

Clause 19: The golf club head of clause 17, wherein the club head comprises a club head center of gravity position, the first weight comprises a first weight center of gravity position, and the second weight comprises a second weight center of gravity position.

Clause 20: The golf club head of clause 19, wherein a first distance is defined between the club head center of gravity position and the first weight center of gravity position, and a second distance is defined between the club head center of gravity position and the second weight center of gravity position, wherein the first distance and the second distance are equal.

The golf club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a front end and a rear end;

a face element comprising a face surface located at the front end and a rear surface located at the rear end;

the face element comprises a face center, a face perimeter, and a thickness measured from the face surface to the rear surface;

the face element includes a perimeter region comprising a constant perimeter thickness and extending inward from the face perimeter toward the face center;

the face element includes a transition region comprising a varying transition thickness and extending inward from the perimeter region toward the face center;

the face element includes a central region encompassing the face center, the central region comprising a constant central thickness and extending inward from the transition region toward the face center;

wherein the constant perimeter thickness comprises a minimum thickness of the face element;

wherein the constant central thickness comprises a maximum thickness of the face element;

a top end and a bottom end;

the top end having a top rail extending in an arcuate fashion toward the bottom end to form a top rail wall;

the bottom end having a sole and a rear portion that integrally forms with the sole, where the rear portion extends upward toward the top end;

a toe end and a heel end;

the toe end divided into a first toe end portion, a second toe end portion, and a third toe end portion;

wherein the first toe end portion is adjacent to and integral with the top end, the third toe end portion is adjacent to and integral with the bottom end, and the second toe end portion is positioned between the first toe end portion and the third toe end portion;

wherein the first toe end portion covers 7% to 15% of the rear surface, the second toe end portion covers 4% to 7% of the rear surface, and the third toe end portion cover 12% to 20% of the rear surface;

wherein the second toe end portion covers the smallest percentage of the rear surface relative to the first toe end portion and the third toe end portion;

wherein the toe end comprises a toe ledge extending in a curved manner toward the top rail, the sole, and the heel end, the toe ledge is integral with the top rail wall and the rear portion;

wherein the heel end comprises a heel ledge extending in a curved manner toward the top rail, the sole, and the toe end, the heel ledge is integral with the top rail wall and the rear portion; and an undercut comprising a first cavity, a second cavity, a third cavity, a fourth cavity, and a fifth cavity.

2. The golf club head of claim 1, wherein the first cavity, the second cavity, the third cavity, the fourth cavity, and the fifth cavity are interrupted and non-continuous by an interrupting structure.

3. The golf club head of claim 1, wherein:

the constant perimeter thickness ranges from 0.06 inch to 0.10 inch; and the constant central thickness ranges from 0.09 inch to 0.15 inch.

4. The golf club head of claim 1, further comprising a cascading sole at the bottom end of the second cavity, wherein the cascading sole comprises a first tier, a second tier, and a third tier.

5. The golf club head of claim 4, wherein the first tier comprises a greater thickness than a thickness of the second tier, and the second tier comprises a greater thickness than a thickness of the third tier.

6. The golf club head of claim 1, wherein the toe ledge at third toe end portion covers a greater percentage of the rear surface than the first toe end portion and the second toe end portion.

7. The golf club head of claim 1, wherein the central region comprises a central region center offset from the face center.

8. The golf club head of claim 1, further comprising a first aperture positioned at the toe end of the golf club head and a second aperture positioned in a hosel of the golf club head, wherein the first aperture is configured to receive a first weight and the second aperture is configured to receive a second weight.

9. The golf club head of claim 8, wherein the golf club head comprises a club head center of gravity position, the first weight comprise a first weight center of gravity position, the second weight comprises a second weight center of gravity position.

10. The golf club head of claim 9, wherein a first distance is defined between the club head center of gravity position and the first weight center of gravity position, and a second distance is defined between the club head center of gravity position and the second weight center of gravity position, wherein the first distance and the second distance are equal.

11. A golf club head comprising:

a front end and a rear end;

a face element comprising a face surface located at the front end and a rear surface located at the rear end;

the face element comprises a face center, a face perimeter, and a thickness measured from the face surface to the rear surface;

the face element includes a perimeter region comprising a constant perimeter thickness and extending inward from the face perimeter toward the face center;

the face element includes a transition region comprising a varying transition thickness and extending inward from the perimeter region toward the face center;

the face element includes a central region encompassing the face center, the central region comprising a constant central thickness and extending inward from the transition region toward the face center;

wherein the constant perimeter thickness comprises a minimum thickness of the face element;

wherein the constant central thickness comprises a maximum thickness of the face element;

a top end and a bottom end;

the top end having a top rail extending in an arcuate fashion toward the bottom end to form a top rail wall;

the bottom end having a sole and a rear portion that integrally forms with the sole, where the rear portion extends upward toward the top end;

a toe end and a heel end;

the toe end divided into a first toe end portion, a second toe end portion, and a third toe end portion;

wherein the first toe end portion is adjacent to and integral with the top end, the third toe end portion is adjacent to and integral with the bottom end, and the second toe end portion is positioned between the first toe end portion and the third toe end portion;

wherein the first toe end portion covers 7% to 15% of the rear surface, the second toe end portion covers 4% to 7% of the rear surface, and the third toe end portion cover 12% to 20% of the rear surface;

wherein the second toe end portion covers the smallest percentage of the rear surface relative to the first toe end portion and the third toe end portion;

wherein the toe end comprises a toe ledge extending in a curved manner toward the top rail, the sole, and the heel end, the toe ledge is integral with the top rail wall and the rear portion; and wherein the heel end comprises a heel ledge extending in a curved manner toward the top rail, the sole, and the toe end, the heel ledge is integral with the top rail wall and the rear portion;

an undercut comprising a first cavity, a second cavity, a third cavity, a fourth cavity, and a fifth cavity; and wherein the first cavity, the second cavity, the third cavity, the fourth cavity, and the fifth cavity are all integrally connected and continuous.

12. The golf club head of claim 11, wherein:

the constant perimeter thickness ranges from 0.06 inch to 0.10 inch; and the constant central thickness ranges from 0.09 inch to 0.15 inch.

13. The golf club head of claim 11 further comprising a cascading sole at the bottom end of the second cavity, wherein the cascading sole comprises a first tier, a second tier, and a third tier.

14. The golf club head of claim 13, wherein the first tier comprises a greater thickness than a thickness of the second tier, and the second tier comprises a greater thickness than a thickness of the third tier.

15. The golf club head of claim 11, wherein the toe ledge at third toe end portion covers a greater percentage of the rear surface than the first toe end portion and the second toe end portion.

16. The golf club head of claim 11, wherein the central region comprises a central region center offset from the face center.

17. The golf club head of claim 11, further comprising a first aperture positioned at the toe end of the golf club head and a second aperture positioned in a hosel of the golf club head, wherein the first aperture is configured to receive a first weight and the second aperture is configured to receive a second weight.

18. The golf club head of claim 17, where the first weight comprises a weight greater than a weight of the second weight.

19. The golf club head of claim 17, wherein the golf club head comprises a club head center of gravity position, the first weight comprises a first weight center of gravity position, and the second weight comprises a second weight center of gravity position.

20. The golf club head of claim 19, wherein a first distance is defined between the club head center of gravity position and the first weight center of gravity position, and a second distance is defined between the club head center of gravity position and the second weight center of gravity position, wherein the first distance and the second distance are equal.

* * * * *